US006264302B1

(12) United States Patent
Imanaka et al.

(10) Patent No.: US 6,264,302 B1
(45) Date of Patent: Jul. 24, 2001

(54) DETECTION OF A DISCHARGE STATE OF INK IN AN INK DISCHARGE RECORDING HEAD

(75) Inventors: Yoshiyuki Imanaka, Kawasaki; Toshio Kashino, Chigasaki; Shuji Koyama, Kawasaki; Yoshie Asakawa, Hotaka-machi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/447,241

(22) Filed: Nov. 23, 1999

Related U.S. Application Data

(62) Division of application No. 08/890,646, filed on Jul. 9, 1997, now Pat. No. 5,992,984.

(30) Foreign Application Priority Data

Jul. 9, 1996 (JP) ..... 8-179687
Jul. 12, 1996 (JP) ..... 8-183654
Jul. 9, 1997 (JP) ..... 9-183982

(51) Int. Cl.[7] ..... B41J 29/393; B41J 2/14; B41J 2/05

(52) U.S. Cl. ..... 347/19; 347/48; 347/65; 347/67

(58) Field of Search ..... 347/7, 63, 65, 347/68, 19, 23, 14, 67, 48

(56) References Cited

U.S. PATENT DOCUMENTS 4,550,327 * 10/1985 Miyakawa ..... 347/19
4,723,129 2/1988 Endo et al. ..... 347/56
4,853,718 8/1989 ElHatem et al. ..... 347/7
5,182,580 * 1/1993 Ikeda et al. ..... 347/19
5,189,443 2/1993 Arashima et al. ..... 347/63
5,237,342 8/1993 Saikawa et al. ..... 347/87
5,278,585 1/1994 Karz et al. ..... 347/65
5,280,299 1/1994 Saikawa et al. ..... 347/87
5,315,316 * 5/1994 Khormaee ..... 347/19
5,500,657 3/1996 Yauchi et al. ..... 347/9
5,534,898 7/1996 Kashino et al. ..... 347/33
5,619,238 4/1997 Higuma et al. ..... 347/86

FOREIGN PATENT DOCUMENTS 436 047 1/1990 (EP) ..... B41J/2/055
443 798 2/1992 (EP) ..... B41J/2/14
55-81172 6/1955 (JP) .
59-26270 2/1959 (JP) .
61-59911 12/1961 (JP) .
61-59914 12/1961 (JP) .
61-59916 12/1961 (JP) .
63-197652 8/1963 (JP) .
63-199972 8/1963 (JP) .
4-41251 2/1992 (JP) .
5-124189 5/1993 (JP) ..... B41J/2/05
5-131644 5/1993 (JP) ..... B41J/2/175

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

This invention provides, in a novel liquid discharge method utilizing a movable member, a configuration for detecting presence or absence of liquid in the liquid path or discharge state of the liquid. In an embodiment of this invention, the element substrate of the liquid discharge head is rendered electrically conductive and a partition wall for separating a liquid path for the liquid to be discharged and a liquid path for generating energy for liquid discharge upon heating is also rendered electrically conductive, and a detecting pulse is applied to the partition wall to detect the difference in potential or the variation in electrostatic capacitance between the element substrate and the partition wall, whereby the presence or absence of liquid in the small liquid path is detected.

Also in another embodiment, the electrostatic capacitance between a fixed electrode provided in a fixed position of the liquid discharge head and a movable electrode provided on the movable member is detected, and the discharge state of the liquid is judged according to the function state of the movable member.

10 Claims, 35 Drawing Sheets

DETECTION OF A DISCHARGE STATE OF INK IN AN INK DISCHARGE RECORDING HEAD

This application is a division of application Ser. No. 08/890,646, filed Jul. 9, 1997, allowed now U.S. Pat. No. 5,992,984.

BACK GROUND OF THE INVENTION

1. Field of the Invention

The present invention relates to a liquid discharging head for discharging desired liquid by bubble generation induced by application of thermal energy to liquid, a head cartridge and a liquid discharging apparatus utilizing such liquid discharging head, and more particularly a liquid discharging head having a movable member capable of displacement by bubble generation, and a head cartridge and a liquid discharging apparatus utilizing such liquid discharging head.

The present invention is applicable to an apparatus such as a printer for printing on various recording media such as paper, yarn, fiber, textile, leather, metal, plastics, glass, timber, ceramics etc., a copying machine, a facsimile provided with a communication system, or a word process provided with a printer unit, and also to an industrial printing apparatus integrally combined with various processing apparatus.

In the present invention, the word "record" means not only provision, onto the recording medium, of a meaningful image such as a character or graphics but also provision of a meaningless image such as a pattern.

2. Related Background Art

There is already known an ink jet printing method, so-called bubble jet printing method, which achieves image formation by providing ink with energy such as heat to induce a state change in the ink, involving a rapid volume change (generation of a bubble), discharging ink from a discharge port by the action force based on such state change, and depositing thus discharged ink onto a recording medium. In the printing apparatus utilizing such bubble jet printing method, there are generally provided, as disclosed for example in the Japanese Patent Publication Nos. 61-59911 and 61-59914, a discharge port for ink discharge, an ink flow path communicating with the discharge port, and a heat generating member (an electrothermal converting member) provided in the ink flow path and constituting energy generating means for generating energy for discharging the ink.

Such printing method provides various advantages such as printing an image of high quality at a high speed with a low noise level, and obtaining a printed image of a high resolution, even a color image, with a compact apparatus, since, in the printing head utilizing such printing method, ink discharge ports can be arranged at a high density. For this reason, such bubble jet printing method is being recently utilized, not only in various office equipment such as printers, copying machines and facsimile apparatus but also in industrial systems such as textile printing apparatus.

With such spreading of the bubble jet printing technology into the products of varied fields, there have emerged various requirements to be explained in the following.

For example, for a requirement for improving the efficiency of energy, there is conceived optimization of the heat generating member, such as the adjustment of the thickness of the protective film. This technology is effective in improving the efficiency of propagation of the generated heat to the liquid.

Also for obtaining the image of higher quality, there have been proposed a driving condition for satisfactory liquid discharge, realizing a higher ink discharge speed and stable bubble generation, and an improved shape of the liquid flow path for realizing a liquid discharge head with a higher refilling speed of the discharged liquid into the liquid flow path.

Also for avoiding the loss of discharge energy, resulting from a backward wave which is a pressure wave generated at the bubble generation by the discharge energy generating element in the ink path and transmitted in the direction toward the liquid chamber opposite to the direction toward the discharge port, inventions utilizing a valve mechanism as a fluid resistance element are disclosed in the Japanese Patent Laid-open Application Nos. 63-197652 and 63-199972.

FIGS. 49A and 49B are respectively an external perspective view and a cross-sectional view showing the liquid path structure of a conventional liquid discharging head.

As shown in FIGS. 49A and 49B, a backward wave preventing valve 1010 is provided at the upstream side in the ink flowing direction, namely at the side of a common liquid chamber 1012, with respect to a heat action area (a space projected from the electrothermal converting member perpendicular to the plane) in the vicinity of a heat generating member 1002 provided in an ink path 1003 for generating bubble. Such backward wave preventing valve 1010 is to prevent the loss of the discharge energy, by so functioning as to prevent the movement of the ink toward the upstream side by the backward wave.

In such configuration, however, the suppression of a part of the backward wave by the preventing valve 1010 is not practical for the liquid discharge, as will be understood by the consideration of a situation of bubble generation in the ink path 1003 containing the liquid to be discharged.

Basically, the backward wave itself does not directly contribute to the liquid discharge. When the backward wave is generated in the ink path 1003, a portion of the bubble pressure directly relating to the liquid discharge has already rendered the liquid dischargeable from the ink path 1003 as shown in FIG. 49B. Consequently it will be apparent that the suppression of the backward wave, in particular a part thereof, does not give a significant influence on the liquid discharge.

Therefore, though the above-explained conventional head with the valve mechanism for preventing the backward wave at the bubble generation can improve the liquid discharging efficiency by a certain degree by the prevention of the backward wave propagating toward the upstream side, such configuration only intends to prevent the escape of a portion, toward the upstream side, of the discharging power generated at the bubble generation and is still insufficient in achieving significant improvement in the discharge efficiency and the discharge power.

On the other hand, in the bubble jet printing method, a deposit is generated on the surface of the heat generating member by the scorching or cognation of the ink since heating is repeated in a state where the heat generating member is in contact with the ink, and, depending on the kind of the ink, such deposit is generated in a large amount to render the bubble generation unstable, whereby satisfactory ink discharge may become difficult. For this reason there has been desired a method for achieving satisfactory discharge without denaturing the liquid to be discharged, even in case of a liquid which is susceptible to heat or is incapable of sufficient bubble generation.

In view of the foregoing points, a method of constituting the liquid for generating bubble by heat (bubble generating liquid) and the liquid to be discharged (discharge liquid) by different liquids and discharging such discharge liquid by transmitting the pressure of bubble generation to such discharge liquid is disclosed for example in the Japanese Patent Publication No. 61-59916 and Japanese Patent Laid-open Application Nos. 55-81172 and 59-26270. In these patents, there is employed a configuration of completely separating the ink or discharge liquid from the bubble generating liquid with a flexible membrane such as of silicone rubber thereby avoiding the direct contact of the discharge liquid with the heat generating member, and transmitting the pressure of bubble generation in the bubble generating liquid to the discharge liquid by the deformation of the flexible membrane. It is intended by such configuration to prevent generation of deposit on the surface of the heat generating member and to increase freedom in the selection of the discharge liquid.

However, in a head of the above-explained configuration where the discharge liquid and the bubble generating liquid are completely separated, the pressure of bubble generation, to be transmitted to the discharge liquid by the elongating deformation of the flexible membrane, is considerably absorbed by such flexible membrane. Also as the amount of deformation of the flexible membrane is not so large, there will result a loss in the energy efficiency and in the discharging force, so that the desired satisfactory liquid discharge is difficult to obtain, though the effect of separation of the discharge liquid and the bubble generating liquid can be obtained.

With the recent spreading of the bubble jet technology into various fields as explained in the foregoing, there has been desired a liquid discharging head capable of achieving satisfactory liquid discharge while widening the freedom of selection of the discharge liquid with respect to the viscosity and the thermal properties.

In consideration of these points, the present applicant has already proposed:

a liquid discharge head provided with a liquid path comprising a discharge port for discharging liquid; a heat generating member for generating a bubble in said liquid by heat application thereto; and a movable member positioned so as to oppose to the heat generating member, having a free end at the side of the discharge port, and adapted to displace the free end by a pressure resulting from the bubble generation thereby guiding the pressure resulting from the bubble generation to the side of the discharge port, or a liquid discharge head comprising a first liquid path communicating with a discharge port; a second liquid path provided with a heat generating member for generating a bubble in the liquid by heat application thereto; and a movable member positioned between the first and second liquid paths, having a free end at the side of the discharge port and adapted to displace the free end toward the first liquid path by a pressure resulting from the bubble generation in the second liquid path, thereby transmitting the pressure resulting from the bubble generation toward the first liquid path.

The above-mentioned configuration can achieve liquid discharge with a high discharge efficiency and a high discharge pressure, since a major portion of the pressure resulting from the bubble generation can be transmitted, by the movable member directly to the side of the discharge port.

In particular, in the configuration in which the second liquid path including the heat generating member is separated from the first liquid path communicating with the discharge port, the pressure (pressure wave) generated in the second liquid path can be concentrated to the movable member. This pressure can further be directed, by the movable member, toward the discharge port, so that the discharge efficiency and the discharge pressure can be further increased. Also in such configuration, the liquid refilling can be achieved in satisfactory manner, since a major portion of the pressure wave transmitted to the first liquid path is directed toward the discharge port and the amount of the backward wave is quite limited in the first liquid path.

Also in case different liquids are selected as the discharge liquid in the first liquid path and the bubble generating liquid in the second liquid path in the head of the above-explained configuration, it is rendered possible to reduce deposit on the heat generating member and to satisfactorily discharge even a liquid which does not generate bubble or is limited in bubble generation, or a liquid susceptible to heat.

The liquid discharge head of such configuration including a partition wall provided with a movable member and a second liquid path containing the bubble generating liquid can be prepared, for example, by forming the walls of second liquid paths, with photosensitive resin such as a dry film, on a heater board bearing the heat generating members, and adhering the partition wall with the movable members to the heater board, or by forming the walls of the second liquid paths in advance on the partition wall provided with the movable members and then adhering such partition wall to the heater board.

The principal objective of the present invention is to elevate the basic discharge characteristics of the liquid discharging method by generating a bubble (particularly bubble formed by film boiling) in the liquid flow path to a conventionally unexpected level, based on a view point that cannot be anticipated in the past.

A part of the present inventors has made intensive research, based on the basic principle of liquid droplet discharge, to provide a conventionally unavailable liquid discharging method and a head to be used therein. In such research, there have been conducted a first technical analysis directed to the function of the movable member in the liquid path and including the analysis of working principle of the movable member in the liquid path, a second technical analysis directed to the principle of liquid discharge by the bubble, and a third technical analysis directed to the bubble generating area of the heat generating member.

These analyses have lead to the establishment of a completely novel technology, by positioning the fulcrum and the free end of the movable member in such a manner that the free end is positioned at the side of the discharge port or namely at the downstream side and also by positioning the movable member so as to face to the heat generating member or the bubble generating area.

Then, in consideration of the energy given by the bubble itself for the liquid discharge, there has been obtained a finding that the growth component at the downstream side of the bubble is the largest factor for significantly improving the discharge characteristics. It has thus been found that an efficient conversion of the growing component at the downstream side of the bubble is a key factor for improving the discharge efficiency and the discharge speed. Based on these facts, the present inventors has reached an extremely high technical level, in comparison with the conventional one, of actively displacing the growing component of the bubble at the downstream side toward the free end side of the movable member.

It has also been found out that it is preferable to consider the structural components such as the movable member and liquid path relating to the growth of bubble in the downstream side, in the liquid flowing direction, of the central line passing through the area center of the electrothermal converting member or in the downstream side of the areal center of the surface governing the bubble generation.

It has also been found out that the liquid refilling speed can be significantly improved by the consideration of arrangement of the movable member and the structure of the liquid supply path.

In the head of the above-explained novel configuration, the detection of the states of the liquids in the head, such as the presence or absence of not only the discharge liquid for recording but also the bubble generating liquid and the presence of bubbles therein, is one of the essential factors for achieving stable liquid discharge.

It is further preferable to detect the stated of the liquids in each of the plural liquid paths, such as the presence or absence of the discharge liquid and the bubble generating liquid and the presence of bubbles.

Various proposals have already been made on the means for detecting the presence or absence of the ink, including one disclosed in the Japanese Patent Application Laid-open No. 4-41251.

Means described in the above-mentioned patent specification is integrated in the element substrate and provided in the common liquid chamber for detecting the presence or absence of ink therein, but it is to be provided in the common liquid chamber and cannot detect the presence or absence of ink in each of the plural liquid path, in consideration of the size and sensitivity of the detecting element. Also the detecting sensitivity is insufficient unless the size of the electrode is made considerably large and the distance between the two electrodes is made considerably short.

SUMMARY OF THE INVENTION

The present invention has been attained in consideration of the foregoing, and a first object of the present invention is to provide a liquid discharge head capable of detecting whether a bubble is present in the vicinity of the heat generating member (presence or absence of bubble generating liquid) in each of the plural liquid paths for the purpose of effecting stable liquid discharge, and a head cartridge and a liquid discharge apparatus utilizing such liquid discharge head.

A second object of the present invention is to provide a liquid discharge head capable of detecting presence or absence of the bubble generating liquid in a small area, and a head cartridge and a liquid discharge apparatus utilizing such liquid discharge head.

A third object of the present invention is to provide a liquid discharge head capable of detecting whether a bubble is present in the vicinity of the heat generating member (presence or absence of bubble generating liquid) in each of the plural liquid paths without a significant increase in the number of terminals, and a head cartridge and a liquid discharge apparatus utilizing such liquid discharge head.

A fourth object of the present invention is to provide a liquid discharge head capable of detecting presence or absence of the bubble generating liquid almost without any increase in the cost, by incorporating means for detecting the bubble generating liquid in an element substrate together with conventionally employed elements such as the heat generating members, drivers and control logic elements, and a head cartridge and liquid discharge apparatus utilizing such liquid discharge head.

Still another object of the present invention is to enable judgment of the discharge state of liquid in a liquid discharging method based on a novel discharging principle utilizing a movable member, thereby realizing the liquid discharge in more secure manner.

Still other objects of the present invention, and the features thereof, will become fully apparent from the following description of embodiments, which is to be taken in conjunction with the attached drawings.

DETAILED DESCRIPTION OF THE PREFERRED EMBODIMENTS

Prior to the description of examples of the present invention, there will be explained, with reference to the attached drawings, embodiments of the configuration of the liquid discharge head in which the present invention is applicable.

The expression "upstream" or "downstream" used in the present text refers to the direction of flow of the liquid from the supply source thereof toward the discharge port through the bubble generation area (or the movable member), or to the direction of the same sense in the configuration.

Also the expression "downstream side" relating to the bubble itself represents a part of the bubble at the side of the discharge port, considered to directly contribute to the discharge of liquid droplet. More specifically, it means a part of the bubble generated in the downstream side in the liquid flow direction or in the above-mentioned configuration with respect to the center of the bubble, or the bubble generated in the area of the downstream side with respect to the center of area of the heat generating member.

Also the expression "substantially closing" used in the present text means a state in which, in the course of growth of the bubble, the bubble does not go through the slit around the movable member prior to the displacement thereof.

Also the expression "partition wall" used in the present text means, in a wide sense, a wall (which may include the movable member) so position as to separate the bubble generating area and an area directly communicating with the discharge port, and, in a narrow sense, a member which separates the liquid path including the bubble generating area from the liquid path directly communicating with the discharge port thereby preventing the mixing of the liquids present in the respective areas.

[First Embodiment]

The first embodiment explains the improvement in the discharge power and the discharge efficiency, by controlling the propagating direction of the pressure resulting from the bubble generation or the bubble growing direction, for the liquid discharge.

Figure 1A:
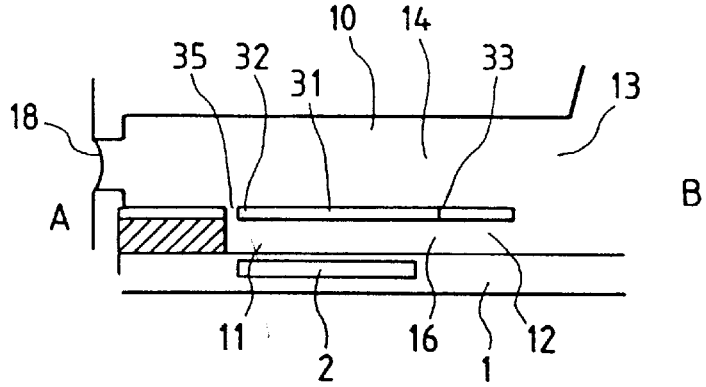
FIGS. 1A, 1B, 1C and 1D are schematic cross-sectional views showing a liquid discharge head constituting a first embodiment of the present invention.
Figure 1B:
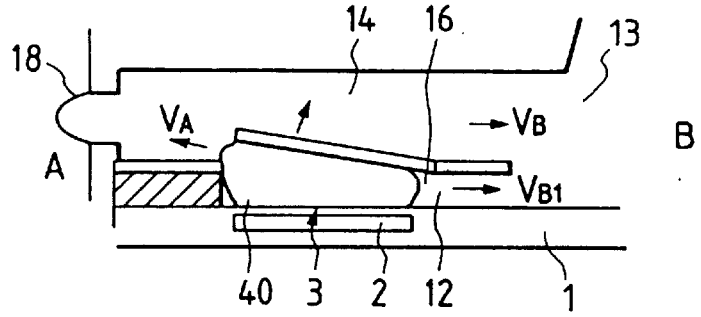
Figure 1C:
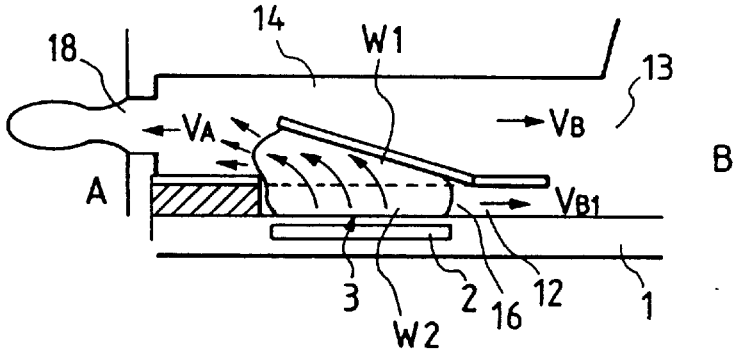
Figure 1D:
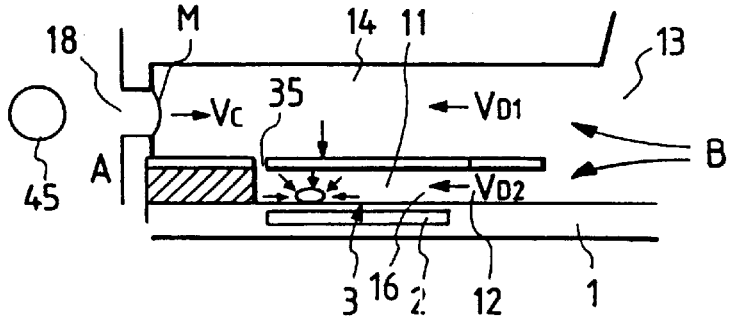
Figure 2:
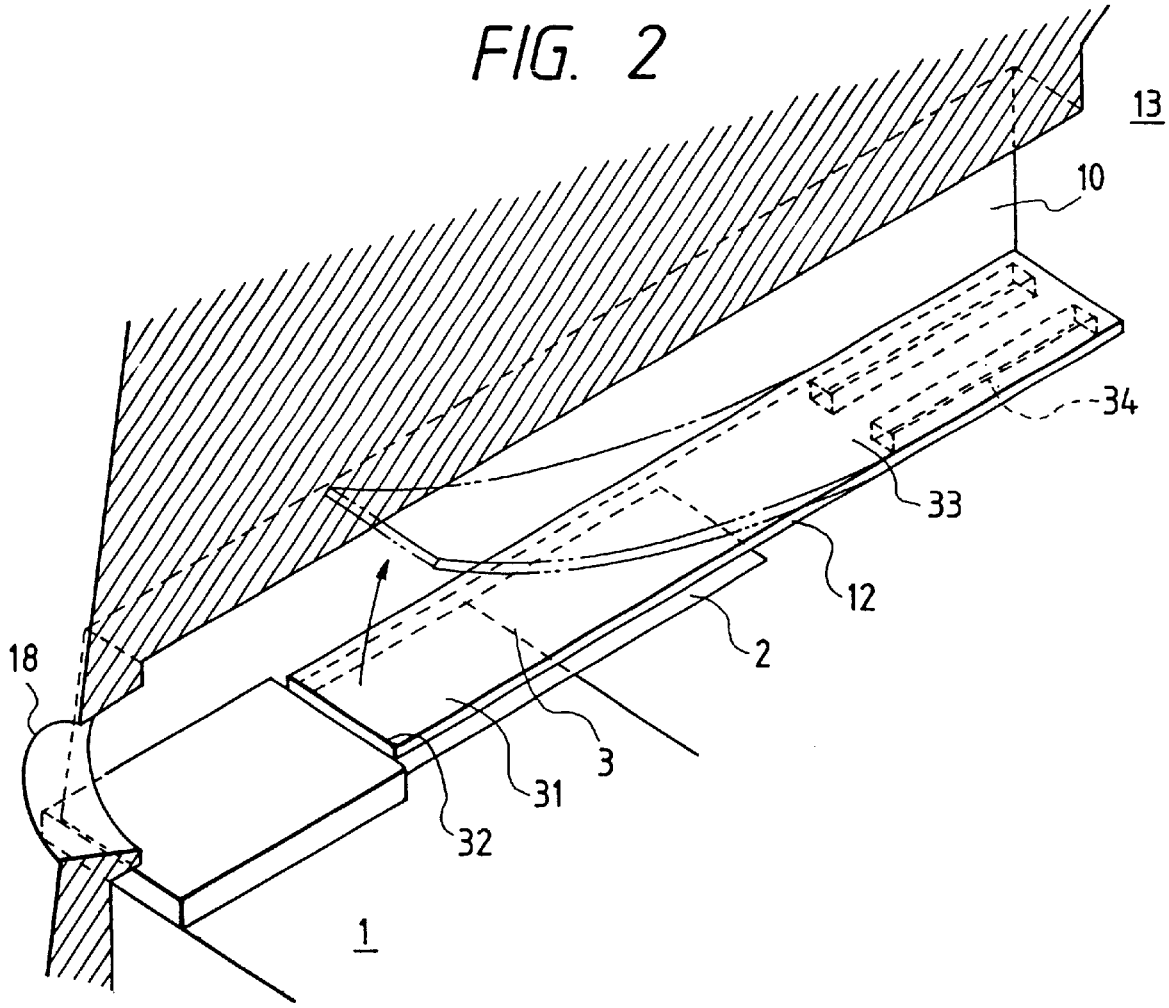
FIG. 2 is a partially cut-off perspective view of the liquid discharge head of the first embodiment of the present invention.

FIGS. 1A to 1D are schematic cross-sectional views of a liquid discharge head of a first embodiment of the present invention, and FIG. 2 is a partially cut-off perspective view thereof.

In the liquid discharge head of the present embodiment, a heat generating member 2 (a heat generating resistance member of a size of 40×105 $\mu$m in the present embodiment), applying thermal energy to the liquid and constituting the element for generating energy for liquid discharge, is provided on an element substrate 1, and a liquid path 10 is formed on the element substrate 1, corresponding to the heat generating member 2. The liquid path 10 communicates with a discharge port 18 and also communicates with a common liquid chamber 13 for supplying plural liquid paths 10 with the liquid, and receives, from the common liquid chamber 13, the liquid of an amount corresponding to that discharged from the discharge port 18.

On the element substrate 1 of the liquid path 10, a plate-shaped planar movable member 31, composed of an elastic material such as metal, is provided in the form of a beam supported at an end, so as to oppose to the heat generating member 2. An end of the movable member 31 is fixed on a support member 34, formed by patterning photosensitive resin or the like on the wall of the liquid path 10 or on the element substrate 1. Such support member supports the movable member 31 and constitutes a fulcrum portion 33.

The movable member 31 is provided in a position opposed to the heat generating member 2, with a distance of about 15 μm therefrom, so as to cover the heat generating member 2, in such a manner as to have the fulcrum (fixed end) 33 at the upstream side of the major flow from the common liquid chamber 13 to the discharge port 18 through the movable member 31 induced by the liquid discharging operation, and a free end 32 at the downstream side of the fulcrum 33. A space between the heat generating member 2 and the movable member 31 constitutes the bubble generating area. The kind, shape and arrangement of the heat generating member 2 and the movable member 31 are not limited to those explained above but may be so arbitrarily selected as to control the bubble growth and the pressure propagation as will be explained in the following. Also for facilitating the following description of the liquid flow, the liquid path 10 will be divided by the movable member 31 into a first liquid path 14 constituting a part communicating directly with the discharge port 18, and a second liquid path 16 including the bubble generating area 11 and the liquid supply chamber 12.

Heat generated by the heat generating member 2 is applied to the liquid present in the bubble generating area 11 between the movable member 31 and the heat generating member 2, thus generating a bubble in the liquid, based on a film boiling phenomenon, as described in the U.S. Pat. No. 4,723,129. The bubble and the pressure resulting from the generation thereof act preferentially on the movable member 31, whereby the movable member 31 displaces to open toward the discharge port 18 about the fulcrum 33, as shown in FIGS. 1B, 1C and 2. By the displacement of the movable member 31 or in the displaced state thereof, the propagation of the pressure resulting from the bubble generation and the growth of the bubble itself are transmitted toward the discharge port 18.

Now there will be explained one of the basic discharging principles of the present embodiment.

In the present embodiment, one of the most important principles is that the movable member 31, so positioned as to oppose to the bubble, is displaced with the growth of the bubble from a first position in the stationary state to a second position after the displacement by the pressure of the bubble or by the bubble itself, whereby the movable member 31 in the displacing motion guides the pressure resulting from the bubble generation and the bubble 40 itself toward the downstream side where the discharge port 18 is located.

This principle will be explained in further details, in comparison with the configuration of the conventional liquid path.

Figure 3:
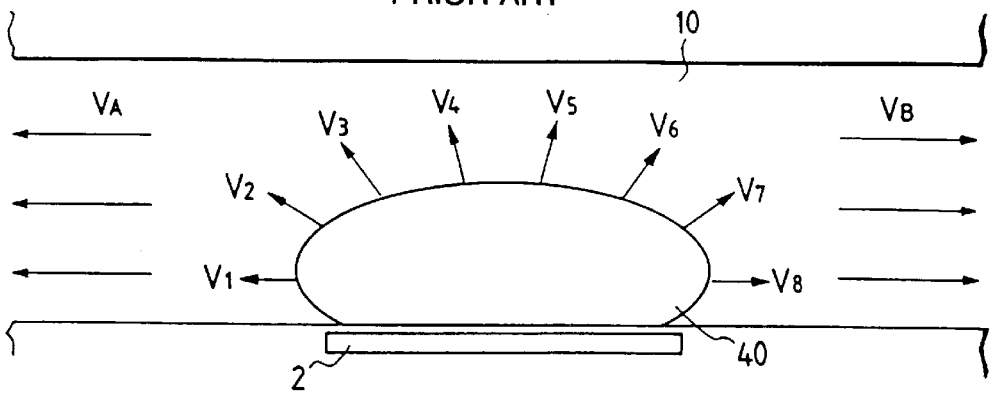
FIG. 3 PRIOR ART
FIG. 3 is a schematic view showing the propagation of pressure in a conventional head.
Figure 4:
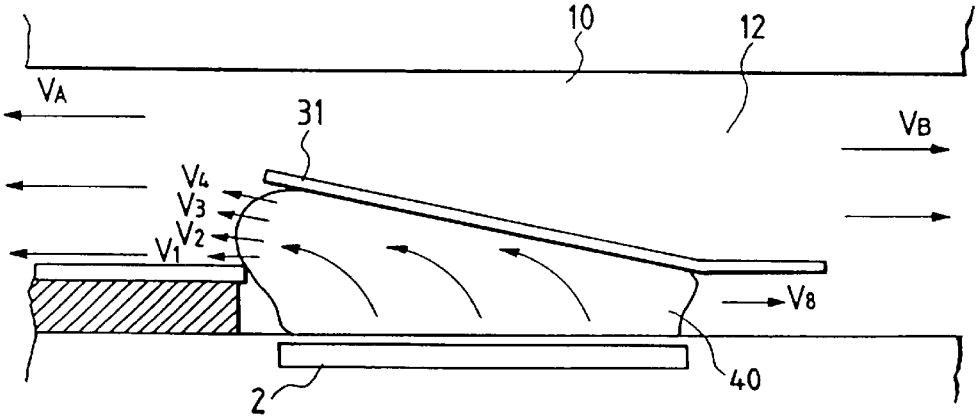
FIG. 4 is a schematic view showing the propagation of pressure in a head of the present invention.

FIG. 3 is a schematic view showing pressure propagation from the bubble in a conventional head, while FIG. 4 is a schematic view showing pressure propagation from the bubble in the head of the present embodiment, wherein $V_A$ stands for the pressure propagating direction toward the discharge port 18, and $V_B$ stands for that toward the upstream side.

The conventional head as shown in FIG. 3 lacks any configuration limiting the propagating direction of the pressure resulting from the generated bubble 40. Consequently the pressure propagates in various directions, respectively perpendicular to the surface of the bubble 40, as indicated by $V_1$–$V_8$. Among these directions, those having a component in the pressure propagating direction $V_A$ showing the largest influence on the liquid discharge are $V_1$–$V_4$, which are generated in an about a half, closer to the discharge port 18, of the bubble, and which constitute an important portion directly contributing to the liquid discharge efficiency, the liquid discharge power and the liquid discharge speed. The direction $V_1$ is most efficient as it is closest to the discharge direction $V_A$, but $V_4$ contains a relatively small component in the direction $V_A$.

On the other hand, in the configuration of the present embodiment shown in FIG. 4, the movable member 31 aligns the pressure propagating directions $V_1$–$V_4$, which are in various directions in the configuration shown in FIG. 3, toward the downstream side (toward the discharge port 18), namely in the propagating direction $V_A$, whereby the pressure of the bubble 40 contributes to the liquid discharge directly and efficiently. Also the growth of the bubble itself is guided toward the downstream side, like the pressure propagating directions $V_1$–$V_4$, whereby the bubble grows larger in the downstream side than in the upstream side. Such control of the growing direction itself of the bubble and of the pressure propagating direction thereof by the movable member 31 enables fundamental improvements in the discharge efficiency, the discharge power and the discharge speed.

Now reference is made again to FIGS. 1A to 1D, for explaining the discharge operation of the liquid discharge head of the present embodiment.

FIG. 1A shows a state prior to the heat generation of the heat generating member 2, by the application of energy such as electrical energy.

In this state, it is important that the movable member 31 is provided in a position opposed at least to the downstream portion of the bubble generated by the heat from the heat generating member 2. Stated differently, the movable member 31 is provided, in the configuration of the liquid path, at least to a position of the heat generating member 2 downstream of the areal center 3 of the heat generating member 2 (namely in a range at the downstream side of a line passing through the areal center 3 of the heat generating member 2 and perpendicular to the longitudinal direction of the liquid path), whereby the downstream side of the bubble acts on the movable member 31.

FIG. 1B shows a state in which the heat generating member 2 has generated heat by the application for example of electrical energy, to heat a part of the liquid present in the bubble generating area 11, thereby generating a bubble 40 by film boiling.

In this state the movable member 31 starts displacement from the first position, by the pressure resulting from the generation of the bubble 40 to the second position, so as to guide the propagating direction of the pressure of the bubble 40 toward the discharge port 18. It is important in this state, as explained in the foregoing, that the free end 32 of the movable member 31 is positioned at the downstream side (side of the discharge port 18) while the fulcrum 33 is positioned at the upstream side (side of the common liquid chamber 13) and that at least a part of the movable member 31 is opposed to downstream portion of the heat generating member 2, or the downstream portion of the bubble 40.

FIG. 1C shows a state in which the bubble 40 continues growth and the movable member 31 is displaced further according to the pressure resulting from the generation of the bubble 40. The generated bubble 40 grows larger in the downstream side than in the upstream side and continues growth beyond the broken-lined first position of the movable member 31. The gradual displacement of the movable member 31 in the course of the growth of the bubble 40 is considered to align the pressure propagating direction of the bubble 40 and the direction of easy volume movement thereof, namely the growth direction of the bubble toward the free end side, uniformly toward the discharge port 18, thereby improving the discharge efficiency. The movable member 31 scarcely hinders the transmission of the bubble 40 itself and the pressure thereof toward the discharge port 18, and can efficiently control the pressure propagating direction and the bubble growing direction according to the magnitude of the transmitted pressure.

FIG. 1D shows a state in which the bubble 40 contracts and vanishes by the decrease of the pressure in the bubble, after the film boiling mentioned before.

The movable member 31 which has displaced to the second position returns to the initial first position shown in FIG. 1A, by a negative pressure generated by the contraction of the bubble and the elastic returning force of the movable member 31 itself. When the bubble vanishes, in order to compensate the volume contraction of the bubble in the bubble generating area 11 and to compensate the volume of the discharged liquid, the liquid flows in as indicated by flows $V_{D1}$, $V_{D2}$ from the side of the common liquid chamber 13 and a flow $V_C$ from the side of the discharge port 18.

In the foregoing there have been explained the function of the movable member and the liquid discharging operation based on the bubble generation. In the following there will be explained the liquid refilling in the liquid discharge head of the present invention.

There will be given a detailed explanation on the liquid filling mechanism in the present invention, with reference to FIGS. 1A to 1D.

When the bubble 40 enters a vanishing stage from the state of maximum volume, after the state shown in FIG. 1D, the liquid of a volume corresponding to the vanishing bubble flows into the bubble generation area, from the side of the discharge port 18 in the first liquid path 14 and from the side of the common liquid chamber 13 in the second liquid path 16. In the conventional liquid path configuration without the movable member 31, the amount of the liquid flowing into the position of the vanishing bubble from the side of the discharge port 18 and that from the common liquid chamber 13 are determined by the flow resistances (based on the resistance of the liquid paths and the inertia of the liquid), in portions closer to the discharge port 18 and to the common liquid chamber 13.

Therefore, if the flow resistance is smaller in the side closer to the discharge port 18, a larger amount of liquid flows into the bubble vanishing position from the side of the discharge port 18, thereby increasing the amount of retraction of the meniscus. Therefore, if a smaller flow resistance is selected in the side closer to the discharge port 18 in order to improve the discharge efficiency, there results a larger amount of retraction of the meniscus M at the bubble vanishing, thus prolonging the refilling time and hindering the high-speed printing.

On the other hand, in the present embodiment involving the movable member 31, the retraction of the meniscus M stops when the movable member 31 reaches the original position in the course of bubble vanishing, and, if the bubble volume W is divided, by the first position of the movable member 31, into a volume W1 at the upper side and W2 at the side of the bubble generation area 11, the volume W2 remaining thereafter is principally replenished by the liquid flow $V_{D2}$ in the second liquid path 16. Consequently, the amount of retraction of the meniscus M, which has corresponded to about a half of the bubble volume W in the conventional configuration, can be reduced to about a half of the smaller volume W1.

Also the liquid replenishment of the volume W2 can be achieved, by the pressure at the bubble vanishing, in forced manner principally from the upstream side ($V_{D2}$) of the second liquid path, along a face of the movable member 31 at the side of the heat generating member 2, whereby faster refilling can be achieved.

The refilling operation in the conventional head utilizing the pressure at the bubble vanishing causes a significant vibration of the meniscus, leading to the deterioration of the image quality. In contrast, the high-speed refilling in the present embodiment can minimize the meniscus vibration as the movable member 31 suppresses the liquid movement between the first liquid path 14 at the side of the discharge port 18 and the bubble generating area 11.

As explained in the foregoing, the present embodiment achieves forced refilling to the bubble generating area through the liquid supply path 12 of the second liquid path 16 and the high-speed refilling by the above-explained suppression of the meniscus retraction and the meniscus vibration, thereby realizing stable discharge, high-speed repeated discharges, and improvement in the image quality and in the printing speed of the print.

The configuration of the present invention also has the following effective function, which is the suppression of propagation of the bubble-generated pressure to the upstream side (backward wave). Within the pressure resulting from the bubble generated on the heat generating member 2, that based on the bubble at the side of the common liquid chamber 13 (upstream side) forms a force (backward wave) which pushes back the liquid toward the upstream side. Such backward wave creates a pressure in the upstream side, a resulting liquid movement and an inertial force associated with the liquid movement, which retard the liquid refilling into the liquid path and hinder the high-speed drive.

On the other hand, in the configuration of the present embodiment, the movable member 31 suppresses these actions toward the upstream side, thereby further improving the refilling ability.

In the following there will be explained other features in the configuration and other advantages of the present embodiment.

The second liquid path 16 of the present embodiment is provided with a liquid supply path 12 with an internal wall which is connected with the upstream side of the heat generating member 2 in substantially flat manner (without a significant recess in the portion of the heat generating member 2). In such configuration, the liquid is supplied to the bubble generating area 11 and the surface of the heat generating member 2 by a flow $V_{D2}$, along a face of the movable member 31 close to the bubble generating area 11. Such mode of liquid supply suppresses stagnation of the liquid on the surface of the heat generating member 2, thereby preventing separation of the gas dissolved in the liquid, also facilitating the elimination of so-called remaining bubble that could not vanish totally, and also avoiding excessive heat accumulation in the liquid. Consequently the bubble generation can be repeated at a high speed, in more stable manner. The present embodiment discloses a configuration having the liquid supply path 12 with a substantially flat internal wall, but there may be employed any liquid supply path that has a smooth internal wall connected smoothly with the surface of the heat generating member 2 so as not to cause liquid stagnation thereon or significant turbulence in the liquid supply.

The liquid supply to the bubble generating area 11 is also conducted by a path $V_{D1}$, through a side (slit 35) of the movable member 31. However, the liquid flow to the bubble generating area 11 through such path $V_{D1}$ is hindered in case the movable member 31 is so formed as to cover the entire bubble generating area or the entire area of the heat generating member 2 as shown in FIG. 1A in order to more effectively guide the pressure of the bubble generation to the discharge port 18 and so formed, upon returning to the first position, as to increase the flow resistance of the liquid between the bubble generating area 11 and the area of the first liquid path 14 closer to the discharge port 18. Nevertheless, the head configuration of the present invention realizes very high liquid refilling ability because of the presence of the flow path $V_{D2}$ to the bubble generating area, so that the liquid supply performance is not deteriorated even when the movable member 31 is so formed as to cover the entire bubble generating area 11 for improving the discharge efficiency.

Figure 5:
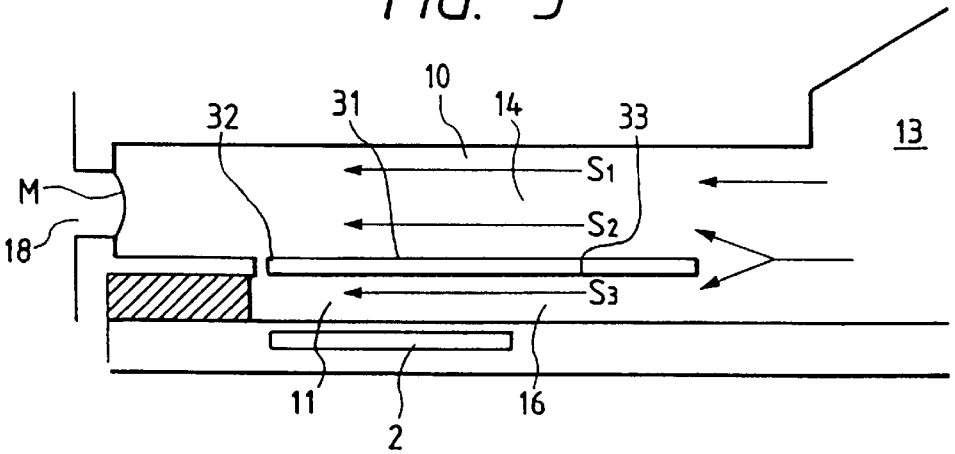
FIG. 5 is a schematic view showing the flow of liquid in the present invention.

FIG. 5 is a schematic view showing the liquid flow in the present embodiment.

The movable member 31 is so constructed, as shown in FIG. 5, that the free end 32 is positioned at the downstream side, with respect to the fulcrum 33. Such configuration allows to realize, at the bubble generation, the aforementioned functions and effects such as aligning the pressure propagating direction of the bubble and the growing direction thereof toward the discharge port 18. Also such positional relationship attains, in addition to the functions and effects relating to the liquid discharge, a lower flow resistance for the liquid flowing in the liquid path 10, thereby enabling high-speed refilling. This is because the free end 32 and the fulcrum 33 are so positioned, as shown in FIG. 5, that the movable member 31 is not against the flows S1, S2, S3 in the liquid path 10 (including the first liquid path 14 and the second liquid path 16) at the returning of the retracted meniscus M to the discharge port 18 by the capillary force or at the liquid replenishment for the vanished bubble.

In more details, in the present embodiment shown in FIGS. 1A to 1D, the free end 32 of the movable member 31 is so extended with respect to the heat generating member 2, as already explained in the foregoing, as to oppose to a position which is at the downstream side of the areal center 3 (a line passing the areal center of the heat generating member 2 perpendicularly to the longitudinal direction of the liquid path) which divides the heat generating member 2 into the upstream area and the downstream area. Because of such structure, the pressure or the bubble, generated at the downstream side of the areal center position 3 of the heat generating member 2 and significantly contributing to the liquid discharge, is received by the movable member 31 and can thus be directed toward the discharge port 18, whereby a fundamental improvement can be achieved in the discharge efficiency and the discharge power.

In addition, the upstream side of the bubble is also utilized to attain various effects.

Also in the configuration of the present embodiment, the instantaneous mechanical displacement of the free end of the movable member 31 is considered to effectively contribute to the liquid discharge.

[Second Embodiment]

Figure 6:
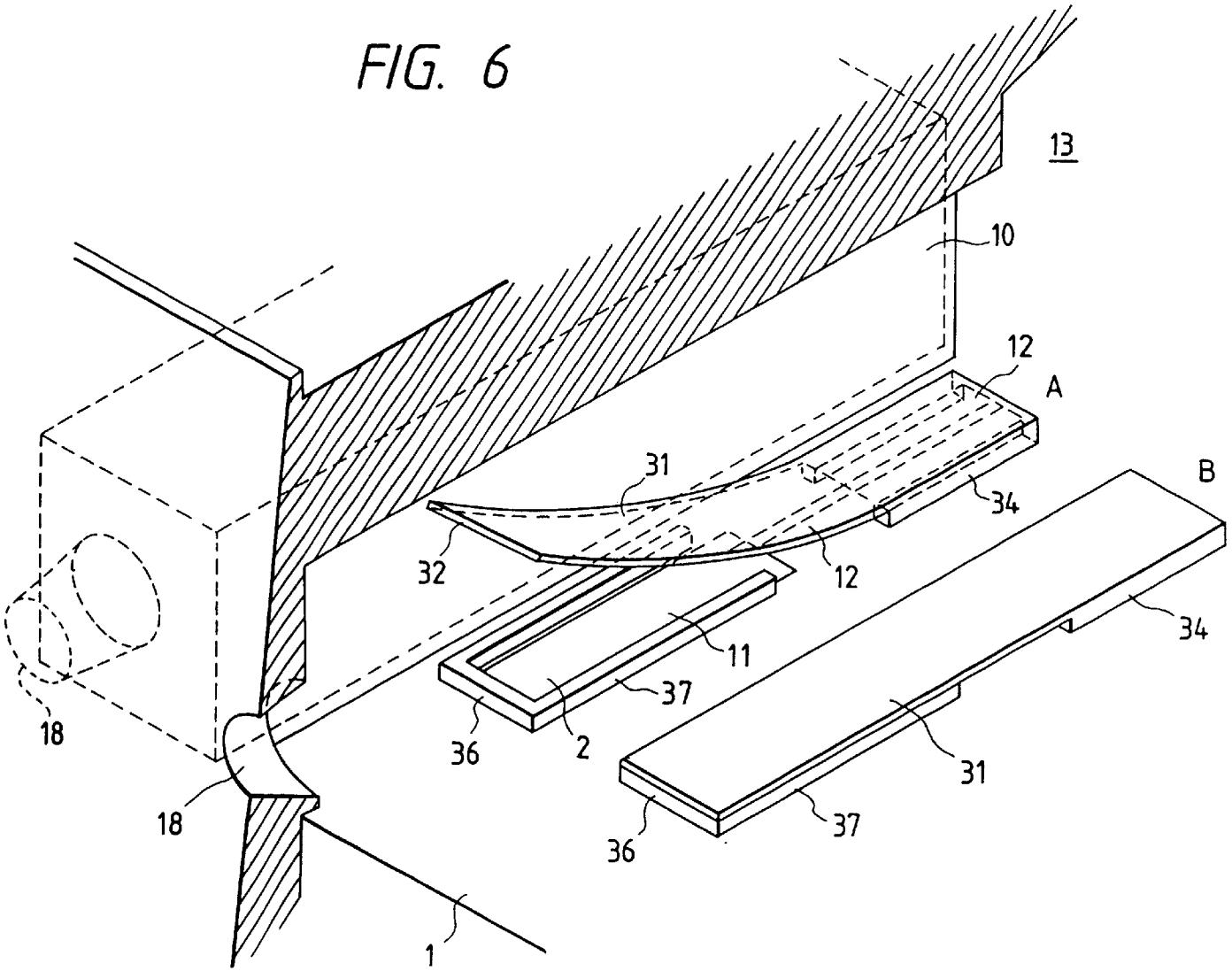
FIG. 6 is a partially cut-off perspective view of a liquid discharge head constituting a second embodiment of the present invention.

FIG. 6 is a partially cut-off perspective view of a liquid discharge head constituting a second embodiment of the present invention, wherein A indicates a state in which the movable member 31 is displaced (bubble being omitted from illustration), while B indicates a state in which the movable member 31 is in the initial (first) position. In this state B the bubble generating area 11 is considered as substantially closed from the discharge port 18. (Though not illustrated, a liquid path wall is present to separate the paths A and B.)

The movable member 31 in FIG. 6 is provided with two lateral support members 34, between which the liquid supply path 12 is formed. In this manner the liquid can be supplied along the surface of the movable member 31 at the side of the heat generating member 2, by the liquid supply path 12 having a face which is substantially flat with the surface of the heat generating member or is smoothly connected therewith.

In the initial (first) position, the movable member 31 is positioned close to or in intimate contact with a downstream wall 36 and a lateral wall 37 of the heat generating member 2, positioned at the downstream side and the lateral side thereof, thereby substantially closing the bubble generating area 11 at the side of the discharge port 18. Consequently, at the bubble generation, the bubble pressure, particularly that at the downstream side of the bubble, does not leak but can be concentrated on the free end portion of the movable member 31.

Also at the bubble vanishing, the movable member 31 returns to the first position to substantially close the bubble generating area 11 at the side of the discharge port 18, whereby attained are various effects explained in the foregoing embodiment, such as suppression of retraction of the meniscus at the liquid supply onto the heat generating member 2 at the bubble vanishing. Also there can be obtained functions and effects on the liquid refilling, similar to those explained in the foregoing embodiment.

In the present embodiment, as shown in FIGS. 2 and 6, the support member 34 for the movable member 31 is provided at an upstream position separate from the heat generating member 2, and is formed with a smaller width in comparison with the liquid path 10, in order to realize the liquid supply into the aforementioned liquid supply path 12. The shape of the support member 34 is however not limited to that explained above but can be arbitrarily selected as long as the liquid refilling can be achieved smoothly.

In the present embodiment, the distance between the movable member 31 and the heat generating member 2 is selected as about 15 $\mu$m, but it may be arbitrarily selected within a range that permits sufficient transmission of the bubble-generated pressure to the movable member 31.

[Third Embodiment]

Figure 7:
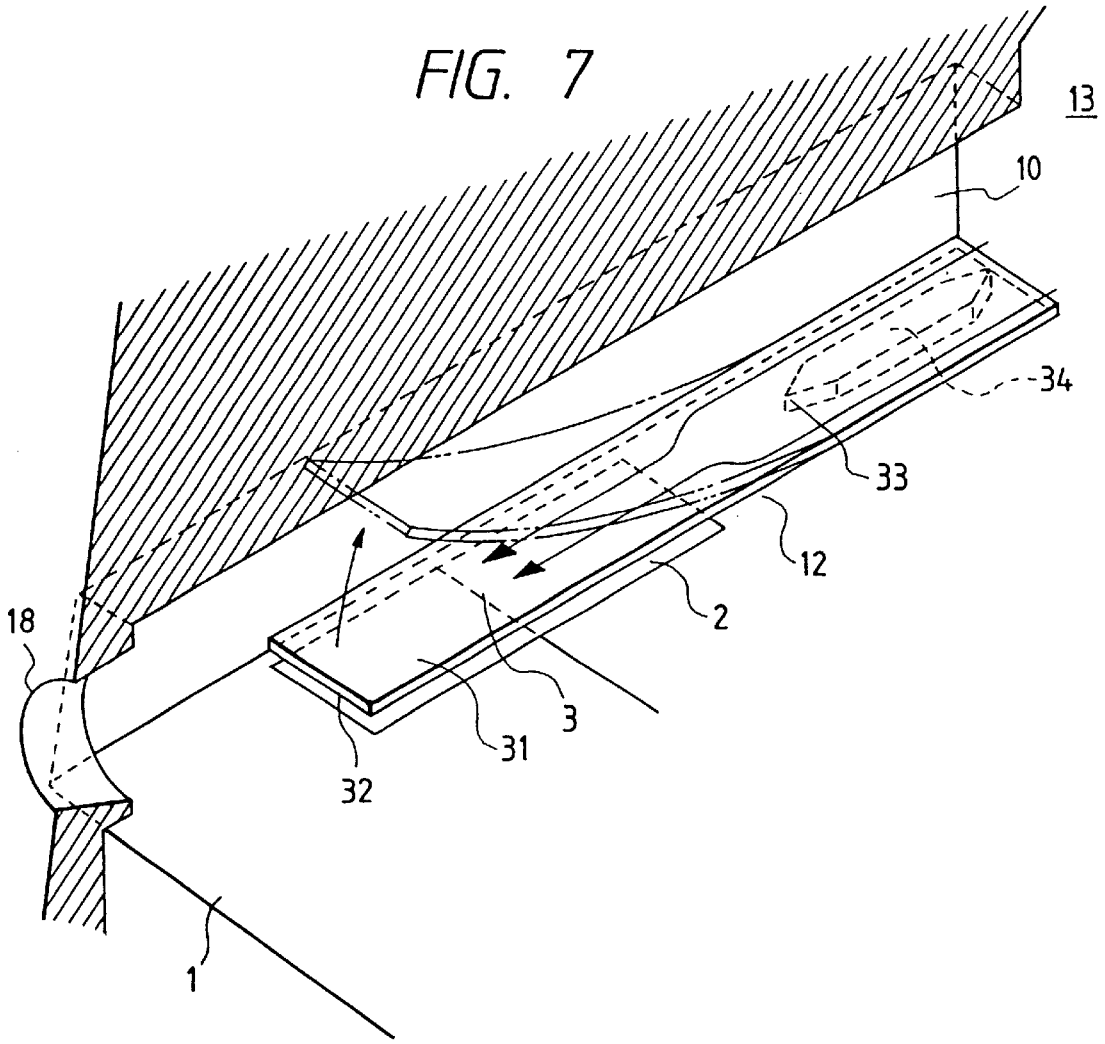
FIG. 7 is a partially cut-off perspective view of a liquid discharge head constituting a third embodiment of the present invention.

FIG. 7 is a partially cut-off perspective view of a liquid discharge head constituting a third embodiment.

FIG. 7 illustrates the positional relationship of the bubble generating area, the bubble generated therein and the movable member 31 in a liquid path, in order to facilitate the understanding of the liquid discharge method and the liquid refilling method of the present invention.

The foregoing embodiments achieve to concentrate the bubble movement toward the discharge port 18, simultaneously with the abrupt displacement of the movable member 31, by concentrating the pressure of the generated bubble to the free end portion of the movable member 31.

On the other hand, the present embodiment, while giving certain freedom to the generated bubble, limits the downstream portion of the bubble, positioned at the side of the discharge port 18 and directly contributing to the liquid discharge, by means of the free end portion of the movable member 31.

In comparison with the foregoing first embodiment shown in FIG. 2, the configuration shown in FIG. 7 lacks a protruding portion (indicated by hatching), formed on the element substrate 1 and functioning as a barrier at the downstream end of the bubble generating area. Thus, in the present embodiment, the area at the free end and at both sides of the movable member 31 does not close but keeps the bubble generating area open to the area of the discharge port 18.

In the present embodiment, in the downstream portion of the bubble, directly contributing to the liquid discharge, the bubble can grow in the end portion at the downstream side, and the pressure component of such portion is effectively utilized in the liquid discharge. In addition, the free end portion of the movable member 31 so acts as to add the upward pressure (components of V2, V3, V4 shown in FIG. 3) of at least such downstream portion to the bubble growth at the above-mentioned end portions of the downstream side, whereby the discharge efficiency is improved as in the foregoing embodiments. Also in comparison with the foregoing embodiments, the present embodiment is superior in the response to the driving of the heat generating member 2.

In addition, the present embodiment is advantageous in the manufacture, because of the simpler structure.

In the present embodiment, the fulcrum of the movable member 31 is fixed to the support member 34 of a width smaller than that of the face position of the movable member 31. Consequently, the liquid supply to the bubble generating area 11 at the bubble vanishing is made through both sides of such support member 34 (as indicated by arrows in the drawing). The support member 34 may have any configuration as long as the liquid supply can be secured.

In the present embodiment, the liquid refilling at the bubble vanishing is superior to that in the conventional configuration containing the heat generating member only, since the movable member 31 controls the liquid flow into the bubble generating area from above. Naturally such control also reduces the amount of retraction of the meniscus.

In a preferred variation of the third embodiment, both lateral sides (or either one thereof) at the free end portion of the movable member 31 are so constructed to substantially close the bubble generating area 11. Such configuration allows to utilize also the pressure directed to the lateral direction of the movable member 31 for the growth of the bubble at the lateral end portion of the discharge port 18, thereby further improving the discharge efficiency.

[Fourth Embodiment]

The present embodiment discloses a configuration which further improves the liquid discharging power by the aforementioned mechanical displacement.

Figure 8:
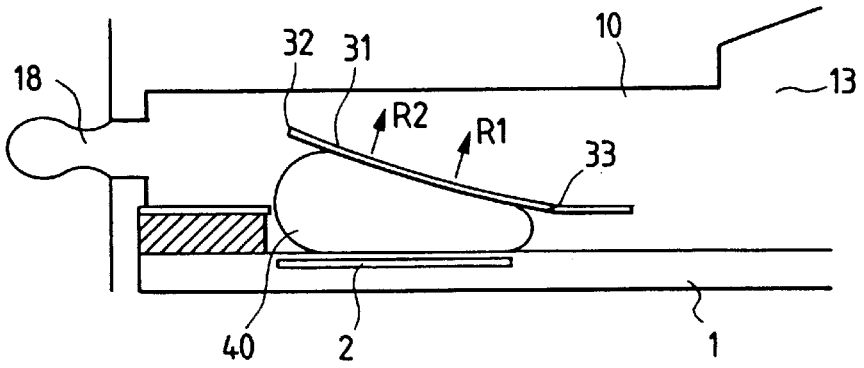
FIG. 8 is a cross-sectional view of a liquid discharge head constituting a fourth embodiment of the present invention.

FIG. 8 is a longitudinal cross-sectional view of such head configuration, wherein the movable member 31 is so further extended that the free end 32 thereof is located in a further downstream position of the heat generating member 2. Such configuration allows to increase the displacing speed of the movable member 31 at the free end position, thereby further increasing the discharge power by the displacement of the movable member 31.

Also in comparison with the foregoing embodiment, the free end 32 is positioned closer to the discharge port 18, thereby concentrating the bubble growth in a stabler directional component and achieving more satisfactory liquid discharge.

Also, the movable member 31 effects the returning motion, from the second position of the maximum displacement, with a returning speed R1 by the elastic returning force, while the free end 32 which is farther from the fulcrum 33 returns with a larger returning speed R2. Consequently the free end 32 acts, with a higher speed, on the bubble 40 in the course of or after the growth to induce a flow of the liquid positioned downstream of the bubble 40 toward the discharge port 18, thereby improving the directionality of liquid discharge and increasing the discharge efficiency.

The free end may be formed perpendicular to the liquid flow as in the case of FIG. 7, thereby allowing the pressure of the bubble 40 and the mechanical action of the movable member 31 to contribute more efficiently to the liquid discharge.

[Fifth Embodiment]

Figure 9A:
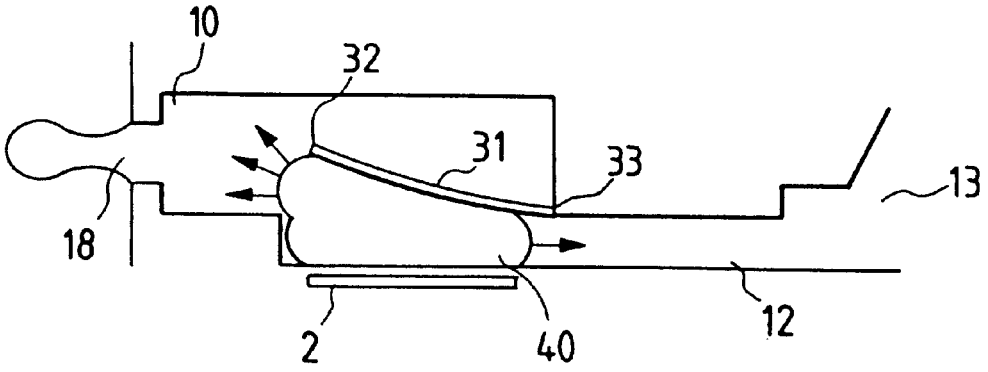
FIGS. 9A, 9B and 9C are schematic cross-sectional views of a liquid discharge head constituting a fifth embodiment of the present invention.
Figure 9B:
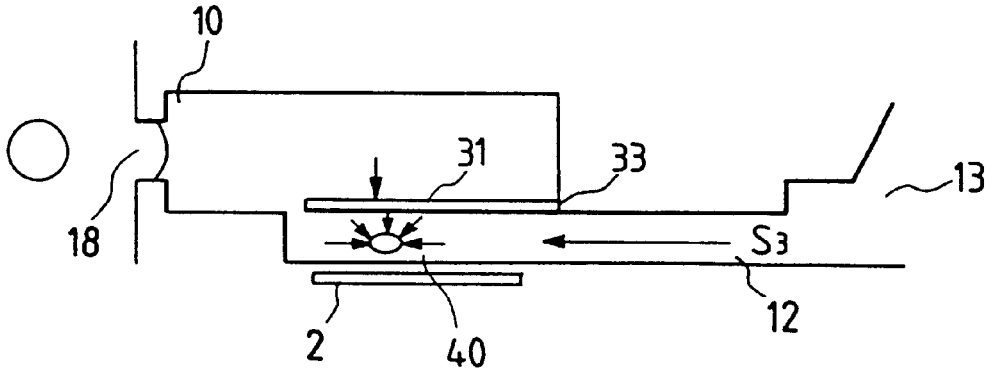
Figure 9C:
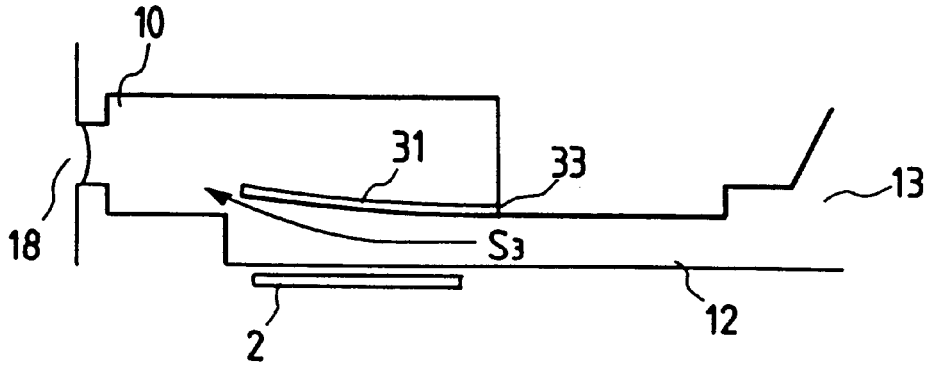

FIGS. 9A, 9B and 9C are schematic cross-sectional views showing a liquid discharge head of a fifth embodiment of the present invention.

In contrast to the foregoing embodiment, in the liquid path of the present embodiment, the area directly communicating with the discharge port 18 does not communicate with the liquid chamber side, whereby the configuration can be made simpler.

The liquid supply is solely made through the liquid supply path 12 along the face of the movable member 31 facing the bubble generating area, while the positional relationship of the free end 32 and the fulcrum 33 of the movable member 31 relative to the discharge port 18 and to the heat generating member 2 is same as in the foregoing embodiment.

The present embodiment achieves the aforementioned effects in the discharge efficiency and in the liquid supply, but is particularly effective in suppressing the retraction of the meniscus, wherein almost all of the liquid refilling is achieved in forced manner by the pressure at the bubble vanishing.

FIG. 9A shows a state where the bubble has been generated in the liquid by the heat generating member 2, while FIG. 9B shows a state where the bubble is in the course of contraction with the returning motion of the movable member 31 to the initial position and the liquid supply by S3.

FIG. 9C shows a state in which a slight retraction of the meniscus induced by the returning motion of the movable member 31 to the initial position is replenished, after the bubble vanishing, by the capillary force in the vicinity of the discharge port 18.

[Sixth Embodiment]

The present embodiment is same as the foregoing embodiments in the discharging principle of the principal liquid but adopts a doubled liquid path configuration thereby dividing the used liquid into bubble generating liquid which generates a bubble by heat application and discharge liquid which is principally discharged.

Figure 10:
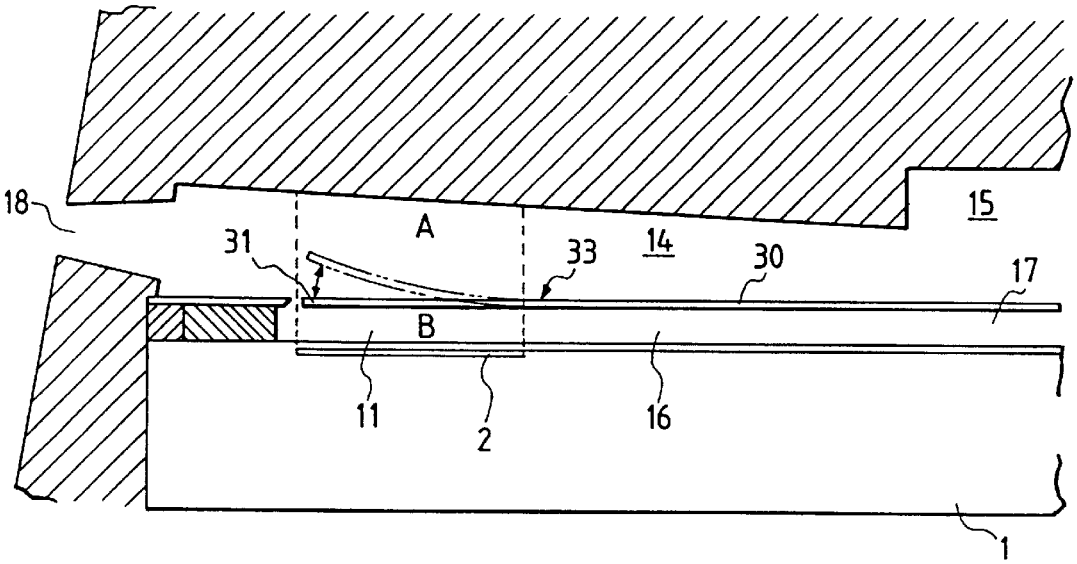
FIG. 10 is a cross-sectional view of a liquid discharge head (two liquid paths) constituting a sixth embodiment of the present invention.
Figure 11:
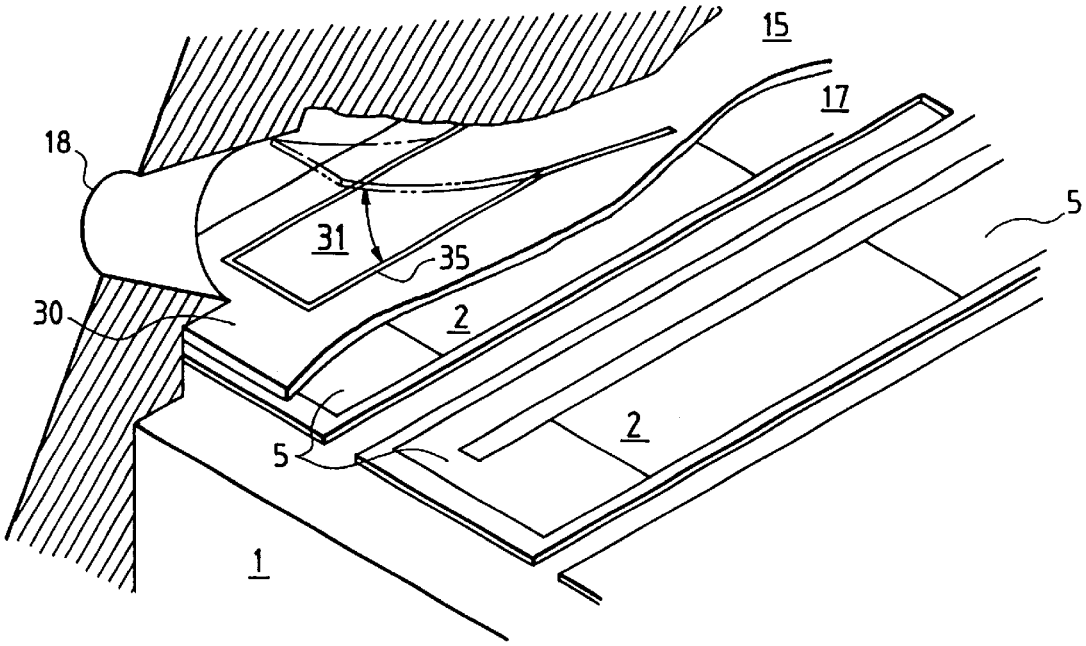
FIG. 11 is a partially cut-off perspective view of the liquid discharge head of the sixth embodiment of the present invention.

FIG. 10 is a cross-sectional view of the liquid discharge head of the present embodiment along the liquid path, and FIG. 11 is a partially cut-off perspective view of such liquid discharge head.

The liquid discharge head of the present embodiment is provided, on the element substrate 1 on which the heat generating member 2 for supplying the liquid with thermal energy for bubble generation is formed, with a liquid path 16 for second liquid as the bubble generating liquid, and thereon with a liquid path 14 for first liquid as the discharge liquid, communicating directly with the discharge port 18.

The upstream side of the first liquid path 14 communicates with a first common liquid chamber 15 for supplying the discharge liquid to the plural first liquid paths 14, while the upstream side of the second liquid path 16 communicates with a second common liquid chamber 17 for supplying the bubble generating liquid to the plural second liquid paths 16.

However, if the bubble generating liquid and the discharge liquid are same, the common liquid chambers 15, 17 may be united into a single chamber.

Between the first and second liquid paths 14, 16 there is provided a partition wall 30 composed of an elastic material such as a metal, for separating the paths 14 and 16. In case the bubble generating liquid and the discharge liquid are to be least mixed, it is desirable to separate, as far as possible, the liquid of the first liquid path 14 and that of the second liquid path 16 by the partition wall 30, but, in case the bubble generating liquid and the discharge liquid may be mixed to a certain extent, the partition wall need not be given the function of such complete separation.

In a space defined by projecting the heat generating member 2 upwards (space corresponding to an area A and the bubble generating area B (11) in FIG. 10 and hereinafter called a discharge pressure generating area), the partition wall constitutes the movable member 31 in the form of a beam supported at an end, having a free end by a slit 35 at the side of the discharge port 18 (at the downstream side in the liquid flow) and a fulcrum 33 at the side of the common liquid chambers 15, 17. The movable member 31, being so positioned as to face the bubble generating area 11 (B), is opened toward the discharge port 18 of the first liquid path 14 (as indicated by an arrow in FIG. 10, by the bubble generation in the bubble generating liquid. Also in FIG. 11, it will be understood that the partition wall 30 is positioned, across a space constituting the second liquid path 16, above the element substrate 1 which bears thereon a heat-generating resistance (electrothermal converting member) constituting the heat generating member 2 and a wiring electrode 5 for supplying the heat-generating resistance with an electrical signal.

The arrangement of the fulcrum 33 and the free end 32 of the movable member 31 and the positional relationship thereof to the heat generating member 2 are same as those in the foregoing embodiment.

The configurational relationship of the second liquid path 16 and the heat generating member 2 is same as that of the liquid supply path 12 and the heat generating member 2 explained in the foregoing embodiments.

Figure 12A:
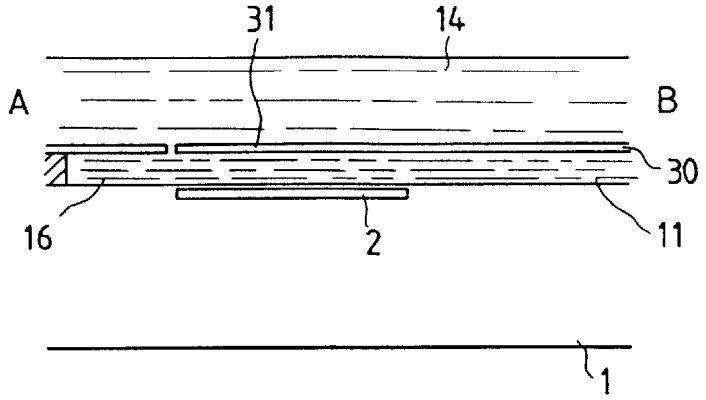
FIGS. 12A and 12B are views showing the function of a movable member of the liquid path.
Figure 12B:
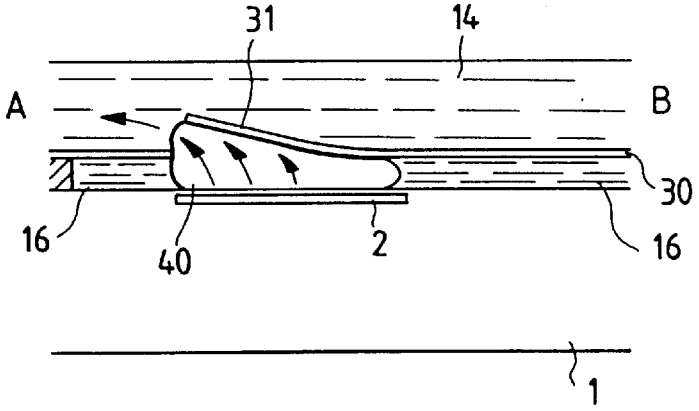

Now reference is made to FIGS. 12A and 12B for explaining the function of the liquid discharge head of the present embodiment.

The head of the present embodiment was driven with same aqueous ink as the discharge liquid to be supplied to the first liquid path 14 and the bubble generating liquid to be supplied to the second liquid path 16.

The heat generated by the heat generating member 2 is applied to the bubble generating liquid contained in the bubble generating area of the second liquid's liquid path to generate a bubble 40 therein by the film boiling phenomenon, as disclosed in the U.S. Pat. No. 4,723,129.

In the present embodiment, since the bubble-generated pressure cannot escape from the bubble generating area in the three directions thereof, except for the upstream side, such pressure is concentrated to the movable member 31 provided in the discharge pressure generating area, and, with the growth of the bubble, the movable member 31 displaces from the state shown in FIG. 12A toward the first liquid path 14 as shown in FIG. 12B. By such function of the movable member 31, the first liquid path 14 widely communicates with the second liquid path 16 and the bubble-generated pressure is principally transmitted toward the discharge port 18 (direction A) in the first liquid path 14. The liquid is discharged from the discharge port 18 by the propagation of such pressure, combined with the mechanical displacement of the movable member 31.

Then, with the contraction of the bubble, the movable member 31 returns to the position shown in FIG. 12A and, in the first liquid path 14, the discharge liquid of an amount, corresponding to that of the discharged liquid, is replenished from the upstream side. Also in the present embodiment, the refilling of the discharge liquid is not hindered by the movable member 31, as the displacement thereof is in the closing direction as in the foregoing embodiments.

The present embodiment is same as the foregoing first embodiment in the functions and effects of the principal components such as pressure propagation, growing direction of the bubble, prevention of the backward wave etc. realized by the displacement of the movable member 31, but provides the following additional advantage because of the two-path configuration.

In the above-explained configuration, the discharge liquid and the bubble generating liquid can be separated and the discharge liquid can be discharged by the pressure obtained by the bubble generation in the bubble generating liquid. It is therefore rendered possible to satisfactorily discharge even viscous liquid, which is insufficient in the discharging power because of insufficient bubble generation under heat application, such as polyethyleneglycol, by supplying such liquid into the first liquid path and also supplying the second liquid path with liquid capable of satisfactory bubble generation (for example a mixture of ethanol:water=4:6, with a viscosity of 1–2 cp) or low-boiling liquid as the bubble generating liquid.

Also liquid which does not generate deposit such as cognation on the surface of the heat generating member 2 under heat application may be selected as the bubble generating liquid to stabilize bubble generation, thereby achieving satisfactory liquid discharge.

The head configuration of the present embodiment, being capable of achieving the effects explained in the foregoing embodiments, can discharge various liquids such as highly viscous liquid, with a higher discharge efficiency and a higher discharge power.

Also liquid susceptible to heat may be discharged without thermal damage, by supplying such liquid as the discharge liquid in the first liquid path 14 and supplying the second liquid path with liquid capable of satisfactory bubble generation and resistant to heat, with a high discharge efficiency and a high discharge power as explained in the foregoing.

[Other Embodiments]

In the foregoing there have been explained embodiments of the principal parts of the liquid discharge head and the liquid discharge method of the present invention. In the following there will be explained other embodiments which are advantageously applicable to such foregoing embodiments, with reference to the attached drawings. It is to be noted that the following embodiments may refer to either of the foregoing embodiment with one-path configuration and that with two-path configuration, but are generally applicable to both configurations unless otherwise specified.

[Ceiling Shape of Liquid Path]

Figure 13:
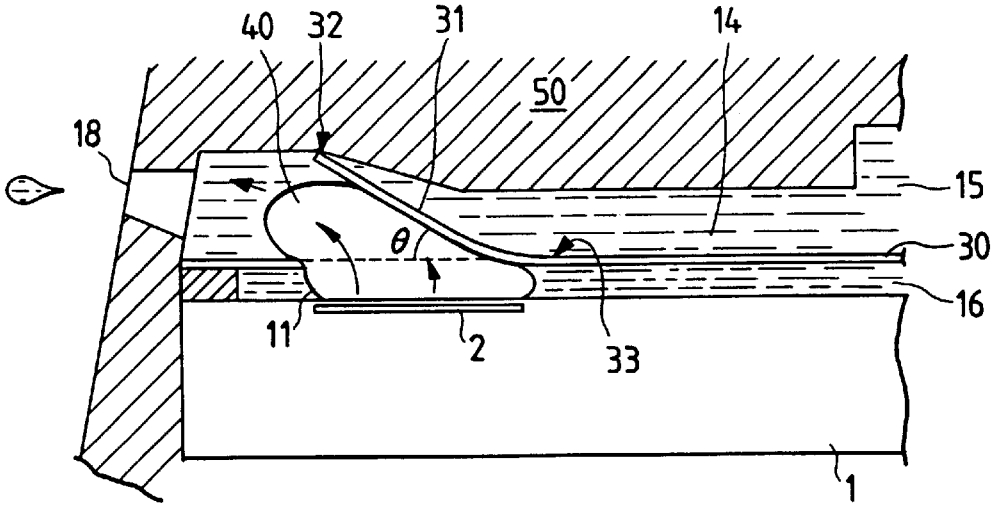
FIG. 13 is a view showing the structure of the movable member and a first liquid path.

FIG. 13 is a view showing the configuration of a movable member and a first liquid path.

As shown in FIG. 13, there is provided, on the partition wall 30, a grooved member 50 having grooves for constituting the first liquid path 14 (or liquid path 10 in FIG. 1). In this embodiment, the ceiling of the liquid path is made higher in the vicinity of the free end of the movable member 31, in order to increase the moving angle θ thereof. The moving range of the movable member 31 can be determined in consideration of the structure of the liquid path, the durability of the movable member 31, the bubble generating power etc., but desirably covers a position including the angle of the discharge port 18 in the axial direction.

Also the discharging power can be transmitted in more satisfactory manner by selecting, as shown in FIG. 13, the height of displacement of the free end of the movable member 31 larger than the diameter of the discharge port 18. Furthermore, as shown in FIG. 13, the ceiling of the liquid path is made lower at the fulcrum 33 of the movable member 31 than at the free end 32 thereof, whereby the leak of the pressure wave toward the upstream side can be prevented in more effective manner.

[Positional Relationship of Second Liquid Path and Movable Member 31]

Figure 14A:
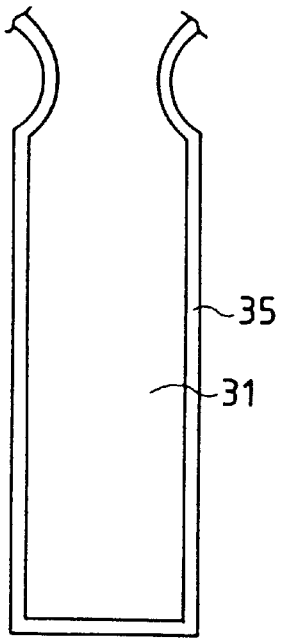
FIGS. 14A, 14B and 14C are views showing the structure of the movable member and the liquid path.
Figure 14B:
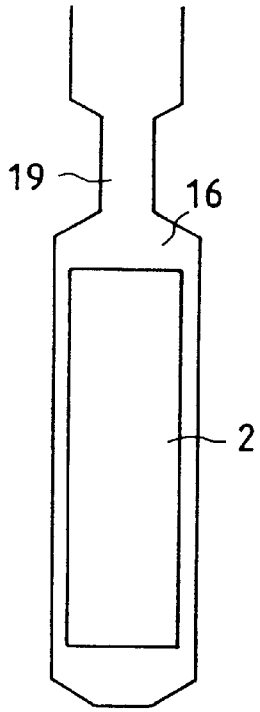
Figure 14C:
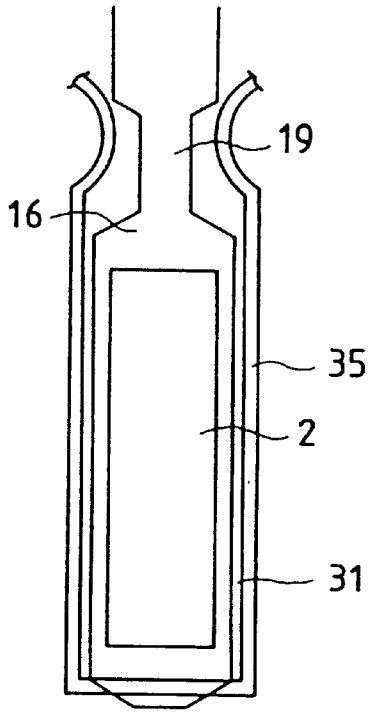

FIGS. 14A to 14C illustrate the positional relationship of the movable member 31 and the second liquid path 16. FIG. 14A is a plan view of the partition wall 30 and the movable member 31 seen from above, while FIG. 14B is a plan view of the second liquid path 16, without the partition wall 30, seen from above, and FIG. 14C is a schematic view of the positional relationship of the movable member 31 and the second liquid path 16, which are illustrated in mutually superposed manner. In these drawings, the lower side is the front side having the discharge port 18.

The second liquid path 16 in the present embodiment has a constricted portion 19 in the upstream side of the heat generating member 2 (the upstream side being defined in the major stream from the second common liquid chamber to the discharge port 18 through the heat generating member 2, the movable member 31 and the first liquid path), thereby forming a chamber structure (bubble generating chamber) for avoiding easy escape of the pressure of bubble generation to the upstream side of the second liquid path 16.

In case the constricted portion 19 for avoiding the escape of the pressure, generated in the liquid chamber by the heat generating member 2, toward the common liquid chamber is formed in the conventional head in which the bubble generating liquid path is same as the liquid discharging path, the cross section of the liquid path in such constricted portion 19 cannot be made very small in consideration of the liquid refilling.

On the other hand, in the present embodiment, most of the discharged liquid can be the discharge liquid present in the first liquid path and the consumption of the bubble generating liquid in the second liquid path, where the heat generating member is present, can be made small. Consequently the replenishing amount of the bubble generating liquid into the bubble generating area 11 of the second liquid path can be made low. For this reason the gap of the above-mentioned constructed portion 19 can be made as small as from several micrometers to less than twenty micrometers, so that the bubble pressure generated in the second liquid path can be further prevented from escaping and concentrated toward the movable member 31. Such pressure can be utilized, through the movable member 31, as the discharging power, thereby achieving a higher discharge efficiency and a higher discharging power. The first liquid path 16 is not limited to the above-explained shape but may assume any shape that can effectively transmit the bubble-induced pressure to the movable member 31.

As shown in FIG. 14C, the lateral portions of the movable member 31 cover a part of the wall constituting the second liquid path, and such configuration prevents the movable member 31 from dropping into the second liquid path, whereby the aforementioned separation of the discharge liquid and the bubble generating liquid can be further enhanced. It also suppresses the leakage of the bubble through the slit, thereby further increasing the discharge pressure and the discharge efficiency. Furthermore, the aforementioned liquid refilling effect from the upstream side by the pressure of bubble vanishing can be further enhanced.

In FIG. 12B and FIG. 13, a part of the bubble, generated in the bubble generating area of the second liquid path 16 extends in the first liquid path 14 as a result of the displacement of the movable member 31 toward the first liquid path 14, and such a height of the second liquid path as to permit such extension of the bubble allows to further increase the discharge power, in comparison with the case without such extension of the bubble. For realizing such extension of the bubble into the first liquid path 14, the height of the second liquid path 16 is desirable made smaller than the height of the maximum bubble and is preferable selected within a range of several to 30 micrometers. In the present embodiment, this height is selected as 15 $\mu$m.

[Movable Member and Partition Wall]

Figure 15A:
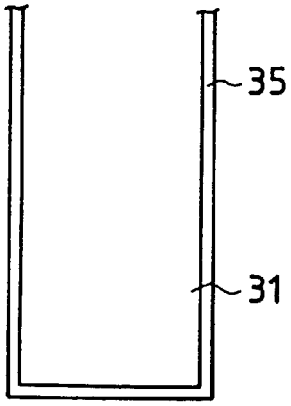
FIGS. 15A, 15B and 15C are views showing other shapes of the movable member.
Figure 15B:
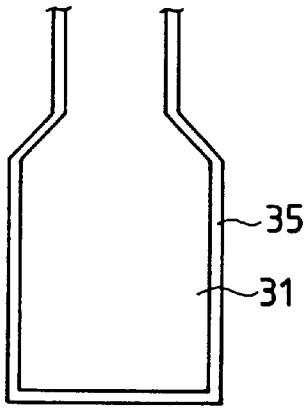
Figure 15C:
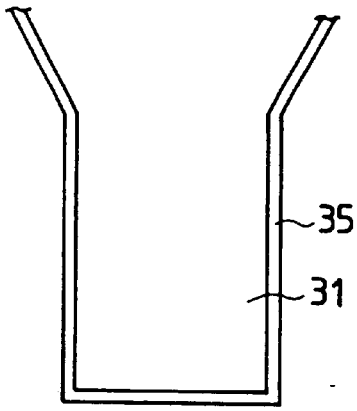

FIGS. 15A to 15C show other shapes of the movable member 31. FIG. 15A shows a rectangular shape, while FIG. 15B shows a shape with a narrower fulcrum portion to facilitate displacement of the movable member 31, and FIG. 15C shows a shape with a wider fulcrum portion to increase the durability of the movable member 31.

In these drawings, a slit 35 formed in the partition wall defines the movable member 31. For realizing easy displacement and satisfactory durability, the width of the fulcrum portion is desirably constricted in arc shape as shown in FIG. 14A, but the shape of the movable member 31 may be arbitrarily selected so as not to drop into the second liquid path and as to realize easy displacement and satisfactory durability.

In the foregoing embodiment, the partition wall 5 including the plate-shaped movable member 31 was composed of nickel of a thickness of 5 $\mu$m, but the partition wall and the movable member may be composed of any material that is resistant to the bubble generating liquid and the discharge liquid, has elasticity allowing satisfactory function of the movable member and permits formation of the fine slit.

The thickness of the partition wall can be determined in consideration of the material and the shape thereof, so as to attain the required strength and to ensure satisfactory function of the movable member 31, and is preferably selected within a range of 0.5 to 10 $\mu$m.

The width of the slit 35 defining the movable member 31 is selected as 2 $\mu$m in the present embodiment. However, if the bubble generating liquid and the discharge liquid are mutually different and are to be prevented from mutual mixing, the width of the slit may be so selected as to form a meniscus between the both liquids, thereby avoiding the mutual flow of the liquids. For example, if the bubble generating liquid has a viscosity of about 2 cp while the discharge liquid has a viscosity exceeding 100 cp, the mutual mixing can be prevented with a slit of about 5 $\mu$m, but a slit of 3 $\mu$m or less is desirable.

The thickness of the movable member 31 of the present invention is not in the order of centimeter but in the order of micrometer (t $\mu$m). For forming such movable member 31 with the slit of a width in the order micrometer (W $\mu$m), it is desirable to take certain fluctuation in the manufacture into consideration.

If the thickness of the member opposed to the free end and/or the lateral end of the movable member 31 defining the slit is comparable to that of the movable member 31 (as shown in FIGS. 12A, 12B and 13), the mixing of the bubble generating liquid and the discharge liquid can be stably suppressed by selecting the relationship of the slit width and the thickness within the following range, in consideration of the fluctuation in the manufacture. Though this gives a limitation in the designing, a condition $W/t \leqq 1$ enables suppression of mixing of the two liquids over a prolonged period in case of using the bubble generating liquid of a viscosity of 3 cp or less in combination with the highly viscous ink (5 or 10 cp).

A slit in the order of several micrometers can securely realize the "substantially closed state" of the present invention.

When the functions are divided into the bubble generating liquid and the discharge liquid, the movable member practically constitutes a partition member for these liquids. A slight mixing of the bubble generating liquid into the discharge liquid is observed as a result of displacement of the movable member by the growth of the bubble. However, since the discharge liquid which forms the image in the ink jet printing generally contains a coloring material with a concentration of 3 to 5%, a significant variation in the color density will not result if the bubble generating liquid is contained, within a range up to 20%, in the droplet of the discharge liquid. Consequently, the present invention includes a situation where the bubble generating liquid and the discharge liquid are mixed within such a range that the content of the bubble generating liquid in the discharged droplet does not exceed 20%.

In the above-explained configuration, the mixing ratio of the bubble generating liquid did not exceed 15% even when the viscosity was changed, and, with the bubble generating liquid of a viscosity not exceeding 5 cp, the mixing ratio did not exceed 10% though it is variable depending on the drive frequency.

Such mixing of the liquids can be reduced, for example to 5% or less, by reducing the viscosity of the discharge liquid from 20 cp.

In the following there will be explained the positional relationship of the heat generating member and the movable member in the head, with reference to the attached drawings. However the shape, dimension and number of the movable member and the heat generating member are not limited to those explained in the following. The optimum arrangement of the heat generating member and the movable member allows to effectively utilize the pressure of bubble generated by the heat generating member as the discharging pressure.

Figure 16:
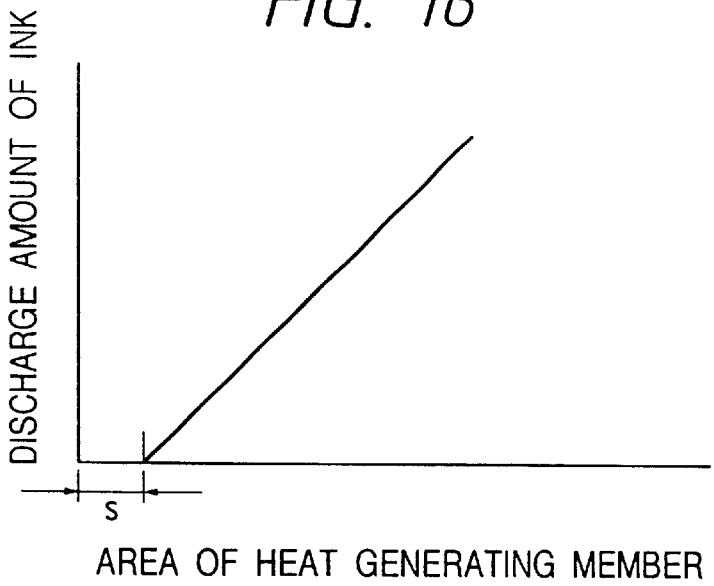
FIG. 16 is a chart showing the relationship between the area of the heat generating member and the ink discharge amount.

FIG. 16 is a chart showing the relationship between the area of the heat generating member and the ink discharge amount.

In the conventional technology of so-called bubble jet printing which is the ink jet printing for effecting image formation by providing ink with energy such as heat to generate herein a state change involving a steep volume change (bubble generation), discharging the ink from the discharge port by an action force resulting from such state change and depositing thus discharged ink onto the recording medium, the discharged amount of ink is in proportion to the area of the heat generating member as shown in FIG. 16, but there also exists an ineffective area S which does not contribute to the bubble generation. Also the state of cogation on the heat generating member indicates that such ineffective area S is present in the peripheral area of the heat generating member. Based on these results, it is assumed that a peripheral area, with a width of about 4 μm, of the heat generating member does not contribute to the heat generation.

Consequently, for effective utilization of the pressure of the bubble generation, it is considered effective to position the movable member in such a manner that the movable member covers an area immediately above the effective bubble generating area, which is inside the peripheral area of a width of about 4 μm of the heat generating member. In the present embodiment, the effective bubble generating area is considered as the area inside the peripheral area of a width of about 4 μm of the heat generating member, but such configuration is not restrictive depending on the kind of the heat generating member and the method of formation thereof.

Figure 17A:
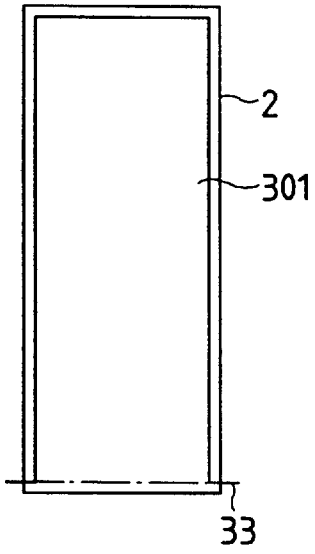
FIG. 17A and 17B are views showing positional relationship between the movable member and the heat generating member.
Figure 17B:
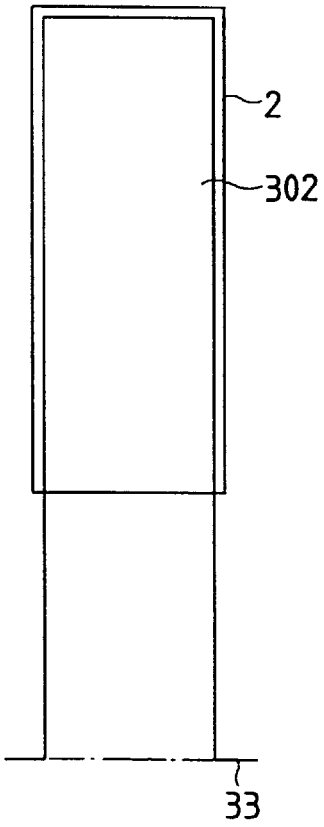

FIGS. 17A and 17B are views, seen from above, of the heat generating member 2 of an area of 58×150 μm, respectively superposed with the movable member 301 (FIG. 17A) and 302 (FIG. 17B) of different movable areas.

The movable member 301 has a dimension of 53×145 μm, which is smaller than the heat generating member 2 but is comparable to the effective bubble generating area thereof, and it is so positioned as to cover such effective bubble generating area. On the other hand, the movable member 302 has a dimension of 53×220 μm, which is larger than the heat generating member 2 (distance from the fulcrum to the movable end being longer than the length of the heat generating member 2, for the same width) and is so positioned as to cover the effective bubble generating area as in the case of the movable member 301. The durability and the discharge efficiency were measured for such movable members 301 and 302, under following conditions:

bubble generating liquid: 40% aqueous solution of ethanol discharge ink: dye-containing ink voltage: 20.2V frequency: 3 kHz The measurement under these conditions revealed that (a) the movable member 301 showed a damage in the fulcrum portion after the movable member 301 showed a damage in the fulcrum portion after the application of $1\times10^7$ pulses, while (b) the movable member 302 did not show any damage after the application of $3\times10^8$ pulses. It was also confirmed that the energy of motion, determined from the discharged amount and the discharging speed relative to the entered energy, was increased by 1.5 to 2.5 times.

Based on these results, it is preferable, in terms of the durability and the discharge efficiency, to position the movable member in such a manner that it covers an area directly above the effective bubble generating area and that the area of the movable member is larger than that of the heat generating member.

Figure 18:
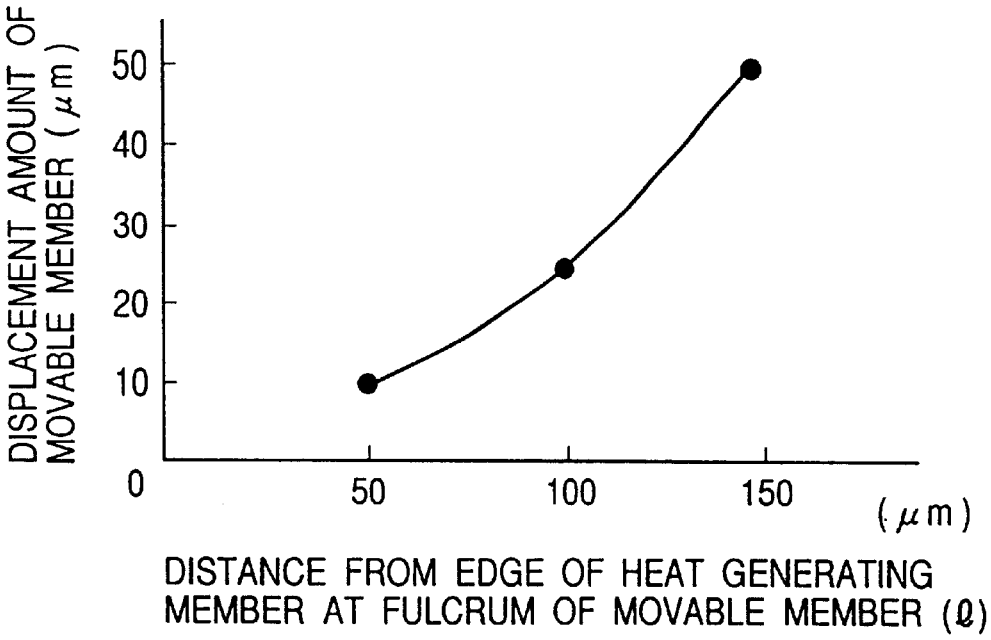
FIG. 18 is a chart showing the relationship between the distance from the edge of the heat generating member to the fulcrum thereof and the amount of displacement of the movable member.
Figure 19:
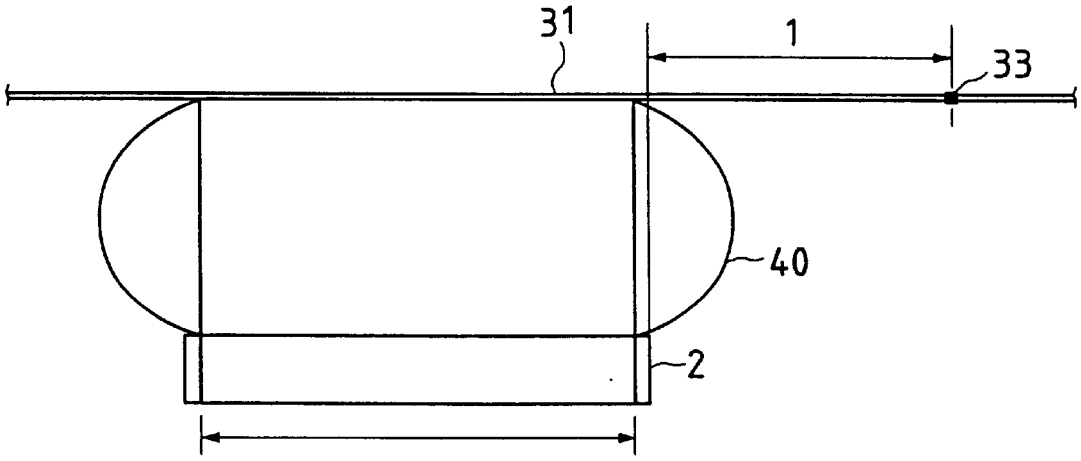
FIG. 19 is a view showing the positional relationship between the heat generating member and the movable member.
Figure 48:
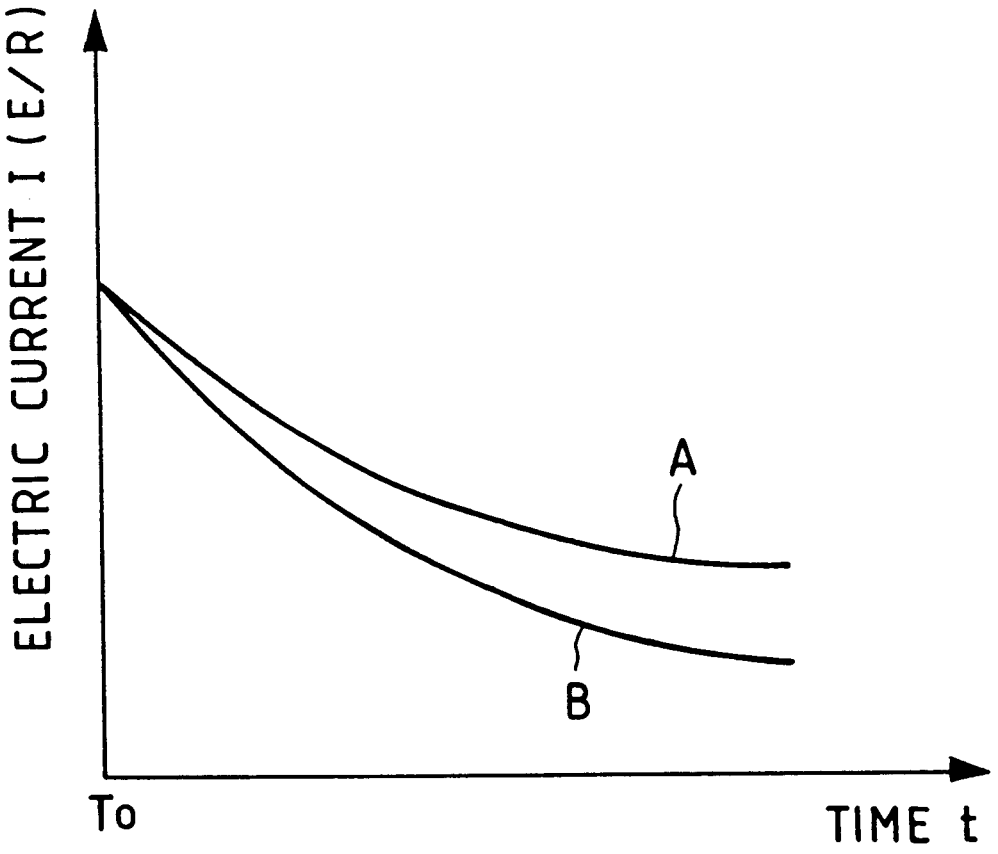
FIG. 48 is a chart showing variation of the current shown in FIG. 46.
Figure 49A:
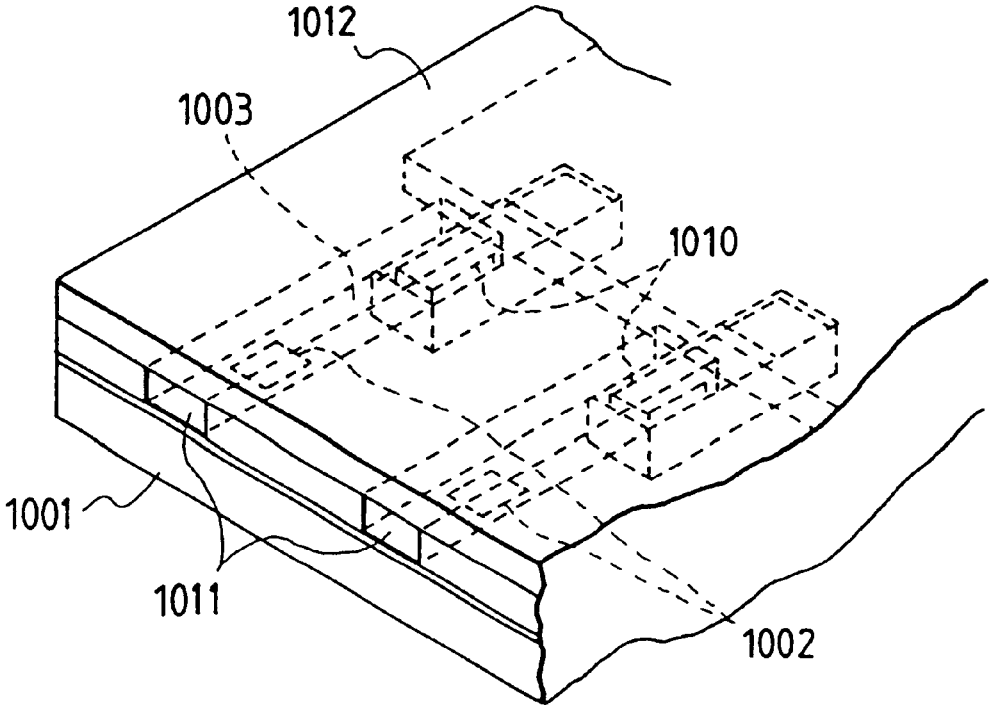
FIG. 49A PRIOR ART
FIGS. 49A and 49B are views showing the configuration of liquid paths in a conventional liquid discharge head.
Figure 49B:
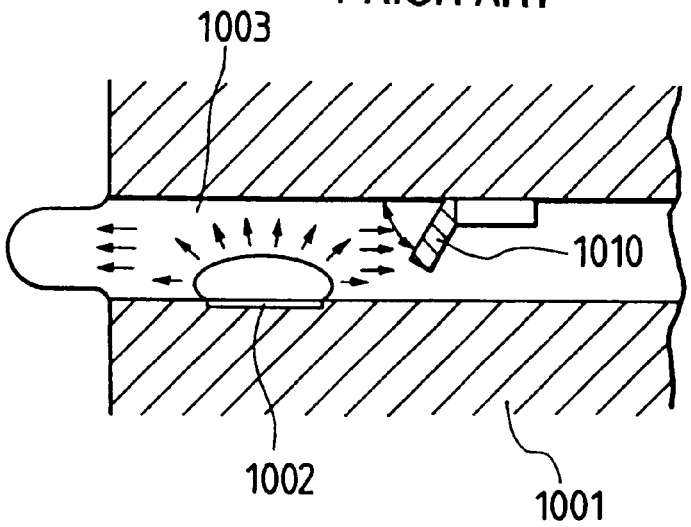
FIG. 49B PRIOR ART

FIG. 18 shows the relationship between the distance form the edge of the heat generating member to the fulcrum of the movable member and the amount of displacement thereof. Also FIG. 48 is a lateral cross-sectional view showing the positional relationship of the heat generating member 2 and the movable member 31.

The heat generating member 2 had a dimension of 40×105 μm. It will be understood that the amount of displacement increases with the increase in the distance from the edge of the heat generating member 2 to the fulcrum 33 of the movable member 31. It is therefore desirable to determine the optimum amount of displacement and to determine the position of the fulcrum 33 of the movable member 31, according to the desired discharge amount of ink, the structure of the liquid path for the discharge liquid and the shape of the heat generating member.

If the fulcrum of the movable member is positioned directly above the effective bubble generating area of the heat generating member, the durability of the movable member becomes deteriorated since the fulcrum directly received the pressure of bubble generation, in addition to the strain by the displacement of the movable member. According to the experiment of the present inventors, the movable member showed deterioration in the durability, generating damage after the application of about $1\times10^6$ pulses, in case the fulcrum was located directly above the effective bubble generating area. Consequently, a movable member of a shape or a material of medium durability may also be employed by positioning the fulcrum thereof outside the area directly above the effective bubble generating area of the heat generating member. However, the fulcrum may also be positioned directly above such effective bubble generating area if the shape and the material are suitably selected. In this manner there can be obtained a liquid discharge head which is excellent in the discharge efficiency and in the durability.

[Element Substrate]

In the following there will be explained the configuration of the element substrate, on which provided is the heat generating member for giving heat to the liquid.

Figure 20A:
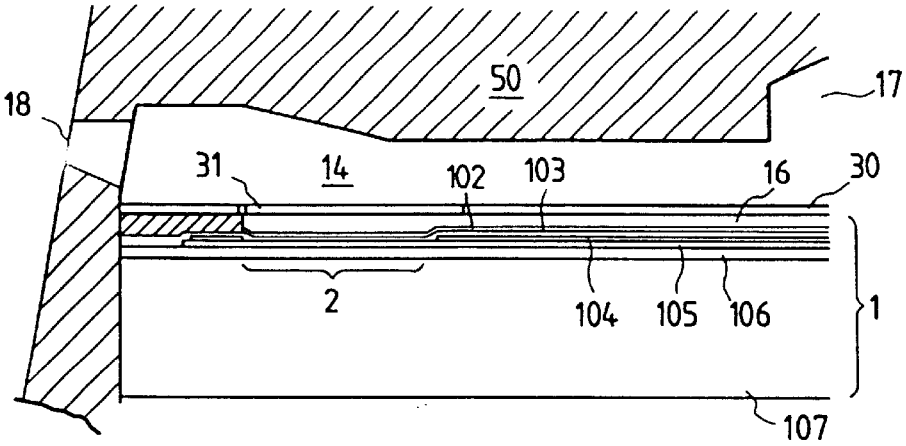
FIGS. 20A and 20B are longitudinal cross-sectional views of a liquid discharge head of the present invention.
Figure 20B:
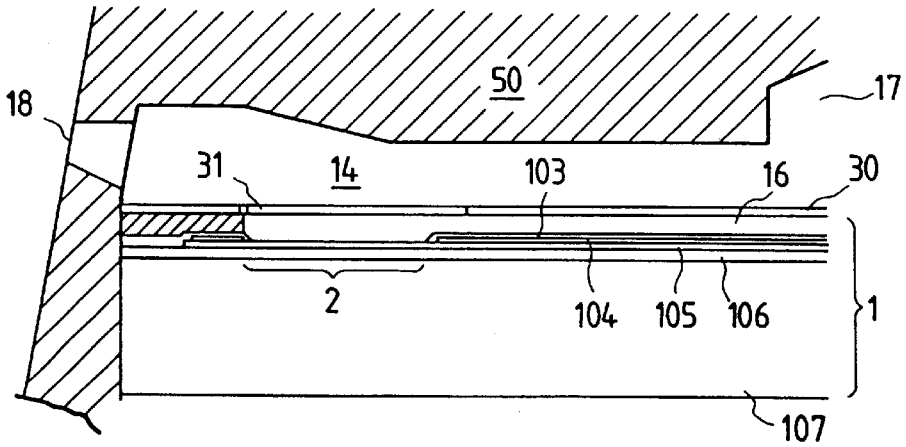

FIGS. 20A and 20B are vertical cross-sectional views of the liquid discharge head of the present invention, respectively with and without a protective film to be explained later.

Above the element substrate 1, there is positioned a grooved member 50 (cover plate) provided with a second liquid path 16, a partition wall 30, a first liquid path 14 and a groove for constituting the liquid path 14.

The element substrate 1 is prepared, on a substrate 107 such as of silicon, by forming a silicon oxide film or a silicon nitride film 106 for insulation and heat accumulation, and thereon patterning, as shown in FIG. 11, an electric resistance layer 105 (0.01–0.2 $\mu$m thick) composed for example of hafnium boride ($HfB_2$), tantalum nitride (TaN) or tantalum-aluminum (TaAl) and constituting the heat generating member 2 and wiring electrodes 104 (0.2–1.0 $\mu$m thick) composed for example of aluminum. The two wiring electrodes 104 apply a voltage to the electric resistance layer 105, thereby supplying a current thereto and generating heat therein. The electric resistance layer between the wiring electrodes bears thereon a protective layer of a thickness of 0.1–2.0 $\mu$m, composed for example of silicon oxide or silicon nitride, and an anticavitation layer (0.1–0.6 $\mu$m) composed for example of tantalum, for protecting the resistance layer 105 from ink or other liquids.

Since the pressure or the impact wave generated at the generation or vanishing of the bubble is very strong and significantly damages the durability of the hard and fragile oxide film, a metallic material such as tantalum (Ta) is employed as the anticavitation layer 102.

The above-mentioned protective layer may be dispensed with by the combination of the liquid, the configuration of the liquid paths and the resistance material, as exemplified in FIG. 20B. An example of the material for the resistance layer which does not require the protective layer is iridium-tantalum-aluminum alloy.

The heat generating member in the foregoing embodiments may be composed solely of the resistance layer (heat generating part) provided between the electrodes or may include the protective layer for protecting the resistance layer.

In the present embodiment, the heat generating member has the heat generating part composed of the resistance layer which generates heat in response to the electrical signal, but such configuration is not restrictive and there may be employed any member capable of generating a bubble sufficient for discharging the discharge liquid. For example the heat generating member may have an optothermal converting member which generates heat by receiving light such as from a laser, or a heat generating part which generates heat by receiving a high-frequency signal.

The element substrate 1 may be further provided, in addition to the electrothermal converting member which is composed of the resistance layer 105 constituting the aforementioned heat generating part and the wiring electrodes 104 for supplying the resistance layer 105 with the electrical signal, with functional elements such as transistors, diodes, latches and shift registers which are used for selectively driving the electrothermal converting element, and are integrally prepared by a semiconductor process.

Figure 21:
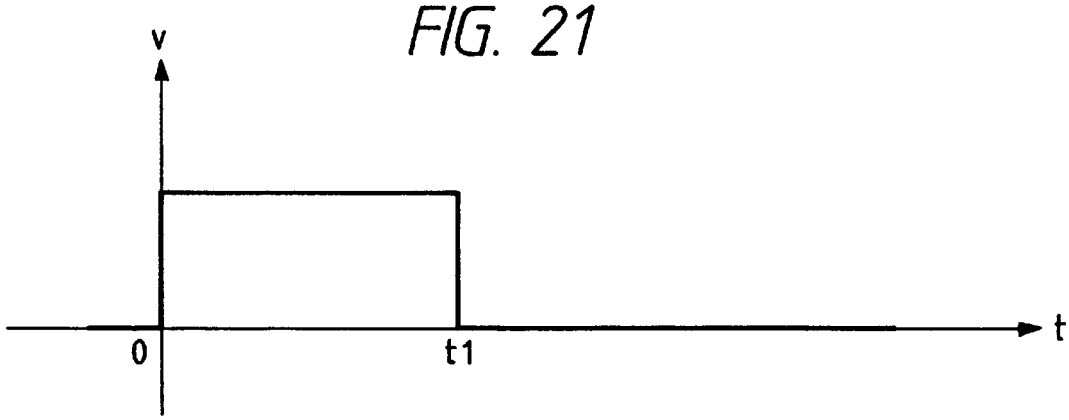
FIG. 21 is a chart showing the shape of a driving pulse.

For discharging the liquid by driving the heat generating part of the electrothermal converting member provided on such element substrate 1, a rectangular pulse as shown in FIG. 21 is applied to the resistance layer 105 through the wiring electrodes 104 to induce rapid heat generation in the resistance layer 105.

FIG. 21 is a schematic view showing the shape of the driving pulse.

In the heads of the foregoing embodiments, an electrical signal of a voltage of 24V, a pulse duration of 7$\mu$ sec and a current of 150 mA was applied with a frequency of 6 kHz to drive the heat generating member, thereby discharging ink from the discharge port by the above-explained functions. However the drive signal is not limited to such conditions but may have any conditions that can adequately generate a bubble in the bubble generating liquid.

[Head Structure with Two-liquid Path Configuration]

In the following there will be explained an example of the structure of the liquid discharging head which allows introduction of different liquids into the first and second common liquid chambers with satisfactory separation, and also allows a reduction in the number of components and in the cost.

Figure 22:
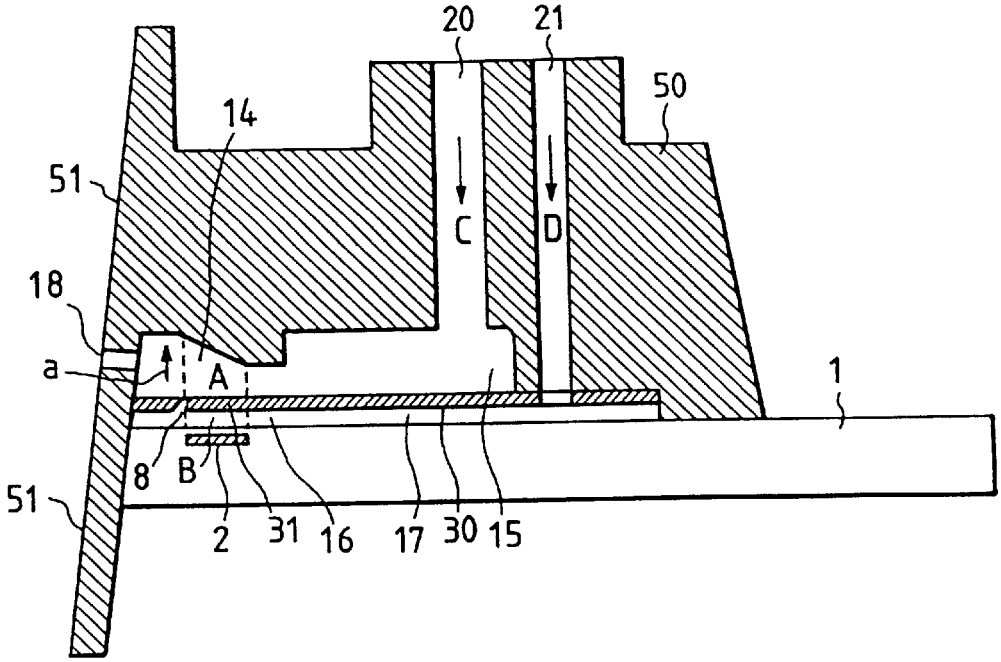
FIG. 22 is a cross-sectional view showing supply paths of the liquid discharge head of the present invention.

FIG. 22 is a schematic view showing the structure of such liquid discharging head, wherein components equivalent to those in the foregoing embodiments are represented by same numbers and will not be explained further.

In this embodiment, the grooved member 50 is principally composed of an orifice plate 51 having discharge ports 18, plural grooves constituting the plural first liquid paths 14, and a recess constituting a first common liquid chamber 15 which commonly communicates with the plural first liquid paths 14 for the supply of the discharge liquid thereto.

The plural first liquid paths 14 can be formed by adhering a partition wall 30 to the lower face of the grooved member 50. The grooved member 50 is provided with a first liquid supply path 20 reaching the first common liquid chamber 15 from above, and a second liquid supply path 21 reaching the second common liquid chamber 17 from above, penetrating through the partition wall 30.

The first liquid (discharge liquid) is supplied, as indicated by an arrow C in FIG. 22, through the first liquid supply path 20 to the first common liquid chamber 15 and then to the first liquid paths 14, while the second liquid (bubble generating liquid) is supplied, as indicated by an arrow D in FIG. 54, through the second liquid supply path 21 to the second common liquid chamber 17 and then to the second liquid paths 16.

In this embodiment, the second liquid supply path 21 is positioned parallel to the first liquid supply path 20, but such positioning is not restrictive and it may be formed in any manner as long as it communicates with the second common liquid chamber 17, penetrating through the partition wall 30 provided outside the first common liquid chamber 15.

The thickness (diameter) of the second liquid supply path 21 is determined in consideration of the supply amount of the second liquid. The second liquid supply path 21 need not have a circular cross section but can have a rectangular cross section or the like.

The second common liquid chamber 17 can be formed by parting the grooved member 50 with the partition wall 30.

Figure 23:
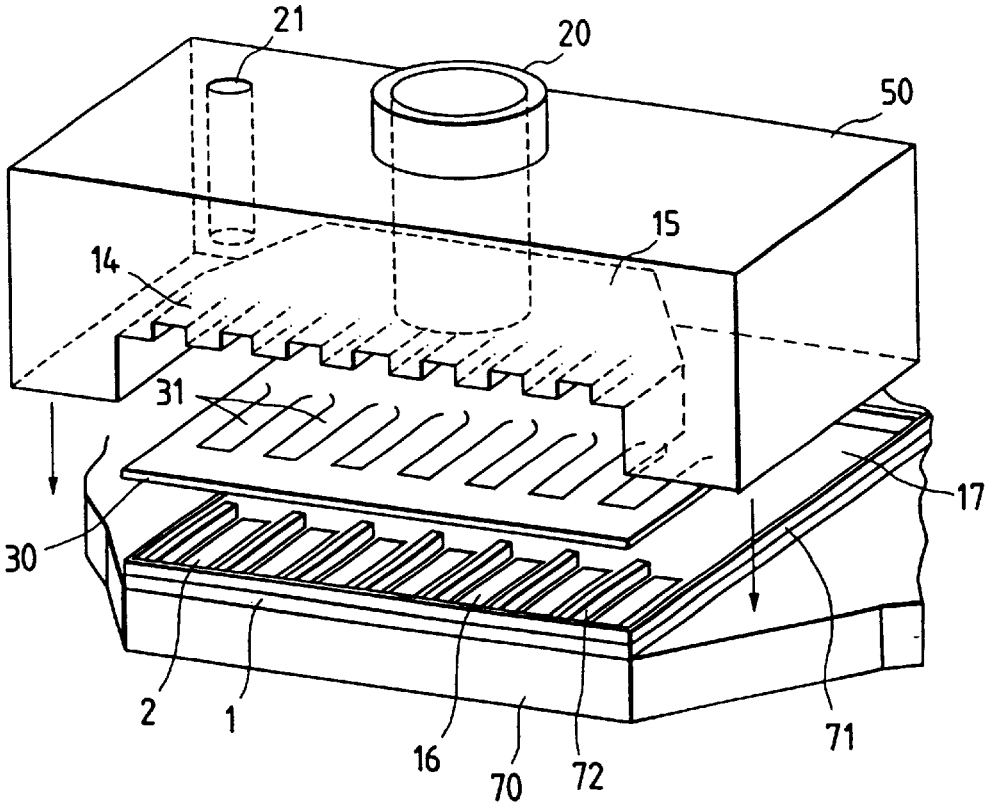
FIG. 23 is an exploded perspective view of the head of the present invention.

The second common liquid chamber 17 and the second liquid paths 16 may be formed, as shown in an exploded perspective view in FIG. 23, by forming the frame of the common liquid chamber and the walls of the second liquid paths by a dry film on the element substrate, and adhering such element substrate with a combined body of the grooved member 50 and the partition wall 30.

In the present embodiment, the element substrate 1 provided with a plurality of electrothermal converting elements, constituting the heat generating members for generating heat for generating the bubble in the bubble generating liquid by film boiling, is provided on a support member 70 composed of a metal such as aluminum.

The element substrate 1 is provided thereon with plural grooves constituting the liquid paths 16 defined by the walls of the second liquid paths, a recess constituting the second common liquid chamber 17 for supplying the bubble generating liquid paths with bubble generating liquid, and a partition wall 30 provided with the aforementioned movable members 31.

A grooved member 50 is provided with grooves constituting the discharge liquid paths (first liquid paths) 14 upon adhesion with the partition wall 30, a recess constituting the first common liquid chamber 15 communicating with the discharge liquid paths and serving to supply such paths with the discharge liquid, a first liquid supply path (discharge liquid supply path) 20 for supplying the first common liquid chamber with the discharge liquid, and a second liquid supply path (bubble generating liquid supply path) 21 for supplying the second common liquid chamber with the bubble generating liquid. The second supply path 21 penetrates through the partition wall 30 positioned outside the first common liquid chamber 15 and is connected to the second common liquid chamber 17, whereby the bubble generating liquid can be supplied thereto without mixing with the discharge liquid.

The element substrate 1, the partition wall 30 and the grooved plate 50 are so mutually positioned that the movable members 31 are aligned respectively corresponding to the heat generating members of the element substrate 1 and that the discharge liquid paths 14 are aligned to such movable members 31. The present embodiment has a second supply path in the grooved member, but there may be provided plural second supply paths according to the supply amount. Also the cross sectional areas of the discharge liquid supply path 20 and the bubble generating liquid supply path 21 may be determination proportion to the supply amounts. Components constituting the grooved member 50 may be made compacter by the optimization of such cross sectional areas of the supply paths.

The present embodiment explained above allows to reduce the number of components and to reduce the manufacturing process and the cost, since the second supply path for supplying the second liquid paths with the second liquid and the first supply path for supplying the first liquid paths with the first liquid are formed with a single grooved member.

Also since the supply of the second liquid to the second common liquid chamber communicating with the second liquid paths is achieved by the second liquid supply path which penetrates through the partition wall for separating the first liquid and the second liquid, the adhesion of the partition wall, the grooved member and the element substrate can be achieved in a single step, whereby the manufacturing process can be facilitated and the precision of adhesion can be improved to achieve satisfactory liquid discharge.

The second liquid, being supplied to the second common liquid chamber penetrating through the partition wall, can be securely supplied to the second liquid paths with a sufficient supply amount, whereby the liquid discharge can be achieved in stable manner.

[Discharge Liquid, Bubble Generating Liquid]

As explained in the foregoing embodiments, the present invention, employing a configuration involving the movable members 31, allows to discharge the liquid with a higher discharge power, a discharge efficiency and a higher discharge speed, in comparison with the conventional liquid discharge head. Among such embodiments, if the bubble generating liquid and the discharge liquid are same, there can be employed liquid of various kinds as long as it is not deteriorated by the heat from the heat generating member 2, also hardly generates deposit on the heat generating member 2 upon heating, is capable of reversible state change of gasification and condensation by heat and does not deteriorate the liquid path, the movable member 31 and the partition wall 30.

Among such liquids, the ink of the composition employed in the conventional bubble jet printing apparatus may be employed as the liquid for printing.

On the other hand, in case the discharge liquid and the bubble generating liquid are made mutually different in the head of the present invention with the two-path configuration, the bubble generating liquid can have the properties as explained in the foregoing and can be composed, for example, methanol, ethanol, n-propanol, isopropanol, n-hexane, n-heptane, n-octane, toluene, xylene, methylene dichloride, trichlene, freon TF, freon BF, ethylether, dioxane, cyclohexane, methyl acetate, ethyl acetate, acetone, methylethylketone, water or a mixture thereof.

As the discharge liquid there can be employed various liquids irrespective of the bubble generating property or the thermal properties, and there can even be employed a liquid with low bubble generating property, a liquid easily denatured or deteriorated by heat or a liquid of a high viscosity, which cannot be easily discharged in the conventional art.

However the discharge liquid is preferably not to hinder the discharge, bubble generation or the function of the movable member 31 by a reaction of the discharge liquid itself or with the bubble generating liquid.

The discharge liquid for printing can for example be ink of high viscosity. Also a pharmaceutical liquid or perfume susceptible to heat may be employed as the discharge liquid.

In the present invention, the printing operation was conducted with the inks of following compositions as the printing liquid that could be used for both the discharge liquid and the bubble generating liquid. There could be obtained a very satisfactory printed image because of the improved accuracy of landing of the droplet, as the ink discharge speed was made higher by the increased discharge power.

| Composition of dye ink (viscosity 2 cp) | |
|---|---|
| dye (C.I. food black 2) | 3 wt % |
| diethylene glycol | 10 wt % |
| thiodiglycol | 5 wt % |
| ethanol | 3 wt % |
| water | 77 wt % |

The printing operation was also conducted with combinations of the following liquids. Satisfactory discharge could be achieved not only with a liquid of a viscosity between 10 and 20 cp but also with a liquid of a very high viscosity of 150 cp, which could not be discharged in the conventional head, thereby providing prints of high image quality:

| Composition of bubble generating liquid 1 | |
|---|---|
| ethanol | 40 wt % |
| water | 60 wt % |
| **Composition of bubble generating liquid 2** | |
| water | 100 wt % |
| **Composition of bubble generating liquid 3** | |
| isopropyl alcohol | 10 wt % |
| water | 90 wt % |
| **Composition of discharge liquid 1 (pigment ink of ca. 15 cp)** | |
| carbon black | 5 wt % |
| styrene-acrylic acid-ethyl acrylate copolymer (acid value 140, weight-averaged molecular weight 8000) | 1 wt % |
| monoethanolamine | 0.25 wt % |
| glycerine | 69 wt % |
| thiodiglycol | 5 wt % |
| ethanol | 3 wt % |
| water | 16.75 wt % |
| **Composition of discharge liquid 2 (55 cp)** | |
| polyethyleneglycol 200 | 100 wt % |
| **Composition of discharge liquid 3 (150 cp)** | |
| polyethyleneglycol 600 | 100 wt % |

In case of the aforementioned liquid that is considered difficult to discharge in the conventional head, the low discharge speed increases the fluctuation in the directionality of discharge, resulting in an inferior precision of the dot landing on the recording paper. Also the discharge amount fluctuates because of the unstable discharge. The high-quality image has been difficult to obtain because of these factors. However, in the head configuration of the foregoing examples, the bubble generation can be conducted sufficiently and stably by the use of the bubble generating liquid mentioned above. As a result, there can be achieved improvements in the precision of droplet landing and in the stability of ink discharge amount, whereby the quality of the printed image can be significantly improved.

[Preparation of Liquid Discharge Head]

In the following there will be explained the preparation process of the liquid discharge head of the present invention.

A liquid discharge head as shown in FIG. 2 is prepared by forming the support member 34 for supporting the movable member 31 on the element substrate 1 by patterning for example a dry film, then fixing the movable member 31 to the support member 34 by adhesion or fusion, and adhering the grooved member which bears plural grooves constituting the liquid paths 10, the discharge ports 18 and the recess constituting the common liquid chamber 15, to the element substrate 1 in such a manner that the grooves respectively correspond to the movable members 31.

In the following there will be explained the preparation process of the liquid discharge head of the two-path configuration, as shown in FIG. 10 and FIG. 23.

FIG. 23 is an exploded perspective view of the head of the present invention.

In brief, the head is prepared by forming the walls of the second liquid paths 16 on the element substrate 1, then mounting the partition wall 30 thereon and mounting thereon the grooved member 50 which bears the grooves constituting the first liquid paths 14 etc. Otherwise it is prepared, after the formation of the walls of the second liquid paths 16, by adhering thereon the grooved member 50 already combined with the partition wall 30.

In the following there will be given a detailed explanation on the method of preparation of the second liquid paths.

FIGS. 24A to 24E are schematic cross-sectional views showing the preparation method of the liquid discharge head of the present invention.

Figure 24A:
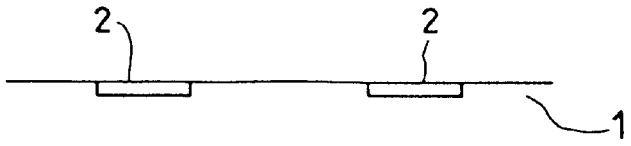
FIGS. 24A, 24B, 24C, 24D and 24E are views showing process steps in a manufacturing method for the liquid discharge head of the present invention.

In this embodiment, on the element substrate (silicon wafer) 1, there were prepared electrothermal converting elements including the heat generating members 2 for example of hafnium boride or tantalum nitride as shown in FIG. 24A with manufacturing apparatus similar to that employed in the semiconductor device manufacture, and the surface of the element substrate 1 was rinsed for the purpose of improving adhesion with the photosensitive resin in a next step. Further improvement in the adhesion was achieved by surface modification of the element substrate 1 with ultraviolet light-ozone treatment, followed by spin coating of liquid obtained by diluting a silane coupling agent (A189 supplied by Nippon Unicar Co.) to 1 wt % with ethyl alcohol.

Figure 24B:
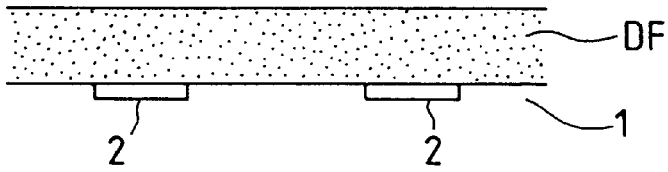

After surface rinsing, an ultraviolet-sensitive resin film DF (dry film Ordil SY-318 supplied by Tokyo Oka Co.) was laminated on the substrate 1 with thus improved adhesion, as shown in FIG. 24B.

Figure 24C:
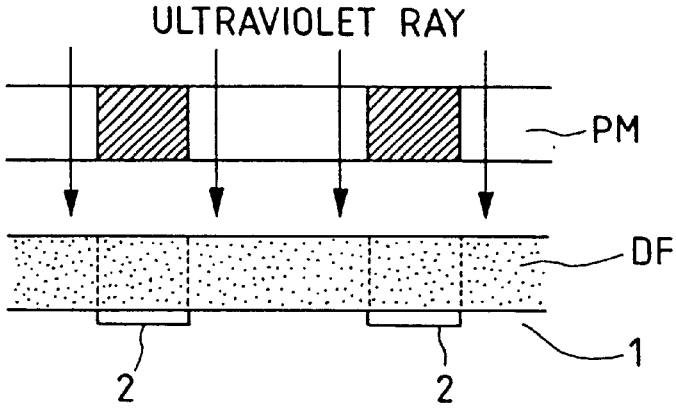

Then, as shown in FIG. 24C, a photomask PM was placed on the dry film DF, and the portions to be left as the walls of the second liquid's paths were exposed to the ultraviolet light through the photomask PM. The exposure step was conducted with an exposure apparatus MPA-600, supplied by Canon K.K., with an exposure amount of about 600 $mJ/cm^2$.

Figure 24D:
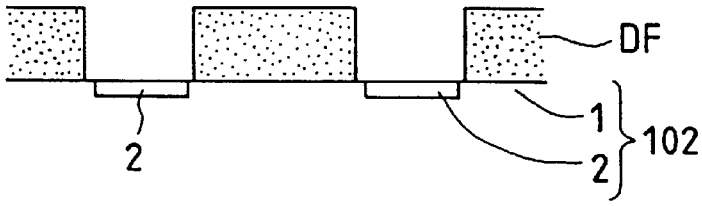

Then, as shown in FIG. 24D, the dry film DF was developed with developer (BMRC-3 supplied by Tokyo Oka Co.) consisting of a mixture of xylene and butylcellosolve acetate to dissolve the unexposed portions, whereby the exposed and hardened portions were left as the walls of the second liquid paths 16. The residue remaining on the element substrate 1 was removed by a treatment for ca. 90 seconds in an oxygen plasma ashing apparatus (MAS-800 supplied by Alcantec Co.). Subsequently ultraviolet light irradiation was conducted for 2 hours at 150° C. with an intensity of 100 $mJ/cm^2$ to completely harden the exposed portions.

The above-explained method allowed to uniformly prepare the second liquid paths in precise manner, on the plural heater boards (element substrate 1) to be divided from the silicon wafer. The silicon substrate was cut and separated, by a dicing machine with a diamond blade of a thickness of 0.05 mm, into respective heater boards 1. The separated heater board was fixed on the aluminum base plate 70 with an adhesive material (SE4400 supplied by Toray Co.) (cf. FIG. 27). Then the heater board 1 was connected with the printed wiring board 71, adhered in advance to the aluminum base plate 70, with aluminum wires (not shown) of a diameter of 0.05 mm.

Figure 24E:
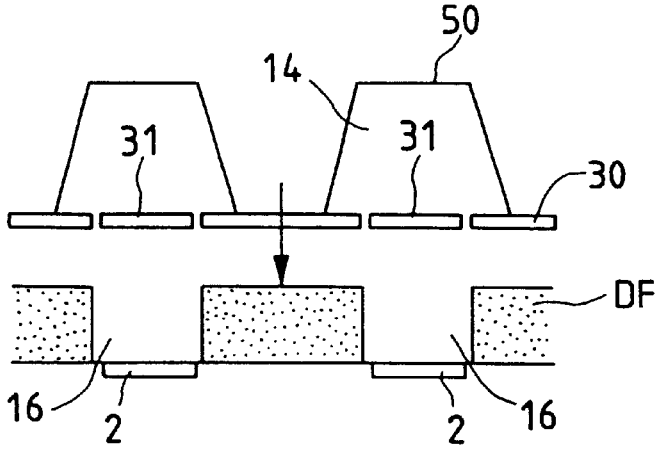

Then, on thus obtained heater board 1, the adhered member of the grooved member 50 and the partition wall 30 was aligned and adhered by the above-mentioned method as shown in FIG. 24E. More specifically, after the grooved member having the partition wall 30 and the heater board 1 were aligned and fixed with the spring 78, the ink/bubble generating liquid supply member 80 was fixed by adhesion on the aluminum base plate 70, and the gaps among the aluminum wires and between the grooved member 50, the heater board 1 and the ink/bubble generating liquid supply member 80 were sealed with a silicone sealant (TSE399 supplied by Toshiba Silicone Co.).

The preparation of the second liquid paths by the above-mentioned method allowed to obtain liquid paths of satisfactory precision, without positional aberration with respect to the heaters of each heater board. In particular, the adhesion in advance of the grooved member 50 and the partition wall 30 allows to improve the positional precision between the first liquid paths 14 and the movable members 31.

Such high-precision manufacturing method stabilizes the liquid discharge and improves the print quality. Also collective manufacture on the wafer enables the manufacture in a large amount, with a low cost.

In the present embodiment, the second liquid paths were prepared with the ultraviolet-hardenable dry film, but they can also be prepared by laminating and hardening a resin having the absorption band in the ultraviolet region, particularly in the vicinity of 248 nm, and directly eliminating the resin in the portions constituting the second liquid paths with an excimer laser.

Also there can be employed another method of preparation.

FIGS. 25A to 25D are views showing the process steps of a second example of the preparation method of the liquid discharge head of the present invention.

Figure 25A:
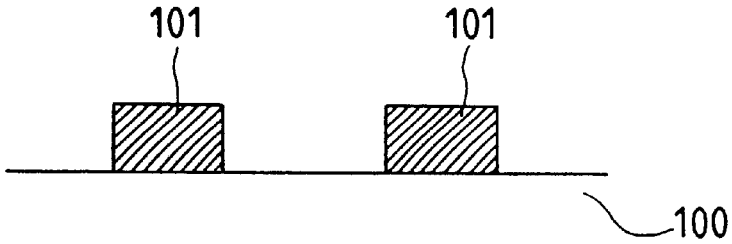
FIGS. 25A, 25B, 25C and 25D are views showing process steps in a manufacturing method for the liquid discharge head of the present invention.

In this embodiment, as shown in FIG. 25A, a photoresist 101 of a thickness of 15 $\mu$m was patterned in the form the second liquid paths on a stainless steel substrate 100.

Figure 25B:
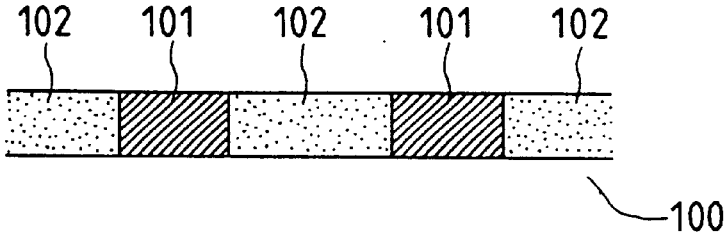

Then, as shown in FIG. 25B, the substrate 100 was subjected to electroplating to grow a nickel layer 102 with a thickness of 15 $\mu$m. The plating bath contained nickel sulfamate, a stress reducing agent (Zero-all supplied by World Metal Co.), an antipitting agent (NP-APS supplied by World Metal Co.) and nickel chloride. The electroplating was conducted by mounting an electrode at the anode side and the patterned substrate 100 at the cathode side, with the plating bath of 50° C. and a current density of 5 A/cm$^2$.

Figure 25C:
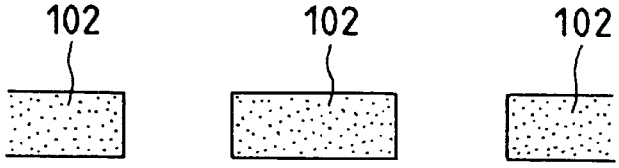

Then, as shown in FIG. 25C, the substrate 100 after the electroplating step was subjected to ultrasonic vibration, whereby the nickel layer 102 was peeled off from the substrate 100 in the portions of the second liquid paths.

Figure 25D:
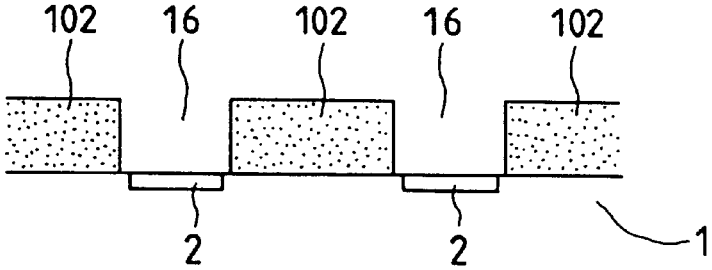

On the other hand, the heater boards bearing the electrothermal converting elements were prepared on a silicon wafer, with manufacturing apparatus similar to those used in the semiconductor device manufacture, and the wafer was separated into the respective heater boards with the dicing machine, as in the foregoing embodiment. The heater board 1 was adhered to the aluminum base plate 70 on which the printed wiring board was adhered in advance, and the electrical connections were made with the printed wiring board by the aluminum wires (not shown). On the heater board in such state, the nickel layer 102 bearing the second liquid paths prepared in the foregoing step was aligned and fixed, as shown in FIG. 25D. This fixing only needs to be of a level not causing positional displacement at the adhesion of the cover plate, since the cover plate and the partition wall are fixed by the spring in a subsequent step, as in the foregoing first embodiment.

In this embodiment, the alignment and fixing mentioned above were achieved by coating an ultraviolet-curable adhesive material (Amicon UV-300 supplied by Grace Japan Co.), followed by ultraviolet irradiation of 100 mJ/cm$^2$ for about 3 seconds in an ultraviolet irradiating apparatus.

The method of this embodiment can provide a highly reliable head resistant to alkaline liquids, since the liquid path walls are made of nickel, in addition to the preparation of the highly precise second liquid paths without positional aberration relative to the heat generating members.

Also there can be employed another method of preparation.

FIGS. 26A to 26D are views showing process steps of a third example of the preparation method of the liquid discharge head of the present invention.

Figure 26A:
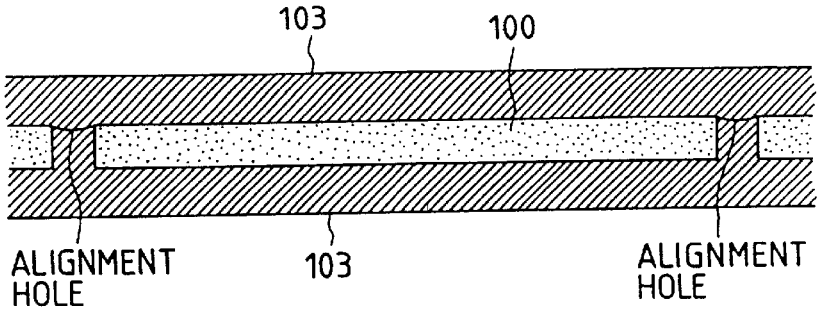
FIGS. 26A, 26B, 26C and 26D are views showing process steps in a manufacturing method for the liquid discharge head of the present invention.

In this example, photoresist 1030 (PMERP-AR900 supplied by Tokyo Oka Co.) was coated on both faces of a stainless steel substrate 100 of a thickness of 15 $\mu$m, having an alignment hole or a mark 100*a,* as shown in FIG. 26A.

Figure 26B:
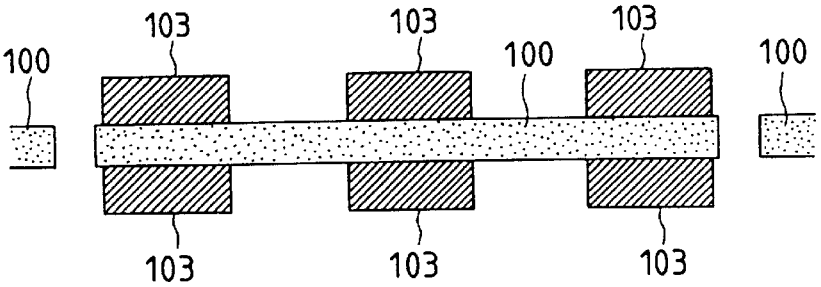

Then, as shown in FIG. 26B, exposure was made with an exposing apparatus (MPA-600 supplied by Canon Co.), utilizing the alignment hole 100*a* of the substrate 100, with an exposure amount of 800 mJ/cm$^2$, to remove the resist 1030 in the portions where the second liquid paths are to be formed.

Figure 26C:
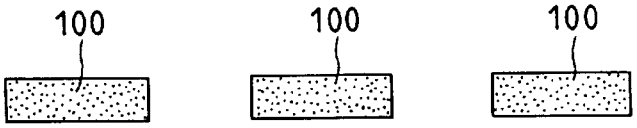

Then, as shown in FIG. 26C, the substrate 100 with the patterned resists on both faces was immersed in an etching bath (aqueous solution of ferric chloride or cupric chloride) to etch off the portions exposed from the resist, and then the resist was stripped off.

Figure 26D:
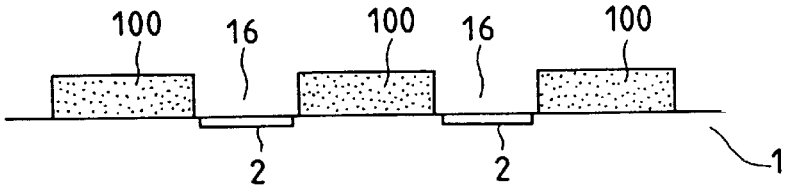

Then, as shown in FIG. 26D, the substrate 100 subjected to the etching step was aligned and fixed on the heater board 1 in the same manner as in the foregoing embodiments to obtain the liquid discharge head having the second liquid paths 16.

The method of the present embodiment can form the second liquid paths 16 in highly precise manner without positional aberration with respect to the heat generating members, and can provided a highly reliable liquid discharge head resistant to acidic and alkaline liquids, since the liquid paths are formed with stainless steel.

As explained in the foregoing, the method of the present embodiment enables highly precise alignment of the electrothermal converting member and the second liquid path, by forming the walls thereof in advance on the element substrate 100. Also the liquid discharge heads can be prepared in a large number, with a low cost, since the second liquid's liquid paths can be simultaneously prepared on a plurality of the element substrates prior to the cutting of the wafer.

Also, the liquid discharge head prepared by the preparation method of the present embodiment can efficiently receive the pressure of the bubble, generated by heat generation of the electrothermal converting member, thereby providing an excellent discharge efficiency, since the heat generating member 2 and the second liquid path are aligned with a high precision.

[Liquid Discharge Head Cartridge]

In the following there will schematically be explained a liquid discharge head cartridge, employing the liquid discharge head explained in the foregoing.

Figure 27:
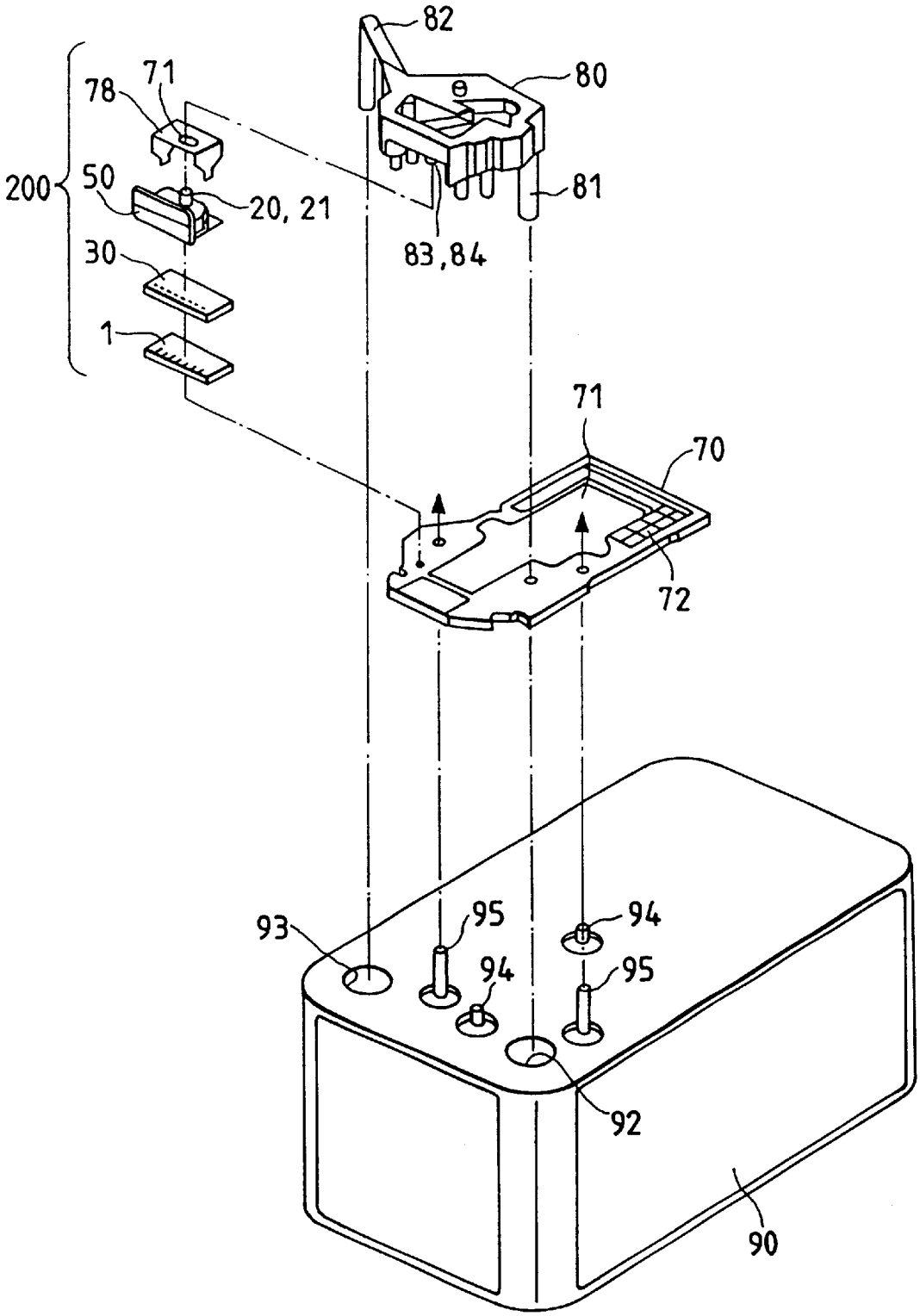
FIG. 27 is an exploded perspective view of a liquid discharge head cartridge.

FIG. 27 is an exploded perspective view of a liquid discharge head cartridge, including the liquid discharge head and principally composed of a liquid discharge head unit 200 and a liquid container 80.

The liquid discharge head unit 200 is composed of an element substrate 1, a partition wall 30, a grooved member 50, a press spring 78, a liquid supply member 90, a support member 70 etc. The element substrate 1 is provided with an array of a plurality of the heat generating resistance members for supplying the bubble generating liquid with heat, and a plurality of functional elements for selectively driving the heat generating resistance members. The bubble generating liquid paths are formed between the element substrate 1 and the aforementioned partition wall 30 bearing the movable members. The unrepresented discharge liquid paths, in which the discharge liquid flows, are formed by the adhesion of the partition wall 30 and the grooved cover plate 50.

The press spring 78 exerts a biasing force on the grooved member 50 toward the element substrate 1, and such biasing force satisfactorily maintains the element substrate 1, the partition wall 30, the grooved member 50 and a support member 70 to be explained later in integral manner.

The support member 70, for supporting the element substrate 1, further supports a circuit board 71 connected with the element substrate 1 for electric signal supply thereto and a contact pad 72 to be connected with a main apparatus for signal exchange therewith.

The liquid container 90 contains therein, in divided manner, the discharge liquid such as ink and the bubble generating liquid for bubble generation, to be supplied to the liquid discharging head. On the outside of the liquid container 90, there are formed positioning units 94 for positioning a connection member for connecting the liquid container 90 with the liquid discharging head, and fixing shafts 95 for fixing the connection member. The discharge liquid is supplied from a discharge liquid supply path 92 of the liquid container 90, through a supply path 84 of the connection member, to a discharge liquid supply path 81 of a liquid supply member 90, and further to the first common liquid chamber through discharge liquid supply paths 83, 71, 21 of various members. The bubble generating liquid is similarly supplied from a supply path 93 of the liquid container, through a supply path of the connection member, to a bubble generating liquid supply path 82 of the liquid supply member 80, and further to the second common liquid chamber through bubble generating supply paths 84, 71, 22.

The liquid discharge head cartridge explained above has a supply form and a liquid container capable of liquid supply even in case the bubble generating liquid is different from the discharge liquid, but, if they are mutually same, the supply form and the liquid container need not be divided between the bubble generating liquid and the discharge liquid.

The liquid container 90 may be refilled after the use of respective liquids, and may be provided with liquid inlets for this purpose. Also the liquid discharging head may be integrated with the liquid container 90 or may be made detachable therefrom.

[Liquid Discharge Apparatus]

Figure 28:
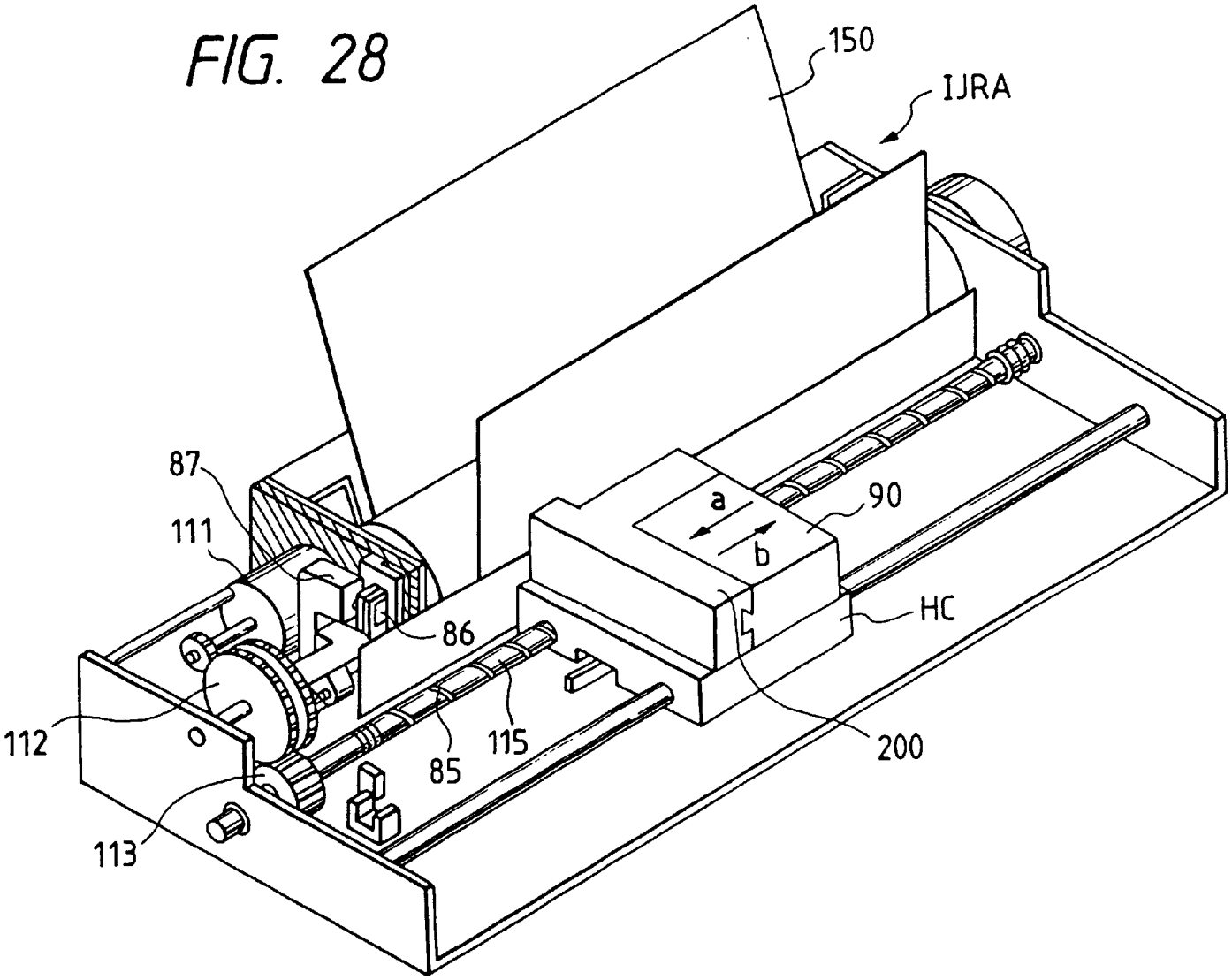
FIG. 28 is a schematic view showing the configuration of a liquid discharge apparatus.

FIG. 28 schematically shows the configuration of a liquid discharge apparatus in which the liquid discharge head is loaded. In the present embodiment, there will be particularly explained an ink discharging record apparatus utilizing ink as the discharge liquid.

A carriage HC executes reciprocating motion in the transversal direction of a recording medium, such as recording paper, transported by record medium transport means, and supports a liquid tank unit 90 containing ink and a head cartridge with a detachable liquid discharge head unit 200.

When drive signals are supplied from the unrepresented signal supply means to the liquid discharge means on the carriage, the liquid discharge head in response discharges the print liquid onto the record medium.

The liquid discharge apparatus of the present embodiment is further provided with a motor 111 for driving the record medium transport means and the carriage, gears 112, 113 and a carriage shaft 115 for transmitting the power of the motor to the carriage. Satisfactory prints could be obtained by discharging liquid onto various record media by means of this recording apparatus and the liquid discharge method executed on this apparatus.

Figure 29:
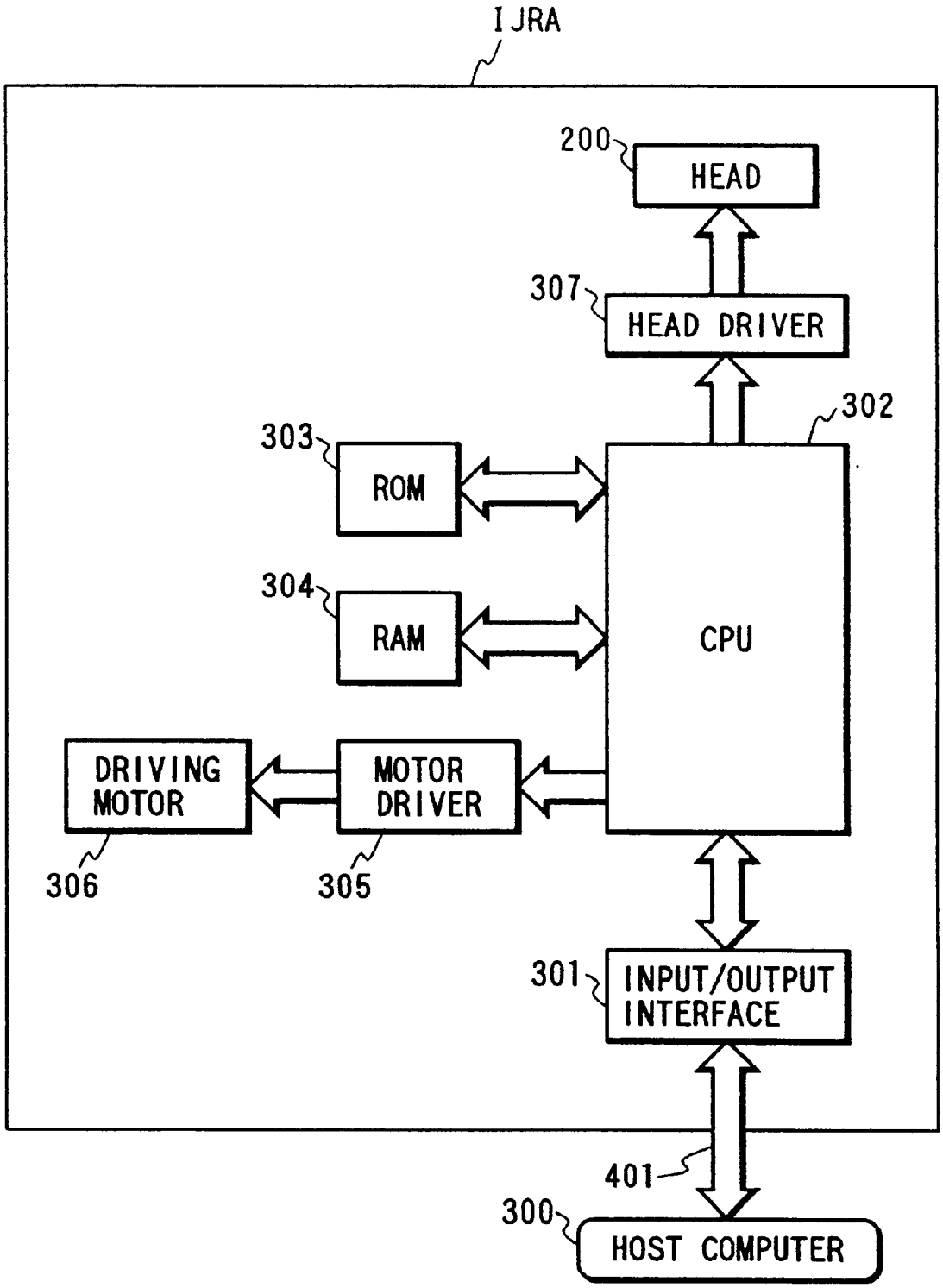
FIG. 29 is a block diagram of the apparatus.

FIG. 29 is a block diagram of the entire ink discharging record apparatus utilizing the liquid discharge method and the liquid discharge head of the present invention.

The recording apparatus receives, as the control signal, print information from a host computer 300. The print information is temporarily stored in an input interface 301 in the printing apparatus and is at the same time converted into data that can be processed in the recording apparatus, and supplied to a CPU 302 which also functions as head drive signal supply means. The CPU 302 processes the entered data by means of peripheral units such as a RAM 304, based on a control program stored in a ROM 303, thereby obtaining image data to be printed.

The CPU 302 also prepares drive data for driving the motor for displacing the print paper and the recording head in synchronization with the image data, in order to record the image data in an appropriate position on the record paper. The image data and the drive data are transmitted, respectively through a head driver 307 and a motor driver 305, to the head 200 and the motor 306, which are thus driven with controlled timing to form an image.

The record medium usable in the above-explained recording apparatus and adapted to receive the liquid such as ink includes various papers, an OHP sheet, plastic materials employed in a compact disk or decorative plates, textiles, metals such as aluminum and copper, leathers such as cow leather, pig leather or artificial leather, timber such as wood or plywood, bamboo, ceramics such as a tile, a three-dimensional structural material such as sponge.

Also the above-explained recording apparatus includes a printer for recording on various papers and an OHP sheet, a plastics recording apparatus for recording on plastic materials such as of a compact disk, a metal recording apparatus for recording on a metal plate, a leather recording apparatus for recording on leather, a timber recording apparatus for recording on timber, a ceramics recording apparatus for recording on ceramic materials, a recording apparatus for recording on three-dimensional network-structure materials such as sponge, and a recording apparatus for recording on textiles.

The discharge liquid to be employed in such liquid discharging apparatus may be selected according to the respective recording medium and the recording conditions.

[Recording System]

In the following there will be explained an example of the ink jet recording system, employing the liquid discharge head of the present invention and executing recording on a record medium.

Figure 30:
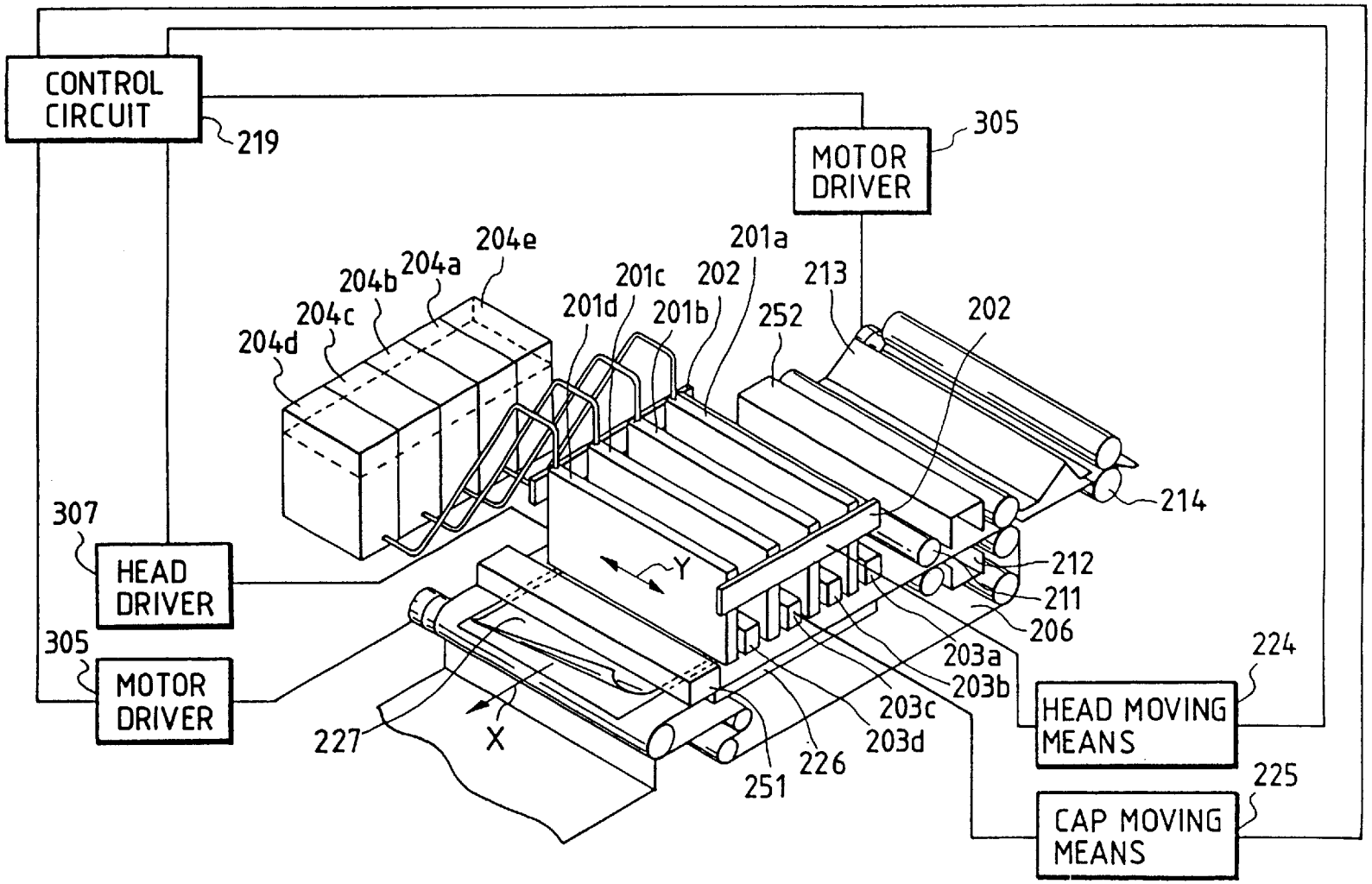
FIG. 30 is a view showing a liquid discharge recording system.

FIG. 30 is a schematic view showing the configuration of an ink jet recording system, employing aforementioned liquid discharge heads 201.

In the present embodiment, there are employed liquid discharge heads of full-line type, having plural discharge ports at a pitch of 360 dpi over a length corresponding to the printable width of a print medium 150, thus having the discharge ports over the entire width (in Y-direction) of the recording area of the recording medium, and four heads 201*a*–201*d*, respectively of yellow (Y), magenta (M), cyan (C) and black (Bk), are supported by a holder 202, with a predetermined interval in the X-direction.

These heads receive signals from head drivers 307 constituting the drive signal supply means, and are driven by such signals.

The heads receive, as the discharge liquids, inks of Y, M, C and Bk colors from ink containers 204*a*–204*d*. A bubble generating liquid container 204*e* contains and supplies the bubble generating liquid to the heads.

Under the heads there are provided head caps 203*a*–203*d* which are provided therein with ink absorbent material such as sponge and are adapted to cover the discharge ports of the heads when the printing operation is not conducted, for the purpose of maintenance.

A conveyor belt 206 constitutes transport means for transporting the print medium. It is maintained along a predetermined path by various rollers, and is driven by a drive roller connected to a motor driver 305.

The ink jet recording system of this embodiment is provided with a pre-processing device 251 and a post-processing device 252 for applying various processes to the print medium before and after the recording, respectively at the upstream and downstream sides of the record medium transport path.

Such pre-process and post-process vary according to the kind of the record medium and that of the inks. For example, for metals, plastics and ceramics, the ink adhesion can be improved by surface activation by ultraviolet and ozone irradiation. Also in a record medium which easily generates static electricity such as plastics, dusts are easily deposited thereon and may hinder satisfactory printing operation. It is therefore advantageous to employ an ionizer as the pre-processing device to eliminate the static electricity from the print medium, thereby avoiding dust deposition. In case of textile printing, for the purpose of preventing the blotting and improving the dyability, there can be executed a pre-process of applying, to the textile, a material selected from an alkaline substance, a water-soluble substance, a synthetic polymer, a water-soluble metal salt, urea and thiourea. The pre-process is not limited thereto but can also be a process of maintaining the record medium at a temperature suitable for recording.

On the other hand, the post-process can for example be a fixation process for accelerating the ink fixation by a heat treatment or ultraviolet irradiation, or washing of a processing material which is applied in the pre-process and remains unreacted in the record medium.

The present embodiment employs full-line heads, but such configuration is not restrictive and the system can also be of a configuration is not restrictive and the system can also be of a configuration for effecting the printing operation by transporting a small-sized head in the transversal direction of the print medium.

[Head Kit]

In the following there will be explained a head kit including a liquid discharge head of the present invention.

Figure 31:
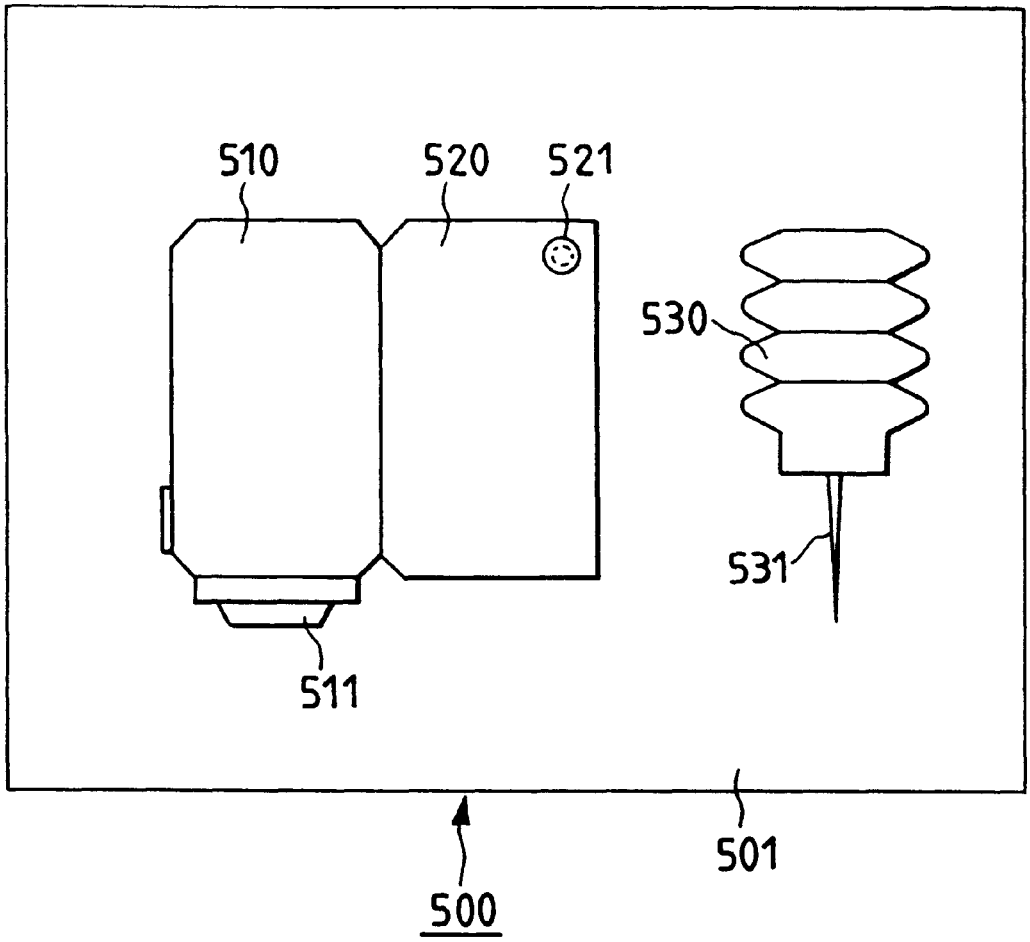
FIG. 31 is a schematic view of a head kit.

FIG. 31 schematically shows a head kit.

The head kit shown in FIG. 31 consists of a head 510 of the present invention having an ink discharge unit 511, an ink container 520 integral with or separable from the head 510 and ink filling means containing ink or filling into the ink container 520, all placed in a kit container 501.

When the ink is all consumed, a part of the inserting part (such as an injection needle) 531 of the ink filling means is inserted into an external aperture 521 of the ink container, a connecting portion thereof with the head or a hole formed in the wall of the ink container and the ink is filled from the ink filling means to the ink container 520 through such inserted part into the ink container. The above-explained kit, containing the liquid discharge head of the present invention, the ink container and the ink filling means in a kit container, allows to easily and promptly replenish the ink into the ink container when the ink therein is consumed, thereby allowing to start the printing operation promptly.

The above-explained head kit is assumed to contain the ink filling means, but it may also be of a form containing a detachable ink container filled with ink and a head in the kit container 501, without such ink filling means.

Also the kit shown in FIG. 31 only contains the ink filling means for ink filling to the ink container, but it may also contain bubble generating liquid filling means for filling the bubble generating liquid container with the bubble generating liquid.

EXAMPLES OF THE PRESENT INVENTION

In the following there will be given a detailed explanation on example of the present invention, with reference to the attached drawings. The following examples can be applied to each of the embodiments explained in the foregoing.

First Example

Figure 41A:
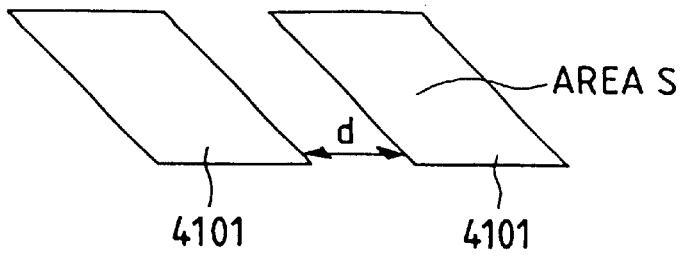
FIG. 41A PRIOR ART
FIGS. 41A and 41B are views showing the effects of an embodiment of the liquid discharge head of the present invention.
Figure 41B:
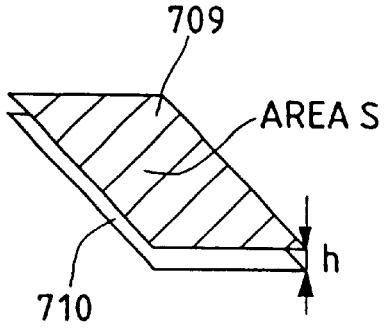

FIGS. 41A and 413 are views for explaining the effect of an example of the liquid discharge head of the present invention, wherein FIG. 41A shows the conventional configuration and FIG. 41B shows the configuration of the present invention.

In the conventional configuration, as shown in FIG. 41A, two electrodes 4101 are provided on a same plane with a mutual distance d therebetween, so that the resistance between the electrodes becomes high even when liquid is present in the liquid path. In order to reduce the resistance in the presence of liquid, the area of the electrodes has to be made larger. Thus, in case of detecting the presence or absence of liquid in each of plural liquid paths, it is difficult in the conventional configuration to form two electrodes of a sufficiently large size in each liquid path. It is additionally necessary to form the wirings for the two electrodes, so that the detection in each liquid path is difficult to realize.

Figure 32:
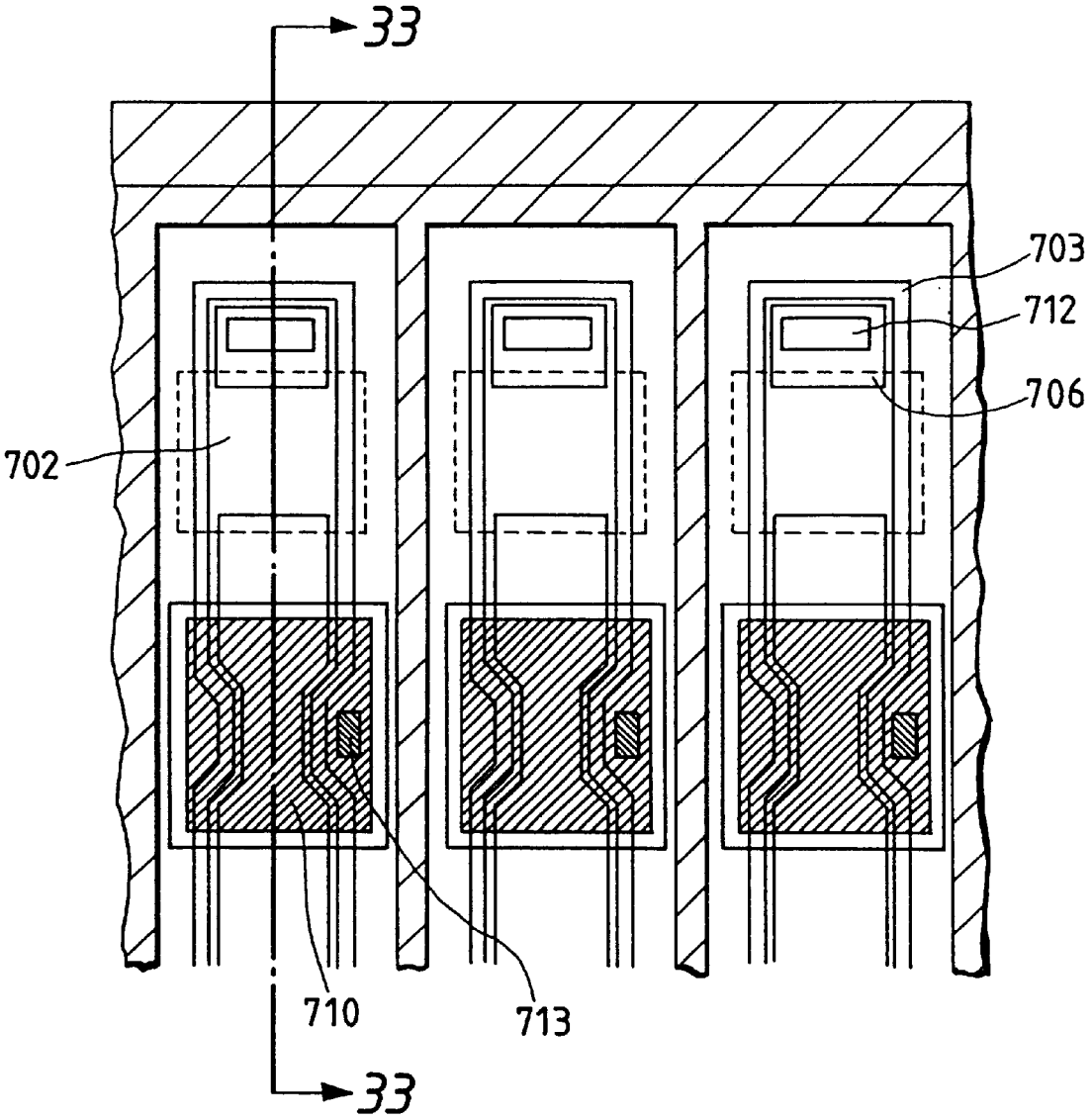
FIG. 32 is a view showing an embodiment of the liquid discharge head of the present invention.
Figure 33:
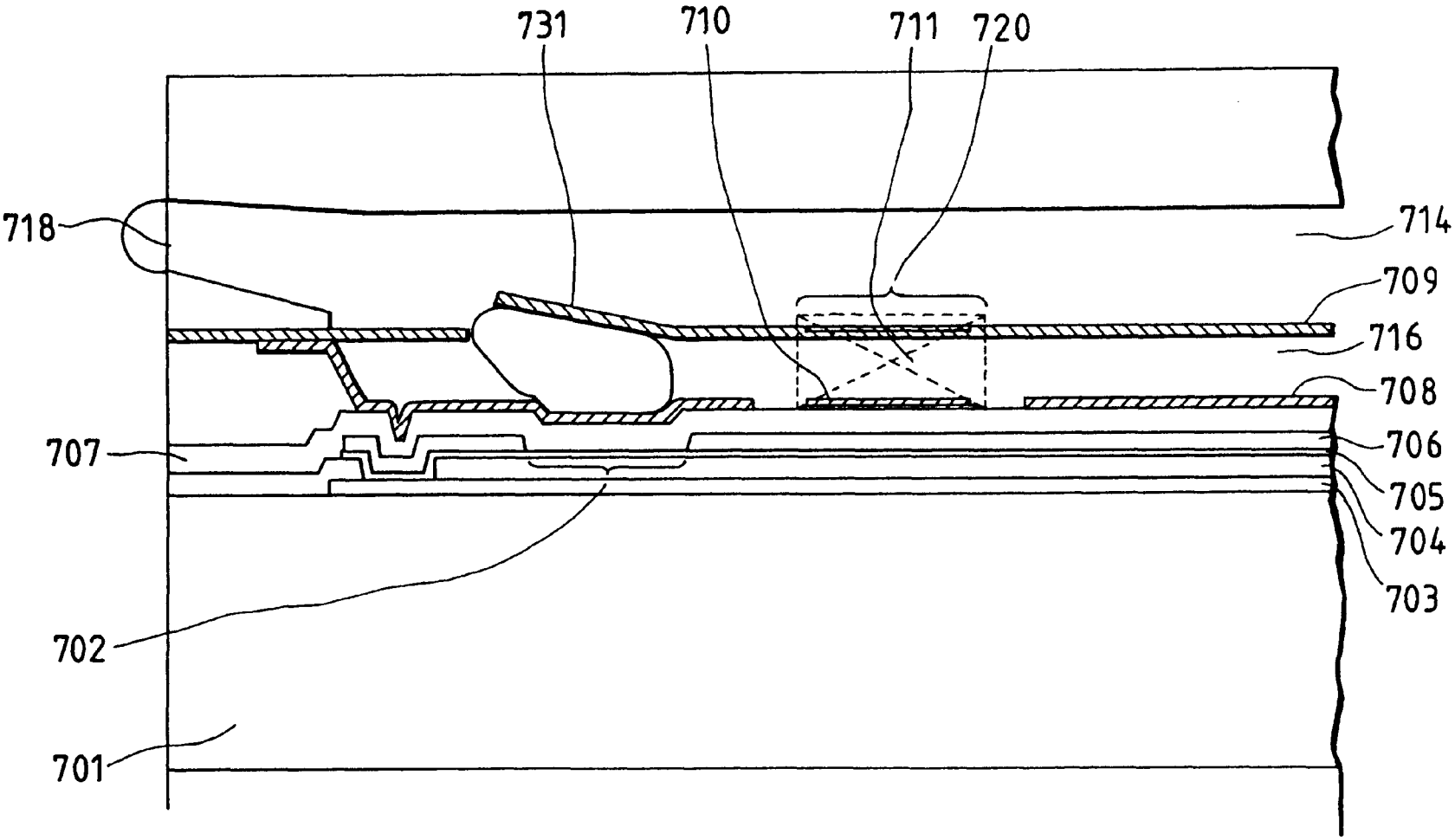
FIG. 33 is a cross-sectional view along a line 33—33 in FIG. 32.

On the other hand, in an embodiment of the present invention, as shown in FIG. 41B, a partition wall 709 and a separated electrode portion 710, serving as the two electrodes, are mutually separated by a height h. In this manner the two electrodes are formed in mutually opposed manner with a slight gap of several tens of micrometers to several micrometers in the liquid path. Thus, since the resistance between the electrodes is determined by h/S, the resistance becomes lower than in the conventional configuration, particularly in case liquid is present in the liquid path. Miniaturization is therefore possible, because there is only required a smaller electrode as the resistance between the electrodes varies significantly between the cases where the liquid is present or absent in the liquid path, and also because there is only required to form a single electrode. FIGS. 32 and 33 show an example of the configuration of the liquid discharge head in which the present invention is applicable, and FIG. 34 is a view showing the connection between the partition wall and the second conductive layer in the liquid discharge head shown in FIGS. 32 and 33.

Figure 34:
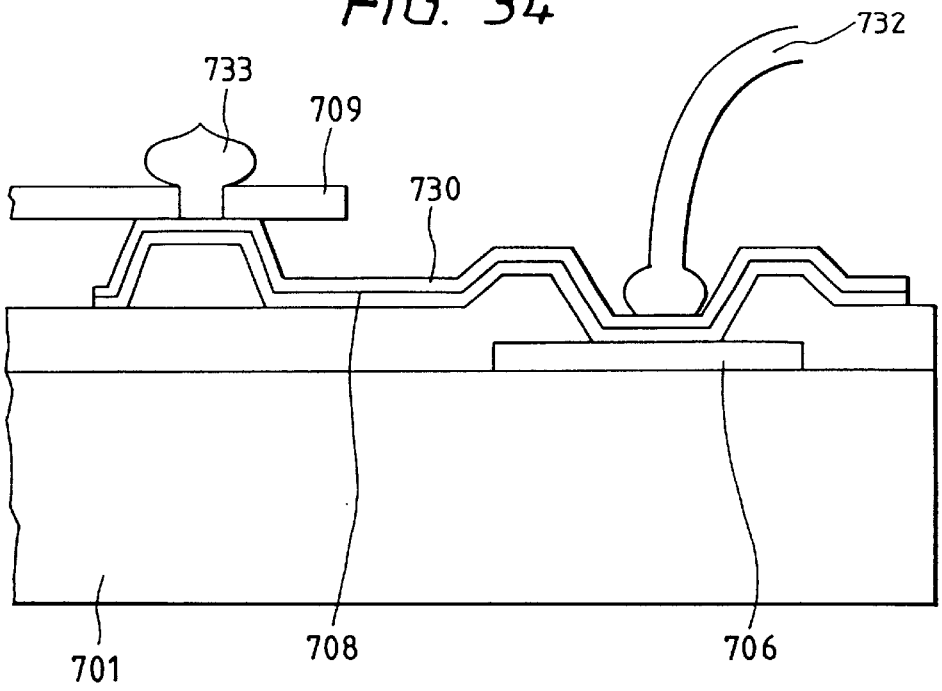
FIG. 34 is a view showing connection of a partition wall and a send conductive layer in the liquid discharge head shown in FIGS. 32 and 33.

Referring to FIG. 34, the partition wall 709 of the present example for separating the first and second liquid paths is composed of nickel for use as an electrode. Also as shown in FIG. 34, an external signal supplied through a bonding wire 732 is directly transmitted to the partition wall 709 through an anticavitation layer 708 for example of tantalum or chromium and an adhesion layer 730.

The adhesion layer 730 is composed of gold in consideration of the satisfactory adhesion to the bonding wire 732 and a fixing portion 733.

In this example, the partition wall 709 to be used as the electrode is composed of nickel, but it is not restrictive and may be composed of any material that has electric conductivity and durability for use as the partition wall. The entire partition wall 709 functions as the electrode since it is composed of nickel, but the partition wall may also be composed of a non-conductive material surfacially coated with a conductive member such as of nickel. There may also be employed a partition wall composed of a conductive material surfacially coated with a non-conductive material, as long as such surface coating is so thin that an AC signal can be transmitted to or from the exterior. Furthermore, there may be employed a partition wall of a non-conductive material, of which a part is composed of a conductive member.

Also in this example, the bonding wire 732 and the partition wall 709 are electrically connected in direct manner, but the exchange of the electrical signals between the bonding wire 732 and the partition wall 709 may also be conducted through the element substrate 701.

Also in this example, the partition wall 709 is electrically connected to the exterior through the anticavitaion film 708 and the adhesion layer 730, but such configuration of connection is not restrictive and any configuration allowing the use of the partition wall 709 as the electrode belongs to the present invention.

In the following there will be explained an example for detecting the state of the discharge liquid and the bubble generating liquid in an ink jet recording head, utilizing the partition wall of the present invention constituting the electrode.

FIG. 32 illustrates an example of the liquid discharge head of the present invention, particularly adapted to detect the state of the bubble generating liquid, and FIG. 33 is a cross-sectional view along a line 33—33 in FIG. 32.

In the example shown in FIGS. 32 and 33, between a first liquid path 714 communicating with a discharge port 718 and a second liquid (bubble generating liquid) path 716 for bubble generation there is provided a partition wall 709 for separating these liquid paths, and, at a side of the second liquid path 716 opposed to the partition wall 709, an element substrate 701 composed of a semiconductor material such as Si is provided thereon in succession a first conductive layer 703, an interlayer isolation film 704, a resistance layer 705, a second conductive layer 706 electrically connected with the partition wall 709, a passivation film 707, and an anticavitation film 708 composed of tantalum or chromium. A part of the partition wall 709 constitutes a movable member 731 which is adapted to displace toward the first liquid path 714 thereby forming a communication path between the first and second liquid paths 714, 716. Also a portion of the element substrate 701 corresponding to the movable member 731 does not bear the second conductive layer 706 but forms a heat generating part 702 for generating the bubble 740. Also the anticavitaion film 708 is provided thereon, at the upstream side of the bubble generating area with a separated electrode portion 710 which is electrically connected with the first conductive layer 703 or the second conductive layer 706. The separated electrode portion 710 need not be provided in the above-mentioned position but can also be provided on the heat generating portion 702, and, in such case, the detection is not conducted while heat is generated in the heat generating portion 702.

Even in case the separated electrode portion 710 is provided in the second common liquid chamber instead of the second liquid path 716, a higher detection sensitivity than in the conventional manner can be obtained by employing the partition wall 709 as one of the electrodes.

It is also possible to form a portion corresponding to the separated electrode portion 710 on a grooved member (cover plate) constituting the first liquid path 714 and to detect the state of the liquid in the first liquid path 714 in cooperation with the electrode 720 of the partition wall.

It is also possible to form an electrode corresponding to the separated electrode portion 710 on the grooved member (cover plate) in the first common liquid chamber and to detect the state of the liquid in the first common liquid chamber in cooperation with the electrode 720 of the partition wall.

It is furthermore possible to form an electrode corresponding to the separated electrode portion 710 on the grooved member (cover plate) in the first common liquid chamber and to detect the state of the liquid from the first and second common liquid chambers to the liquid container in cooperation with the electrode 720 of the partition wall.

In the following there will be explained the detecting principle for the state of liquid in the ink jet recording head of the above-explained configuration, particularly the presence or absence of liquid in the second liquid path.

Figure 35:
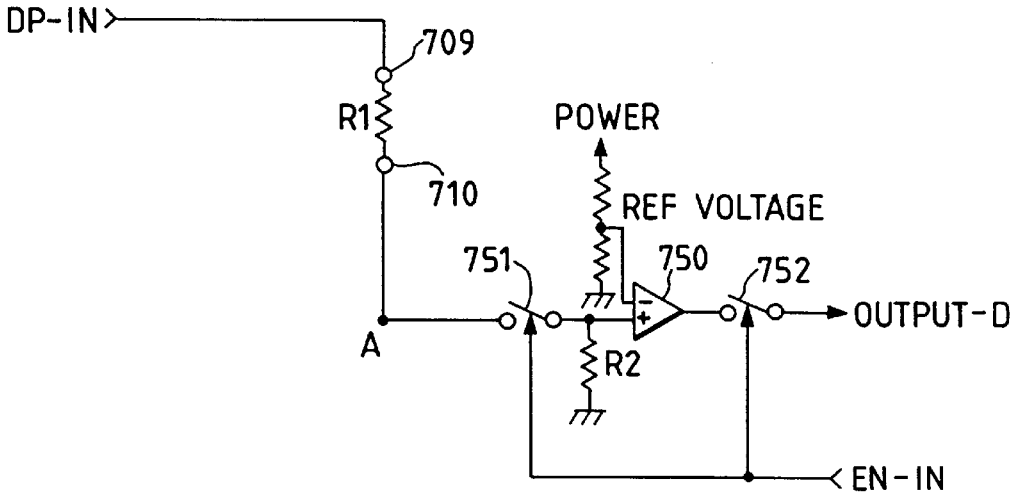
FIG. 35 is a circuit diagram showing an example of the circuit employed for detecting the liquid state such as presence or absence of liquid in a liquid path in the liquid discharge head shown in FIGS. 32 and 33.

FIG. 35 is a circuit diagram showing an example of the circuit used for detecting the state of the liquid, for example presence or absence thereof, in the liquid path in the liquid discharge head shown in FIGS. 32 and 33.

A detecting pulse is supplied to the electrode 709 of the partition wall (DP-IN), and a signal representing the presence or absence of liquid is obtained as the output of a computer 750 (OUTPUT-D).

When the detecting pulse for detecting the state of the liquid, such as presence or absence thereof, in the second liquid path 716 is entered into DP-IN from the exterior, it is transmitted through the bonding wire and the anticavitaion film and the entire partition wall becomes a pulse generating source.

The resistance R1 between the separated electrode portion 710 and the partition wall electrode 709, which is almost infinitely large in the absence of the liquid between the electrodes, has been found to become considerable smaller than in the conventional detecting method, in the presence of liquid. Therefore a resistance R2 of several to several hundred kΩ, which is sufficiently larger than the above-mentioned resistance in the presence of the liquid but is smaller than the resistance in the absence of the liquid is provided between the partition wall and the ground potential (GND) of the substrate, and the potential of the separated electrode portion (pointA) during the emission of the detecting pulse from the partition wall is compared with a predetermined threshold value in a comparator 750 constituting first detection means. In this manner the state of the liquid, such as presence or absence of the liquid or of a bubble, is detected from the result of such comparison.

In this example, the partition wall electrode constitutes the pulse generating source, but it may naturally be used also as the detecting electrode. In such case, the potential of the partition wall electrode may be processed through the heater board (substrate), or transmitted through the bonding wire and processed outside the head.

The present example utilizes a comparater 750 with a single threshold value, but it is also possible to utilize plural threshold values for example with a window comparator thereby detecting the state of the liquid in finer manner or detecting the state of mixing of the discharge liquid and the bubble generating liquid, depending upon the kind of the discharge liquid.

It is also possible, as shown in FIG. 35, to control the potential input to the comparator 750 and the output thereof by utilizing a shift register which is conventionally used for image transfer for determining the on/off operation of the heat generating member and the liquid discharge, providing analog switches 751, 752 operated by the output of such shift register and entering and transferring predetermined data in the shift register at the detecting operation.

The liquid detection can also be achieved by DC measurement, but AC measurement with an AC (pulse) signal of 1 kHz or higher is preferred because a DC current may form an insulation film by the surfacial oxidation of the anticavitaion film 708 or the partition wall 709.

Figure 36:
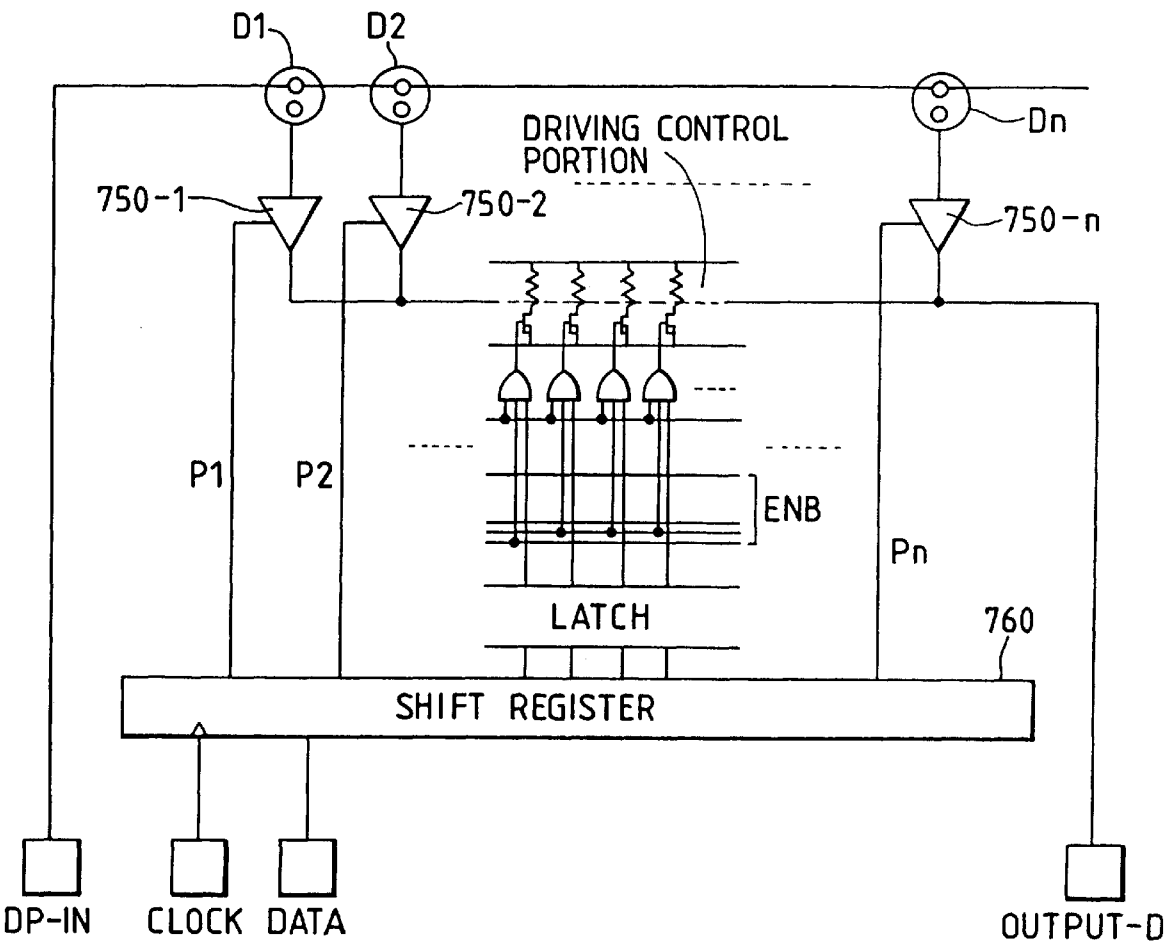
FIG. 36 is a circuit diagram in case the circuit shown in FIG. 35 is provided in plural liquid paths.

FIG. 36 is a circuit diagram in case the circuit shown in FIG. 35 is provided in plural liquid paths, wherein detection units D1, D2, . . . , Dn are provided respectively corresponding to liquid paths P1, P2, . . . , Pn and comparators 750-1, 750-2, . . . , 750-n are provided corresponding to the detection units.

As shown in FIG. 36, a shift register 760 which is conventionally incorporated in the element substrate 701 (cf. FIG. 33) for image transfer is utilized for forming clock signals and data signals common to all the liquid paths, and the detecting operation is executed on time-shared basis. Thus there can be avoided a significant increase in the number of terminals, even in case of detecting the state of liquid in the plural liquid paths.

In the following there will be explained the detecting operation for the state of liquid, such as presence or absence thereof, in the liquid paths, utilizing the circuit shown in FIG. 36.

Figure 37:
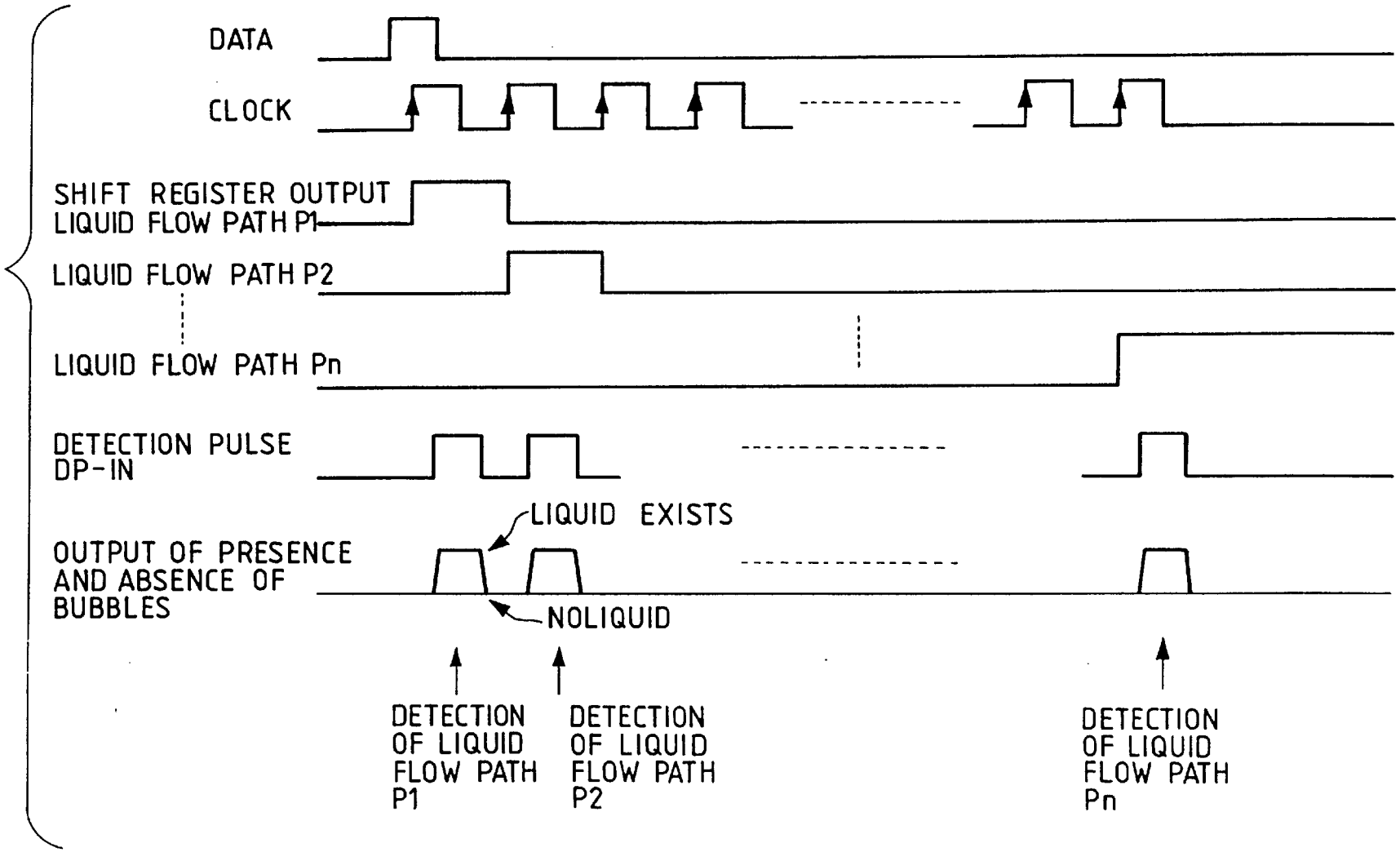
FIG. 37 is a wave form chart showing an example of the detecting operation for liquid state, such as presence or absence of liquid in the liquid path, in the circuit shown in FIG. 36.

FIG. 37 is a timing chart showing an example of the detecting operation for the state of liquid in the liquid paths, in the circuit shown in FIG. 36.

As shown in FIG. 37, in response to clock signals entered at predetermined timings, the shift register 760 releases enable output signals to the respective liquid paths at different timings.

Then, in response to the application of the detection pulse to the partition walls of the liquid paths, the detection pulse in a liquid path which is enabled for detection by the shift register 760 is compared with the reference potential in the comparator 750, and the state of liquid such as presence or absence thereof in such liquid path is detected from the result of comparison.

The results of comparison are serially outputted, and the state is identified as normal if pulses of a predetermined number are detected, but as abnormal if the number of pulses is less.

The above-explained operation may be controlled not only in the liquid discharge head but also in the liquid discharge apparatus in which such head is mounted.

Second Example

In the foregoing first example, the state of liquid such as presence or absence thereof in the liquid path is detected by the result of comparison of the potential of the separated electrode portion 710 (cf. FIG. 33) and the potential of the detection pulse applied to the partition wall 709 (cf. FIG. 33), but such detection may also be achieved by the comparison of the phase detected at the separated electrode portion 710 and that of the detection pulse applied to the partition wall 709.

Figure 38A:
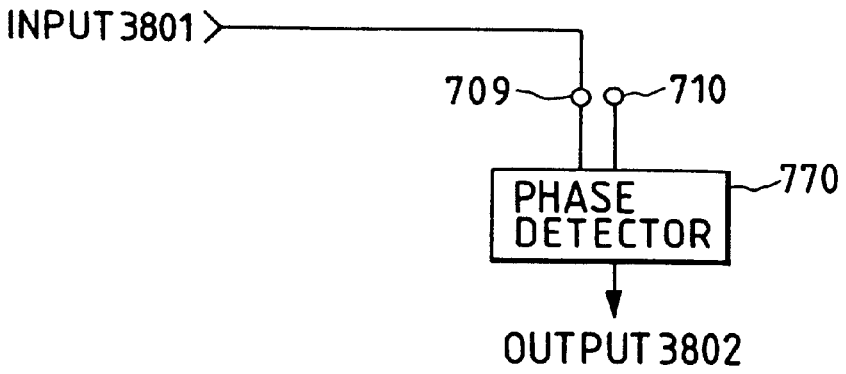
FIGS. 38A and 38B are views showing another embodiment of the liquid discharge head of the present invention.
Figure 38B:
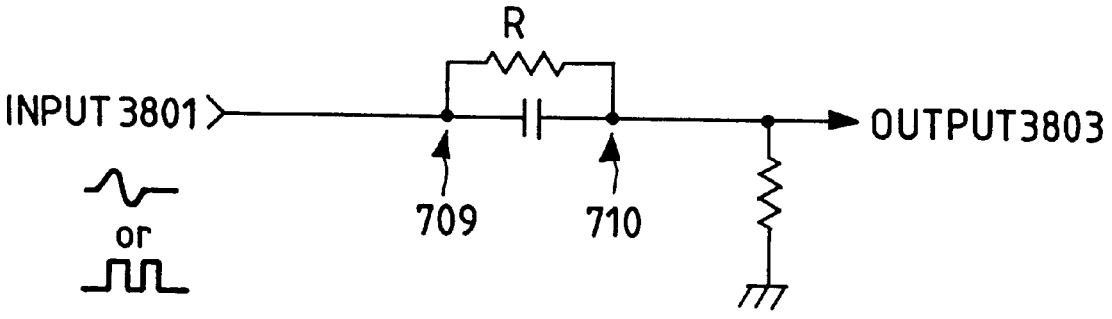

FIGS. 38A and 38B are respectively a circuit diagram and an equivalent circuit diagram, for detecting the state of liquid, such as presence or absence thereof, in the liquid path by the aberration in phase, in a second example of the liquid discharge head of the present invention.

As shown in FIGS. 38A and 38B, this example utilizes a phase detector 770 constituting second detection means, and judges the presence or absence of liquid in the liquid path, by comparing the phase detected at the separated electrode portion 710 (cf. FIG. 33) with the phase of the detection pulse applied to the partition wall 709 (cf. FIG. 33).

Referring to FIG. 38A, a detection signal is supplied to an input 3801, and the output of the phase detector is obtained at an output 3802. Also referring to FIG. 38B, a detecting signal is supplied to an input 3801, and the presence or absence of liquid in the liquid path is detected from an output 3803. In the configuration shown in FIG. 38B, the resistance R becomes smaller or larger respectively in the presence or absence of the liquid.

Figure 39A:
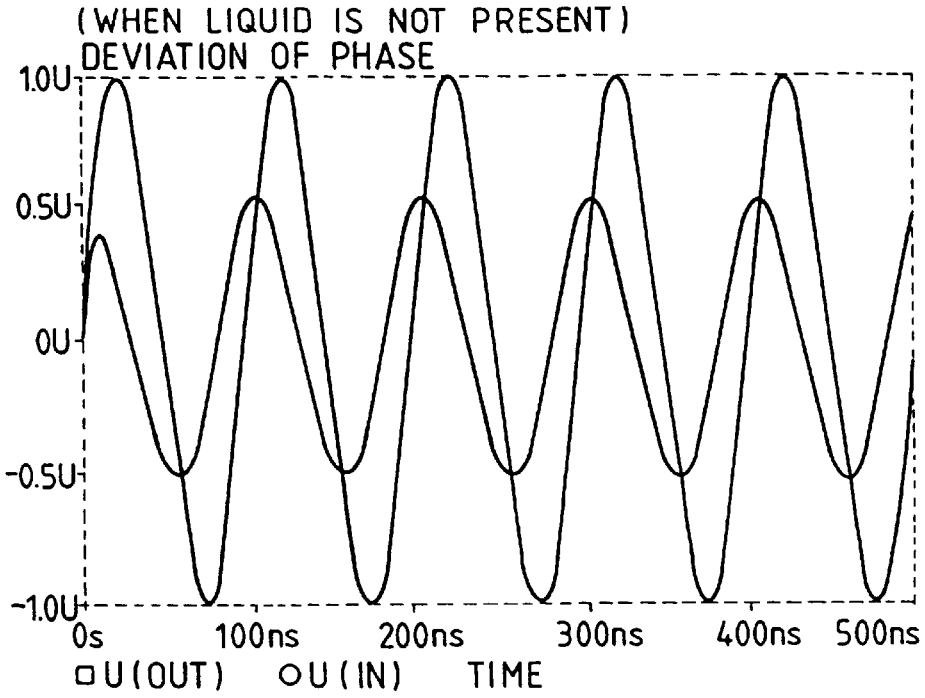
FIGS. 39A and 39B are charts showing examples of the output of the circuit shown in FIGS. 38A and 38B.
Figure 39B:
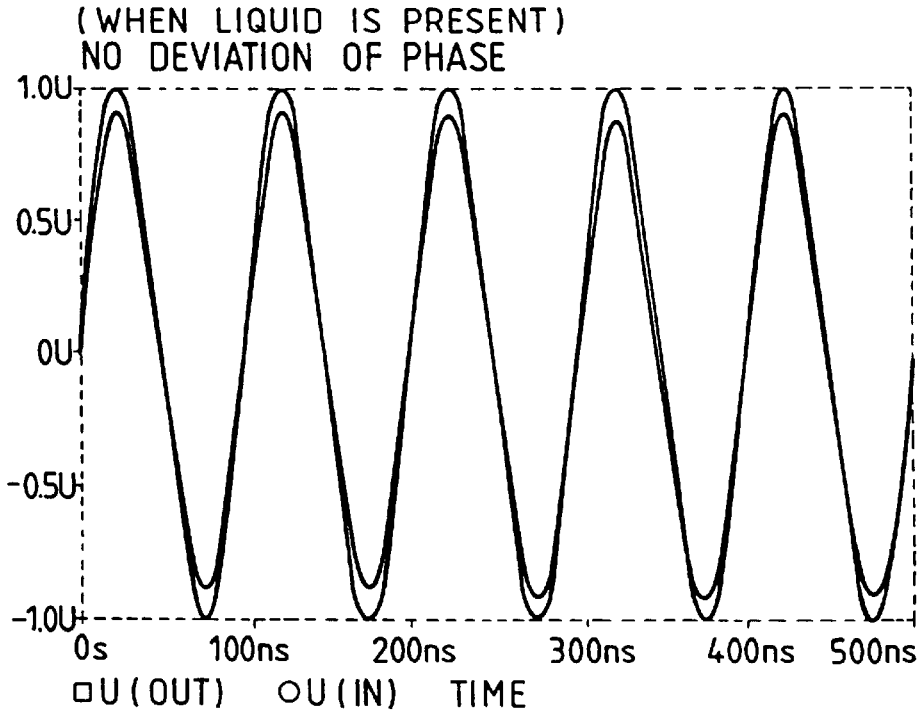

FIGS. 39A and 39B show an example of the output of the circuit shown in FIGS. 38A and 38B, respectively in the absence and presence of the liquid in the liquid path.

As shown in FIGS. 39A and 39B, the phase detected at the separated electrode portion 710 (cf. FIG. 33) and the phase of the detection pulse applied to the partition wall electrode 709 (cf. FIG. 33) are mutually displaced in the absence of the liquid in the liquid path, but they mutually coincide in the presence of the liquid.

Therefore, the liquid is judged absent or present in the liquid path respectively if the phase detected at the separated electrode portion 710 (cf. FIG. 33) and the phase of the detection pulse applied to the partition wall electrode 709 (cf. FIG. 33) are mutually different or mutually coincide. In the foregoing description, the detecting pulse is assumed to be a sinusoidal wave, but it can naturally assume other pulse shapes such as rectangular or the like.

Also, as already explained in the detection based on the potential difference, the pulse emission source is not limited to the partition wall but may also be the separated electrode portion.

In the following there will be explained the steps of preparation of the liquid discharge head of the above-explained configuration.

Figure 40:
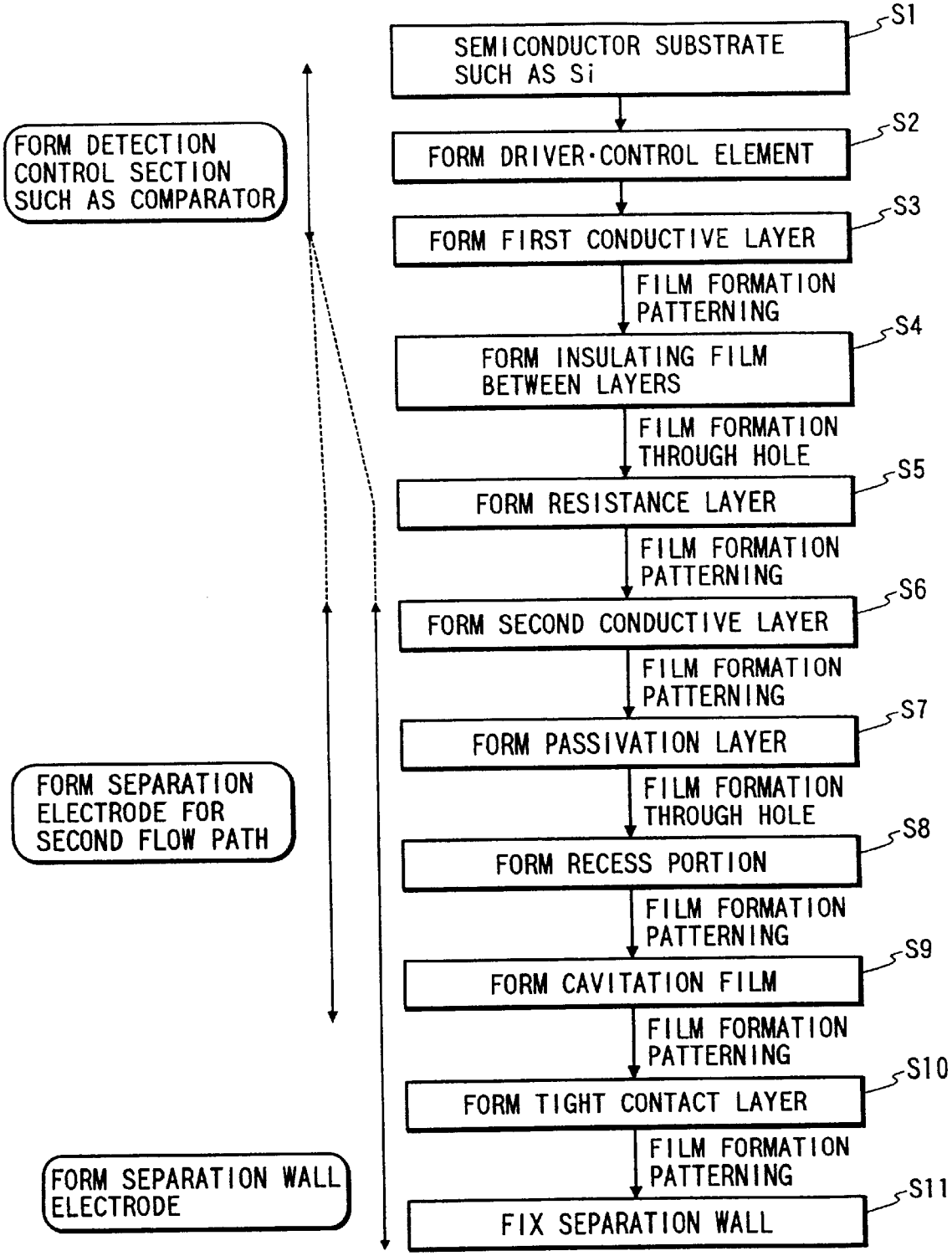
FIG. 40 is a flow chart showing the preparation process for the liquid discharge head shown in FIG. 33.

FIG. 40 is a view showing the process steps for preparing the liquid discharge head shown in FIG. 33.

At first there is prepared an element substrate 701 of a semiconductor material such as Si (step S1).

Then a driver circuit and a control element of BiCMOS or CMOS structure is prepared on the element substrate 701 (step S2).

Then, on the element substrate 701 bearing the driver circuit and the control element thereon, there is formed a first conductive layer 703 consisting for example of aluminum or gold (step S3).

Then an interlayer isolation film 704 consisting for example of silicon dioxide or silicon nitride is formed on the first conductive layer 703 (step S4).

Then a resistance layer 705 consisting for example of hafnium boride or tantalum nitride is formed on the interlayer isolation film 704 (step S5).

Then a second conductive layer 706 consisting for example of aluminum is formed on the resistance layer 705, except for the heat generating portion (step S6).

Then a passivation film 707, consisting for example of silicon dioxide or silicon nitride, is formed over the entire area (step S7).

Then a recess is formed for connecting the second conductive layer with the exterior (step S8).

Then an anticavitation film 708 consisting for example of tantalum or chromium is formed (step S9).

Then an adhesion layer 730 consisting for example of aluminum or gold is formed in the connecting portion of the second conductive layer 706 and the partition wall 709 (step S10).

Then the partition wall 709, consisting for example of nickel, is fixed (step S11).

The above-explained example is intended to detect the presence/absence or state of the liquid in the second liquid path, but it will be easily understood that, even in case of forming the separated electrode portion 710, shown in FIG. 33, in the common liquid chamber, a higher sensitivity of detection can be achieved by utilizing the partition wall as the electrode as explained in the foregoing, and this situation applies also to a case where a member equivalent to the partition wall is provided on the cover plate.

The configurations of the first and second example explained in the foregoing provide the following effects:

(1) In these configurations, electric conductivity is given to at least a part of the partition wall for giving or receiving the electric signal to or from the exterior while an electrically conductive separated electrode portion is provided on the surface or in a part of the substrate and a predetermined detection pulse is applied to such partition wall or separated electrode portion to detect the difference in the potential or the variation in the capacitance between the separated electrode portion and the partition wall, whereby the state of liquid such as presence or absence thereof can be detected in a limited small portion within the ink jet recording head (preferably within a liquid path thereof);

(2) The shift register used for controlling the heat generation in the heat generating part is employed also for detecting the presence or absence of liquid in the plural liquid paths on time-shared basis, whereby the number of terminals does not increase significantly even in case the number of the detecting portions is increased (for example for detection in every liquid path); and (3) In these configurations, the first or second detection means is prepared on the substrate simultaneously with the elements for controlling the heat generation in the heat generating portion, whereby the foregoing effects can be attained almost without an increase in the cost.

Third Example

In the following there will be explained, with reference to the attached drawings, a third example of the present invention.

This example proposes, in the novel liquid discharge method utilizing a movable member, a method for detecting the displacement of the movable member for the purpose of more securely judging the discharge state of the liquid.

Figure 43:
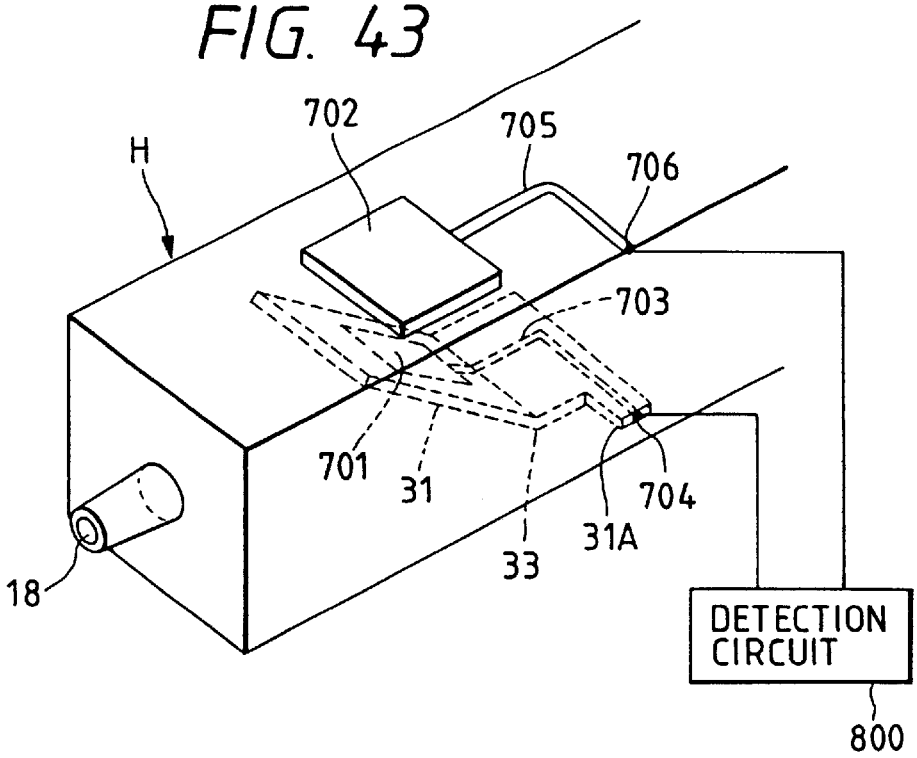
FIG. 43 is a partial perspective view showing an example of the configuration of a movable electrode and a fixed electrode shown in FIG. 42.

In this example, as shown in FIG. 43, a movable electrode 701 and a fixed electrode 702 are provided as displacement detection means for detecting the displacement of the movable member 31.

Figure 42:
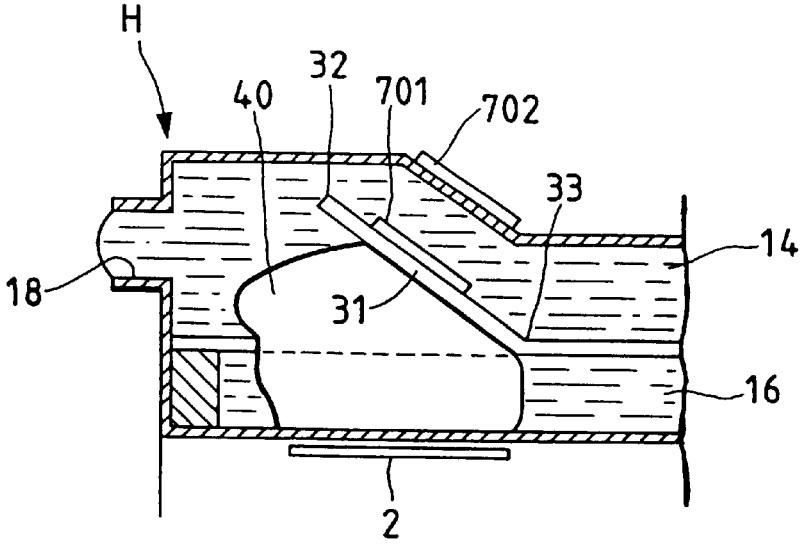
FIG. 42 is a partial cross-sectional view showing the principle for detecting the displacement of the movable member in a liquid discharge head of the present invention.

The movable electrode 701 is provided on the insulating movable member 31 while the fixed electrode 702 is provided on the outside of the first liquid path 14 in a head H, whereby, as shown in FIG. 42, the distance between the electrodes 701, 702 varies by the displacement of the movable member 31. These electrodes 701, 702 constitute a capacitor with the liquid present in the first liquid path 14 as the dielectric material, and the electrostatic capacitance of such capacitor varies according to the displacement of the movable member 31.

The electrostatic capacitance C of a capacitor is given by:

$$C=\in_0\times\in_s\times S/d$$

wherein $\in_0$ is dielectric constant of vacuum, $\in_s$ is dielectric constant of the dielectric material, S is area of the electrode and d is distance between the electrodes.

The dielectric material is the insulating member present between the movable electrode 701 and the fixed electrode 702. The ink and the wall of the liquid path 14 serve as the dielectric member by covering the movable electrode 701 with a non-conductive film in order that the current supplied to the movable electrode 701 does not leak into the ink. Since the area S of the electrode and the dielectric constant $\in_s$ are constant, the electrostatic capacitance C is inversely proportional to the distance d between the electrodes. Thus the displacement of the movable member 31 can be judged by the detection of the variation in the electrostatic capacitance C.

Also in case air enters from the discharge port 18 or ink becomes absent in the liquid path 14, the movable electrode 701 and the fixed electrode 702 are maintained in an electrically insulated state so that the displacement of movable member 31 can be detected.

Figure 44:
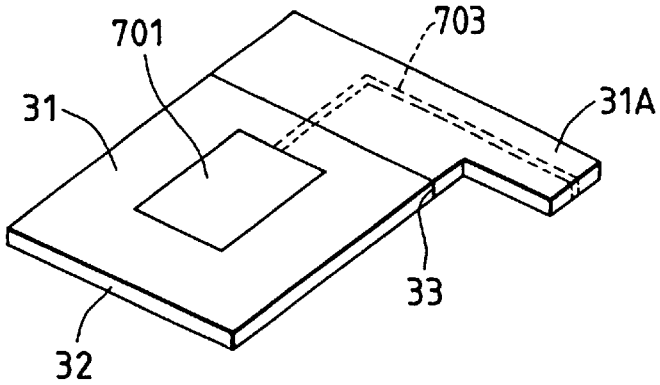
FIG. 44 is a partial perspective view showing an example of the configuration of the movable electrode shown in FIG. 42.

FIGS. 43 and 44 are schematic partial perspective views showing examples of the arrangement of the electrodes 701, 702. In this example, the movable electrode 701 composed of a metal plate is fixed to the movable member 31 and is electrically connected a wiring pattern 703 formed in the interior of the movable member 31. The wiring pattern 703 extends to a protruding portion 31A of the movable member 31 and is connected to an external connection terminal 704 of the head H. The movable electrode 701 may be formed as a thin film on the movable member 31, which may assume a one-member structure which bends about the fulcrum 33 or a composite structure in which two members are connected at the fulcrum 33. On the other hand, the fixed electrode 702 is formed with a metal plate fixed on the outside of the head H above the first liquid path 14, and is electrically connected to a connection terminal 706 by an external wiring 705. Also the fixed electrode 702 may be formed in the interior of the insulating wall of the head H or as a thin film on the outer or inner surface of the insulating wall.

The connection terminals 704, 706 are connected to a detection circuit 800 to be explained later. The head H is provided with plural nozzles each of which has the structure as shown in FIG. 43, and the wiring pattern 703 and the external patterns 705 of these nozzles can be common in a part.

Figure 45:
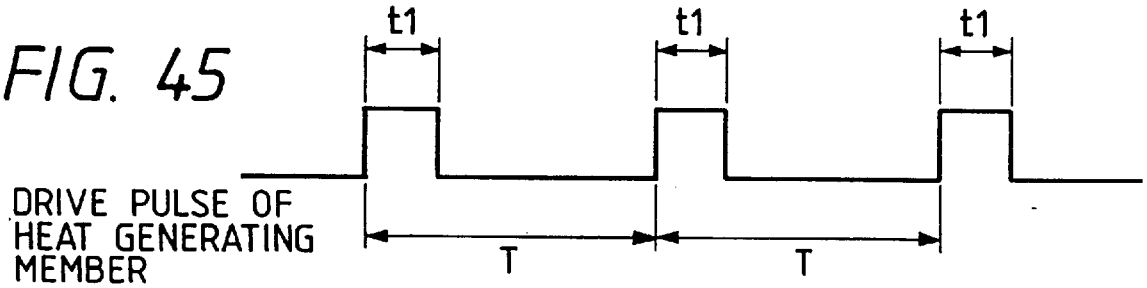
FIG. 45 is a chart showing driving pulses for causing heat generation in the heat generating member.

FIG. 45 is a view showing a driving pulse supplied for causing the heat generation in the heat generating member 2. The heat generation of the heat generating member 2 is caused by energization thereof for a time t1 in every predetermined cycle time T. The generated heat generates the bubble 40, inducing the displacement of the movable member 31 and causing the liquid to be discharged from the discharge port 18. The electrostatic capacitance between the electrodes 701, 702 is measured as will be explained in the following, when the heat generating member 2 effects sufficient heat generation.

Figure 46:
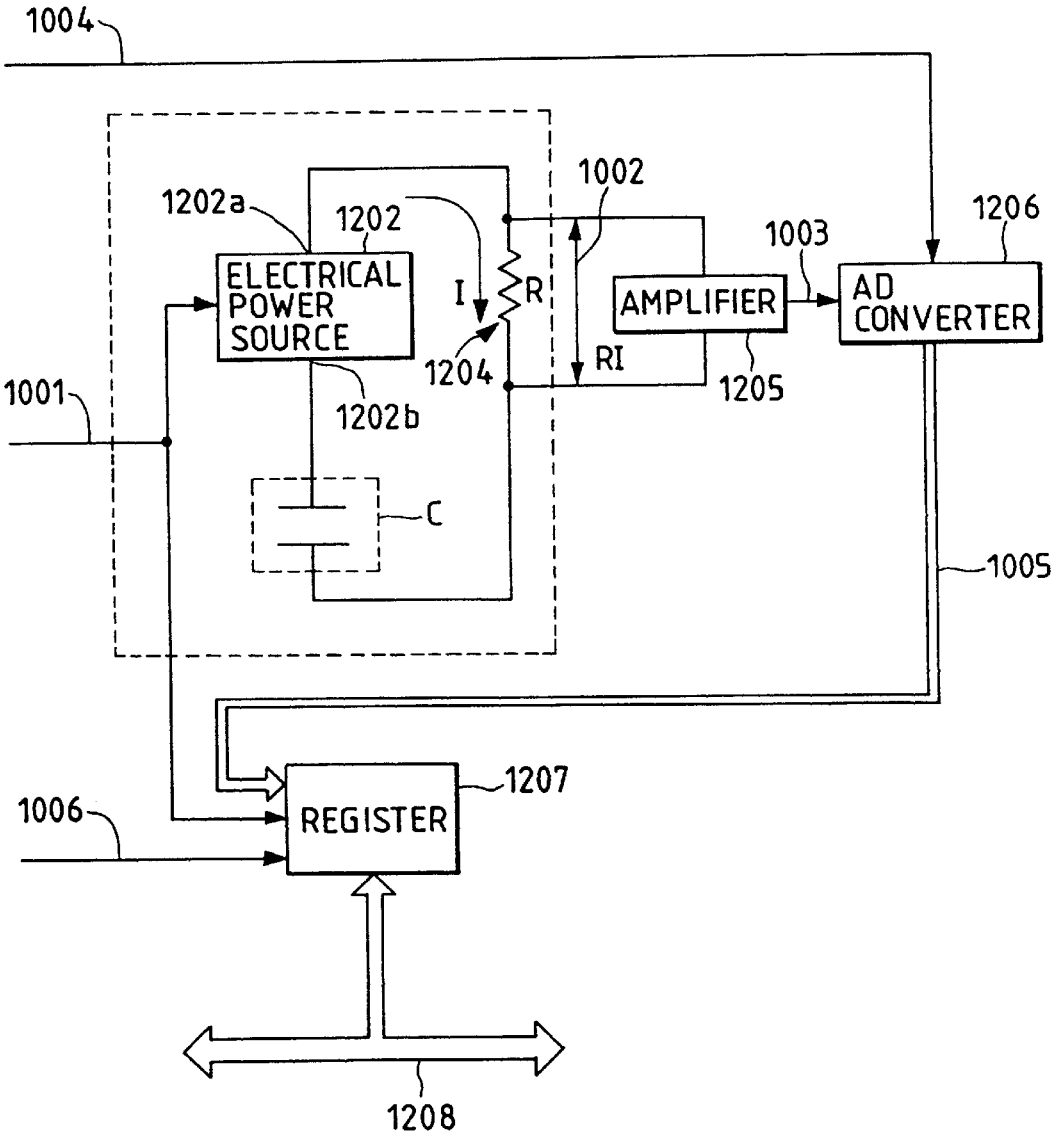
FIG. 46 is a circuit diagram of a detection circuit shown in FIG. 42.

FIG. 46 is a circuit diagram of the detection circuit 800 shown in FIG. 43, wherein C corresponds to the capacitor constituted by the electrodes 701, 702. This capacitor is serially connected to a power source 1202 and a resistor

1204 (resistance R), and a voltage E is outputted between terminals 1202*a* and 1202*b* during a detection period in which a detection period signal 1001 assumes a state "H". This voltage E causes a charging current I corresponding to the electrostatic capacitance of the capacitor C, whereby the resistor 1204 provides a terminal voltage RI. In a non-detection period in which the detection period signal 1001 assumes a state "L", the terminals 1202*a,* 1202*b* are rendered mutually conductive to sufficiently discharge the capacitor C and then become mutually insulated. The terminal voltage IR of the resistor 1204 is amplified by an amplifier 1205 to provide an amplified detection voltage 1003, which is digitized by an A/D converter 1206. A digital signal 1005 thus obtained is entered in a register 1207 at the downshift of an AD clock signal 1004, and is read by a CPU 302 (cf. FIG. 29) through a CPU bus 1208. In the present example, the CPU 302 is provided with judgment means for judging the discharge state of the liquid, based on the amount of variation of the current I.

Figure 47:
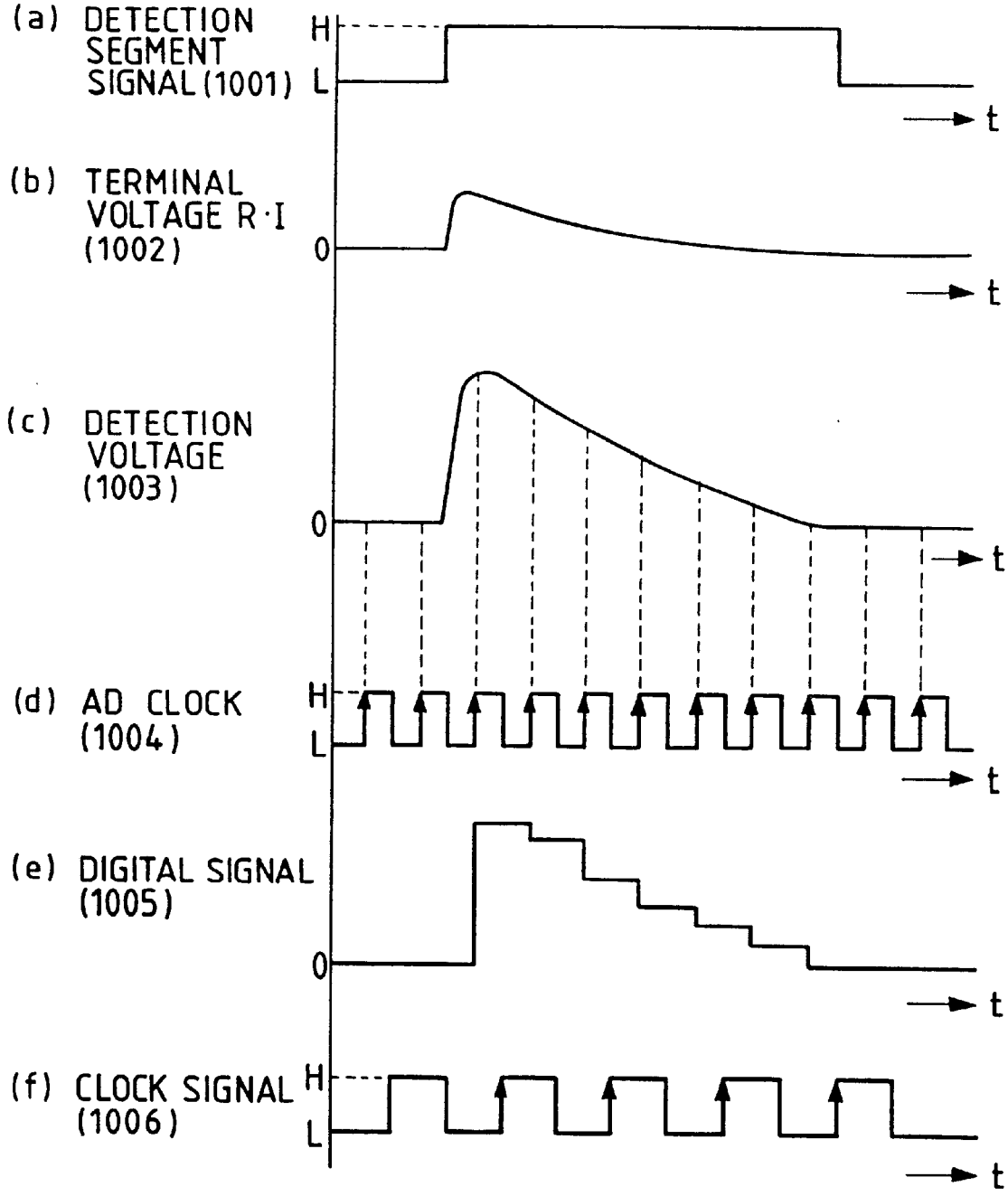
FIG. 47 is a timing chart showing the timing of the signal shown in FIG. 46.

FIG. 47 is a timing chart showing the timings of the signals 1001 to 1006 shown in FIG. 46, wherein the detection voltage 1003 (RI) (c) varies along a curve, according to the electrostatic capacitance of the capacitor C or the position of displacement of the movable member 31.

FIG. 48 is a chart showing the variation of the charging current I according to the electrostatic capacitance of the capacitor C or the position of displacement of the movable member 31. In the normal liquid discharge state in which the movable member 31 displaces to the normal upper position by the sufficient generation of the bubble 40, the charging current I varies as shown by a curve A. On the other hand, in case of lack of liquid discharge in which the movable member 31 is not displaced to the normal upper position by the insufficient generation of the bubble 40, the distance between the electrodes 701, 702 becomes large to reduce the electrostatic capacitance of the capacitor C, whereby the charging current varies as shown by a curve B. The amount of displacement of the movable member 31, or the discharge state of the liquid, can therefore be judged from such curves A and B.

Since such curves A, B correspond to the detection voltage 1003 in (c) of FIG. 47, the CPU 302 judges the discharge state of the liquid from the digital signal 1005 in (e) of FIG. 47 by means of the unrepresented judgement means and generates an alarm by unrepresented alarm means in case of the lack of liquid discharge. The user can confirm the lack of liquid discharge by such alarm and can take a countermeasure such as replacement of the head H. As a result, the user can promptly detect the lack of discharge of the recording ink, thereby dispensing with the correcting work for the prints so far made and maintaining a high recording precision, and such configuration is advantageous in cost as the mechanism of a large magnitude is not needed externally. The digital signal 1005 judged by the CPU 302 is prepared as judgment data for judging the discharge state of the liquid and is stored in a register 1207.

As explained in the foregoing, the configurations of the examples allow, in the liquid discharge method based on the novel discharge principle utilizing the movable member, namely the liquid discharge method capable of efficiently discharging the liquid in the vicinity of the discharge port by the multiplying effect of the generated bubble and the movable member displaced thereby, to judge the discharge state of the liquid by detecting the displacement of the movable member, thereby realizing the secure liquid discharge.

What is claimed is:

1. A recording head arranged with a plurality of discharge elements for generating discharge energy for discharging ink from a corresponding plurality of nozzles, comprising:

a driving element for driving said plurality of discharge elements;

a shift register for holding data for driving said driving elements; and detection means for detecting a discharge state of ink in each of the plurality of nozzles, said detection means including an electrode disposed at a fixed position in the recording head, said detection means detecting the discharge state based on an output change of said electrode accompanied with driving of the discharge elements by said driving element, wherein the detection means time-sharedly conducts a detection of a discharge state corresponding to each of said plurality of discharge elements by inputting data and a clock signal to said shift register.

2. A recording head according to claim 1, wherein said discharge elements are heaters for applying thermal energy to ink.

3. A recording head according to claim 2, wherein a bubble is generated in said nozzles by driving said heaters to cause an ink discharge.

4. A recording head according to claim 3, further comprising a valve member provided corresponding to each of said plurality of nozzles, the valve member being capable of moving accompanied with generation of said bubble.

5. A recording head according to claim 4, wherein said electrode is at least provided to said valve member and said detection means discriminates whether or not said valve member is moved to detect a discharge state of ink.

6. A method for generating discharge energy for discharging ink from a plurality of nozzles in a recording head arranged with a corresponding plurality of discharge elements, comprising the steps of:

driving said plurality of discharge elements;

holding data in a shift register for driving said driving elements; and detecting a discharge state of ink in each of the plurality of nozzles, said detection step including detecting the discharge state based on an output chance of an electrode disposed at a fixed position in the recording head, accompanied with driving of the discharge elements by said driving step, wherein the detection step time-sharedly conducts a detection of a discharge state corresponding to each of said plurality of discharge elements by inputting data and a clock signal to said shift register.

7. A method according to claim 6, wherein said discharge elements are heaters that apply thermal energy to ink.

8. A method according to claim 7, wherein in said driving step a bubble is generated in said nozzles by driving said heaters to cause an ink discharge.

9. A method according to claim 8, further comprising the step of providing a valve member corresponding to each of said plurality of nozzles, the valve member being capable of moving accompanied with generation of said bubble.

10. A method according to claim 9, wherein said electrode is at least provided to said valve member and said detection step discriminates whether or not said valve member is moved to detect a discharge state of ink.

* * * * *